US007151497B2

(12) United States Patent
Crystal

(10) Patent No.: US 7,151,497 B2
(45) Date of Patent: Dec. 19, 2006

(54) COAXIAL ANTENNA SYSTEM

(76) Inventor: Bonnie A. Crystal, Milisec Incorporated Ste 200 1840 Gateway Dr., San Mateo, CA (US) 94404

( * ) Notice: Subject to any disclaimer, the term of this patent is extended or adjusted under 35 U.S.C. 154(b) by 0 days.

(21) Appl. No.: 10/886,292

(22) Filed: Oct. 28, 2004

(65) Prior Publication Data

US 2005/0040991 A1 Feb. 24, 2005

(51) Int. Cl.
*H01Q 9/16* (2006.01)

(52) U.S. Cl. ..... 343/747; 34/792

(58) Field of Classification Search ..... 343/745, 343/747, 750, 792
See application file for complete search history.

(56) References Cited

U.S. PATENT DOCUMENTS 4,543,583 A * 9/1985 Wurdack ..... 343/792
5,157,393 A * 10/1992 Fox et al. ..... 340/870.3
6,549,175 B1 * 4/2003 Cencich et al. ..... 343/830

* cited by examiner

*Primary Examiner*—Tho Phan

(57) ABSTRACT

An antenna system of coaxial elements and terminating impedances produces controlled bandwidth, broadband, and wideband performance under a variety of near field influences, with capability for simultaneous and alternating reception and radiation of electromagnetic radio energy. The antenna system enables broader bandwidths within miniaturized areas of confinement relative to wavelength. Singular elements of the system enable, and a plurality of elements of the system are combined to form specific bandpass, band reject, duplexing, and diplexing for radio frequencies as a function of the antenna system. The antenna system features complex terminating impedances which combine with characteristic impedances of coaxial structures to yield efficient radiating and matching functions for radio energy over a controlled bandwidth. The antenna system simultaneously utilizes the skin effect of electron flow with different vectors flowing on the internal and the external surfaces of the outside conductor of coaxial antenna elements with different vectors.

34 Claims, 53 Drawing Sheets

COAXIAL ANTENNA SYSTEM

BACKGROUND OF THE INVENTION

Antennas and antenna systems are utilized with radio frequency transmission and reception devices for communications and control. An antenna system is the combination of the electromagnetic radiation elements of an antenna, the feedline, the matching networks, the impedance circuitry, and the physical structure of an interface between electromagnetic space fields and the radio frequency input/output port of a radio frequency transmitter or receiver device. Different types of antenna systems are valuable for certain applications which require specific physical and electrical characteristics. The bandwidth and impedance match of an antenna system is very important for both broadband and narrowband signals used by devices for communications and control in the electromagnetic spectrum. Many electronic radio frequency devices which utilize antennas require that the impedance of the antenna system closely matches the impedance of the radio frequency device circuits. In previously known conventional dipole and monopole antenna systems, resonant wires and conductive bars or plates are used as radiating elements. Added matching circuits in the radio frequency device circuitry or at the junction of the feedline and antenna element feedpoint of the system are utilized in an effort to match the impedance and resonance to that required by the radio frequency device so that useful electronic signals may be conveyed efficiently. The evolution of predominant spectrum use from narrowband to broadband radio frequency communication devices requires new antenna system characteristics. For best performance, an antenna system should provide a good impedance match and electromagnetic radiation efficiency within the desired broadband part of the spectrum, and it may be desirable to reject other bands of non-interest.

Disclosure of the Invention

Description of the Invention and the Preferred Embodiment of the Invention

BRIEF DESCRIPTION OF THE INVENTION AND THE DRAWING FIGURES

FIG. 1 shows the coaxial antenna system, shown in dipole configuration, with two end impedance terminations FIG. 2 shows the coaxial antenna system, shown in dipole configuration, with one end impedance termination FIG. 3 shows the coaxial antenna system, shown in monopole configuration, with one end termination, and an rf ground reference connection FIG. 4 shows the coaxial antenna system, shown in monopole configuration, with one end termination, and one rf ground connection FIG. 5 shows the coaxial antenna system, shown in monopole configuration, with one end termination, one feedpoint termination and one rf ground FIG. 6 shows the coaxial antenna system, shown in monopole configuration, with one end termination, one feedpoint termination and one rf ground, showing radiating and receiving element bent or meandered FIG. 7 shows the coaxial antenna system, with an end termination, an rf ground connection, and a coaxial line connecting a terminating impedance to the rf ground and radiating and receiving element.

FIG. 8 shows the coaxial antenna system, shown in monopole configuration, with one end termination, one feedpoint termination and one rf ground, showing radiating and receiving element curved or bent into a specific shape or polarization FIG. 9 shows the coaxial antenna system, shown in dipole configuration, with end terminations, showing radiating and receiving elements curved or bent into a specific shape or polarization FIG. 10 shows the coaxial antenna system, shown in dipole configuration, with end terminations, showing radiating and receiving elements coupled electromagnetically to adjacent conductive materials FIG. 11 shows the coaxial antenna system, shown in dipole configuration, with end terminations, showing radiating and receiving elements partially or completely bent or spiraled FIG. 12 shows the coaxial antenna system, shown in dipole configuration, with end terminations and central termination FIG. 13 shows the coaxial antenna system, with an end termination of the radiating and receiving element, a coaxial line connection and a coaxial sleeve surrounding the coaxial transmission line.

Figure 16:
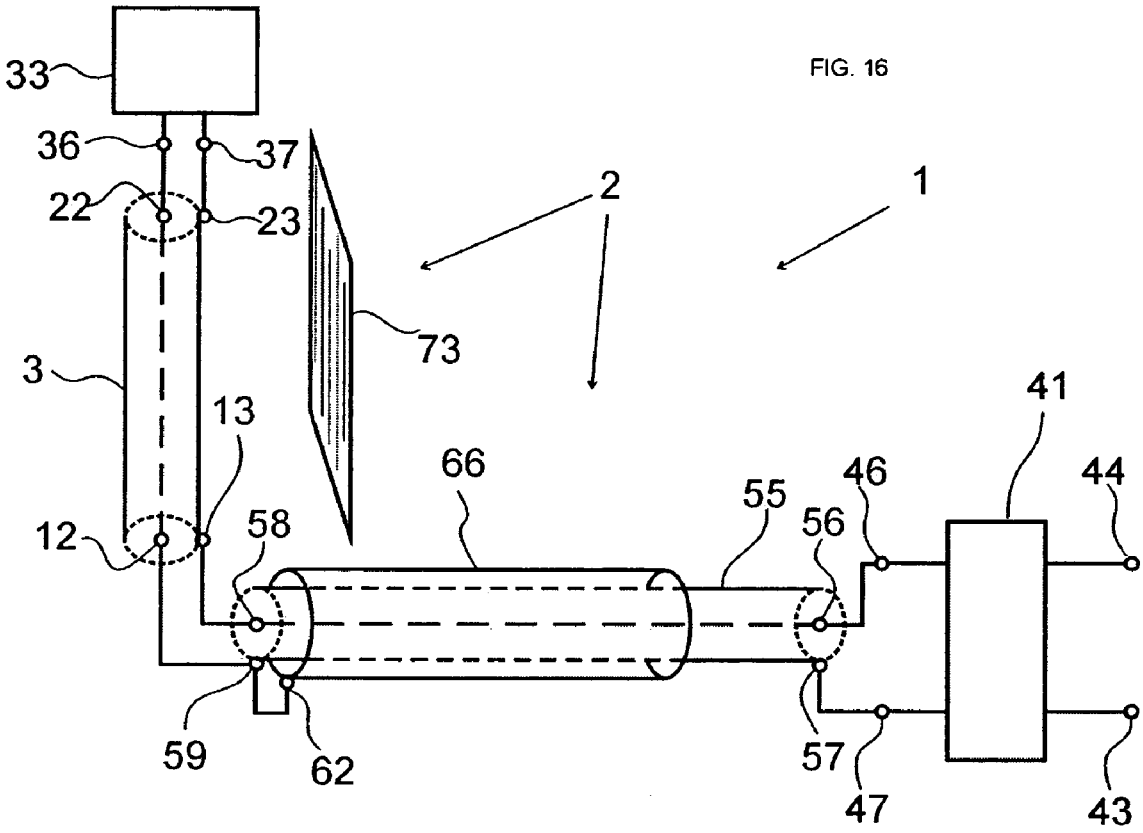
Figure 17:
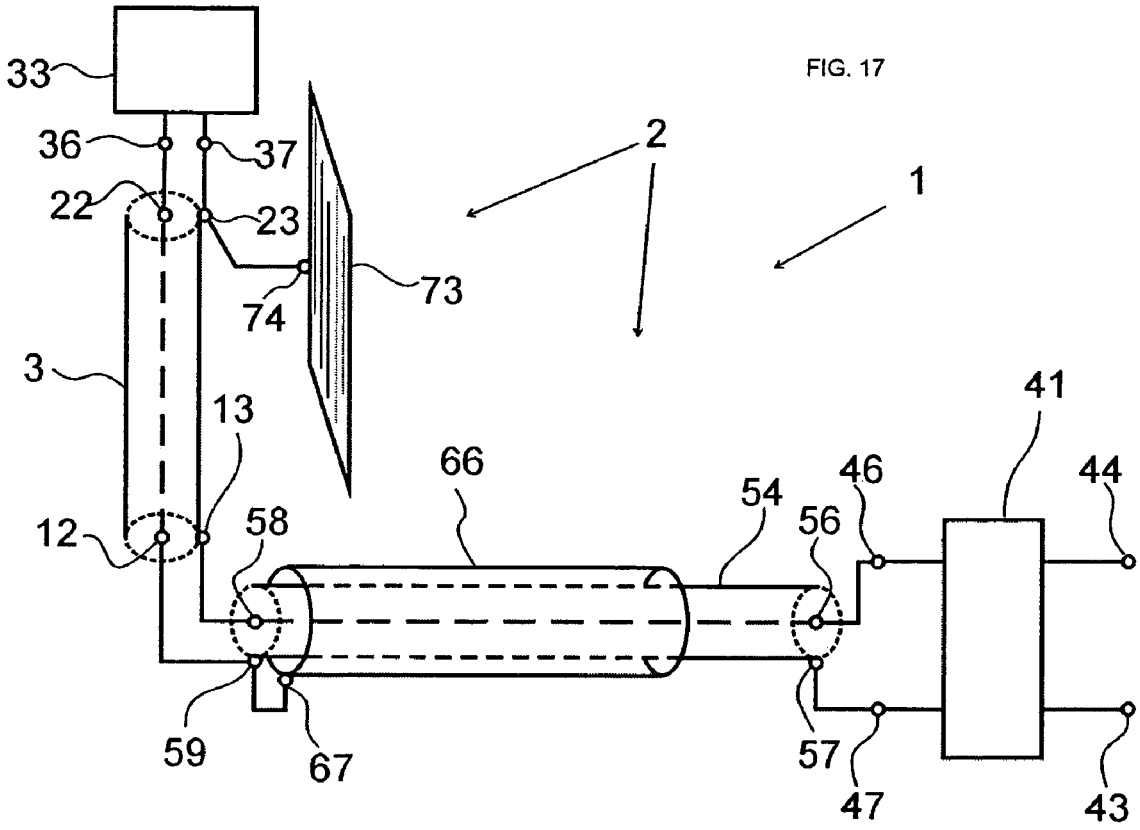

FIG. 16 shows the coaxial antenna system, with an end termination of the radiating and receiving element, a coaxial line connection, a coaxial sleeve surrounding the coaxial transmission line, showing radiating and receiving element coupled and/or connected to adjacent conductive materials FIG. 17 shows the coaxial antenna system, with an end termination of the radiating and receiving element, a coaxial line connection, a coaxial sleeve surrounding the coaxial transmission line, showing radiating and receiving element coupled and/or connected to adjacent conductive materials.

Figure 18:
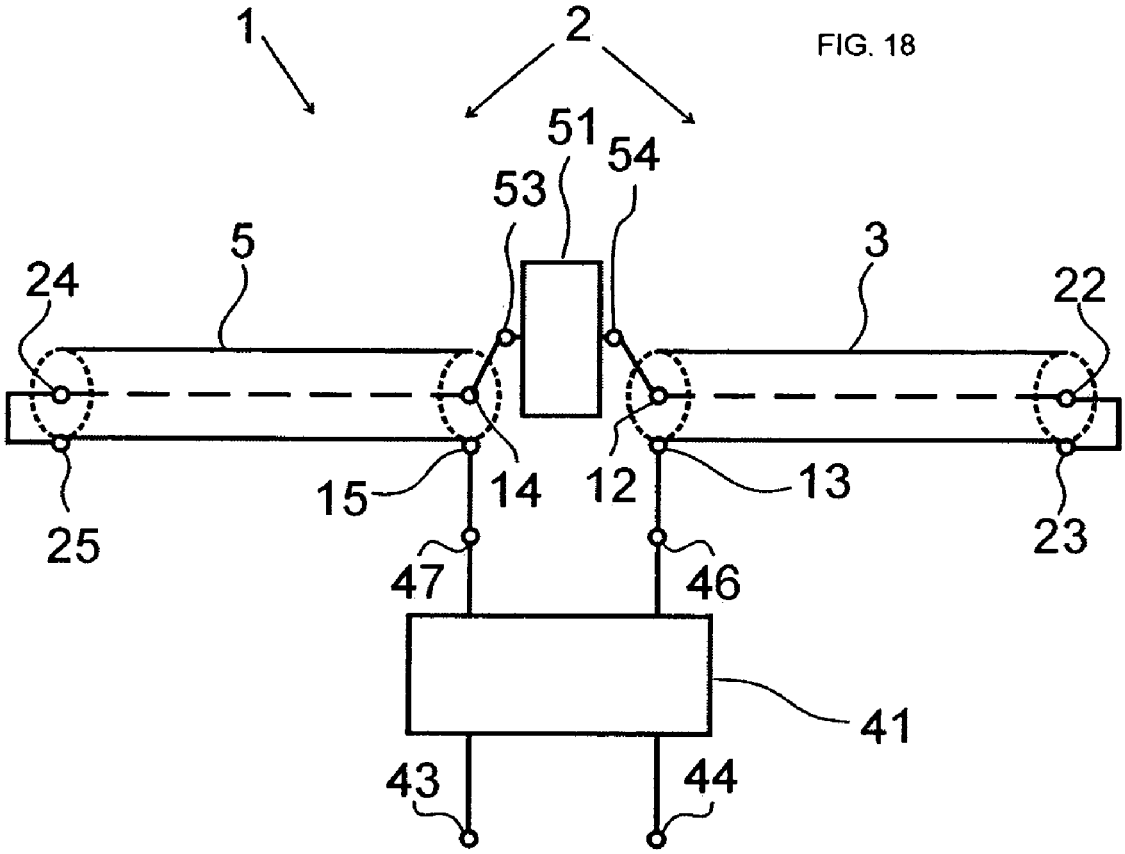

FIG. 18 shows the coaxial antenna system, shown in dipole configuration, with one central termination between the inner conductors of the coaxial elements, and ends of the radiating and receiving elements shorted between the center and the outer conductors of the radiating and receiving elements.

Figure 19:
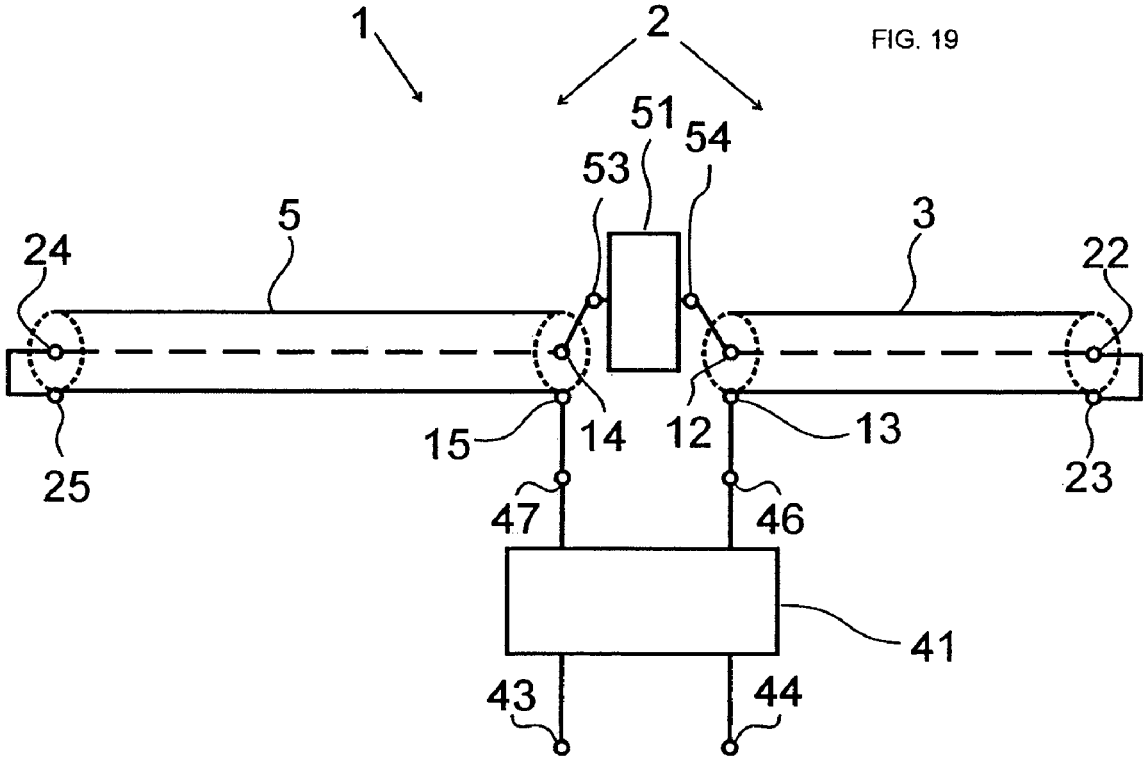

FIG. 19 shows the coaxial antenna system, shown in dipole configuration, with one central termination, between the inner conductors of the coaxial elements, and ends of the unequal length radiating and receiving elements shorted between the center and the outer conductors of the unequal length radiating and receiving elements.

Figure 20:
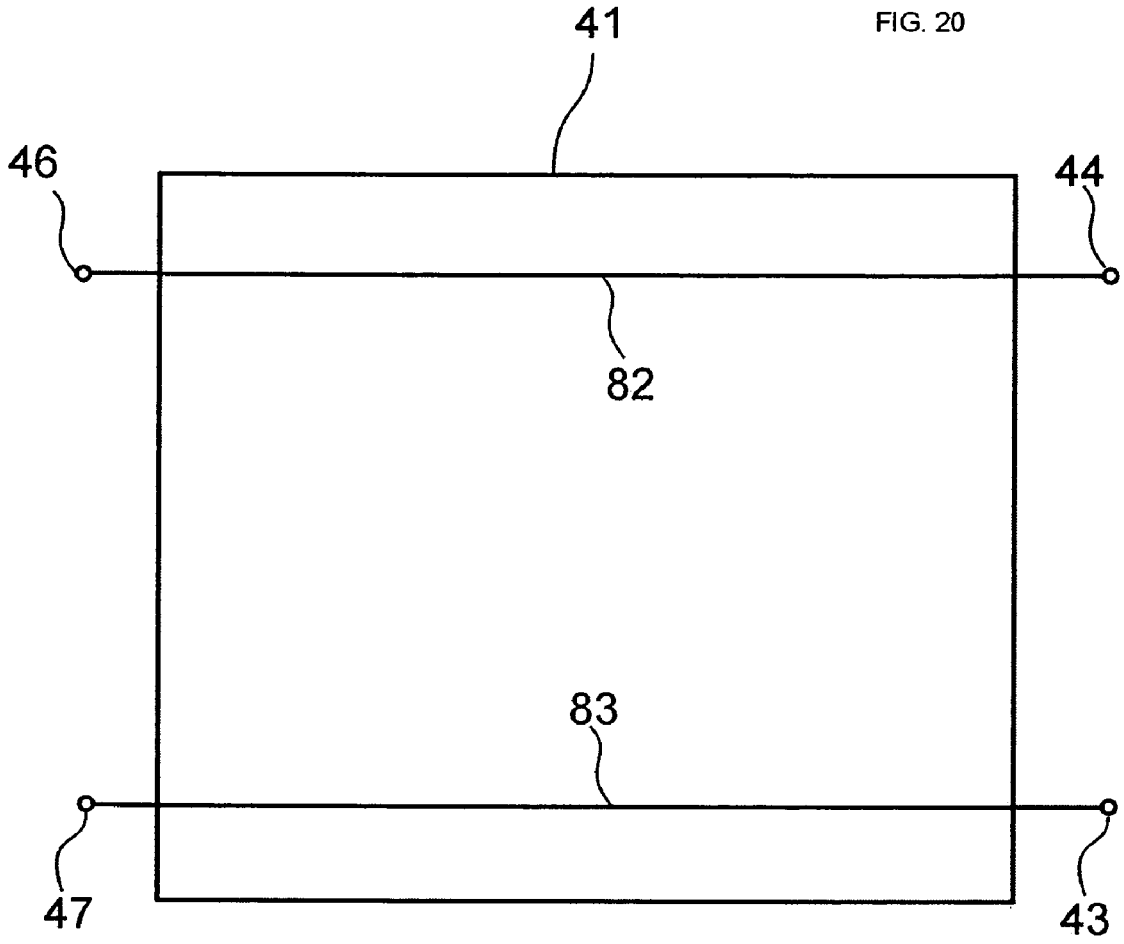

FIG. 20 shows the coaxial antenna system feedpoint unit for connection to radiating and receiving elements and transmitter or receiver, showing a straight through connection.

Figure 21:
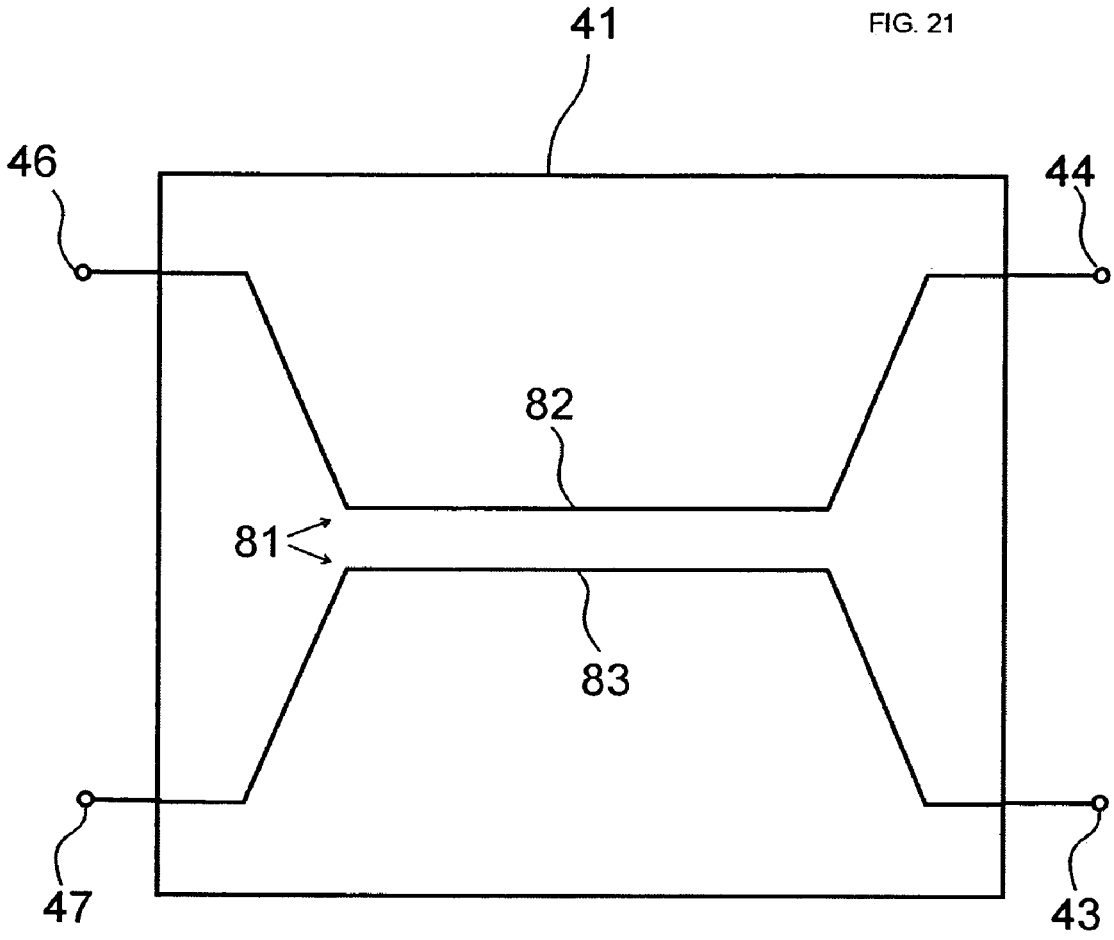

FIG. 21 shows the coaxial antenna system feedpoint unit for connection to radiating and receiving elements and transmitter or receiver, showing a straight through connection of a transmission line.

Figure 22:
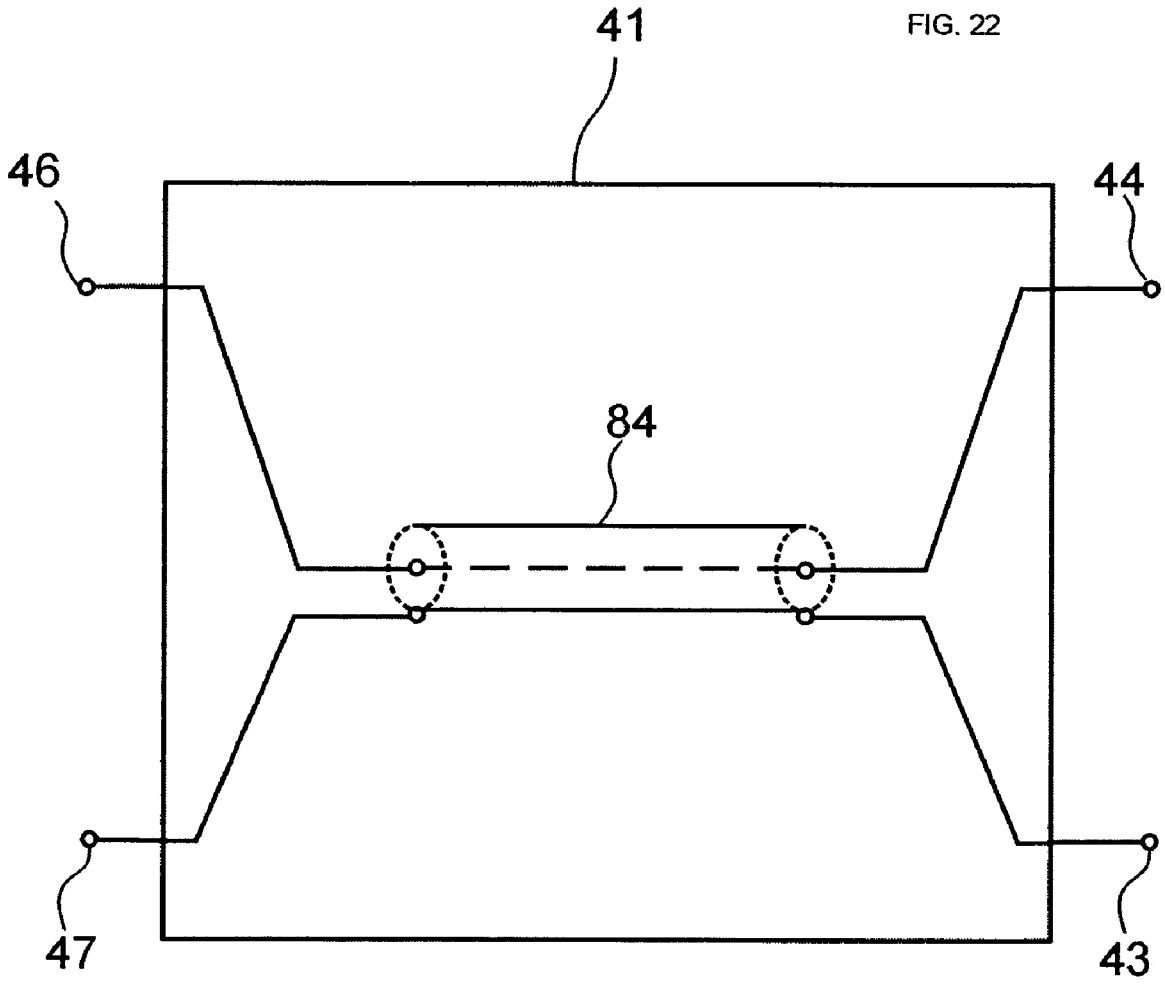

FIG. 22 shows the coaxial antenna system feedpoint unit for connection to radiating and receiving elements and transmitter or receiver, showing a straight through connection of a coaxial transmission line.

Figure 23:
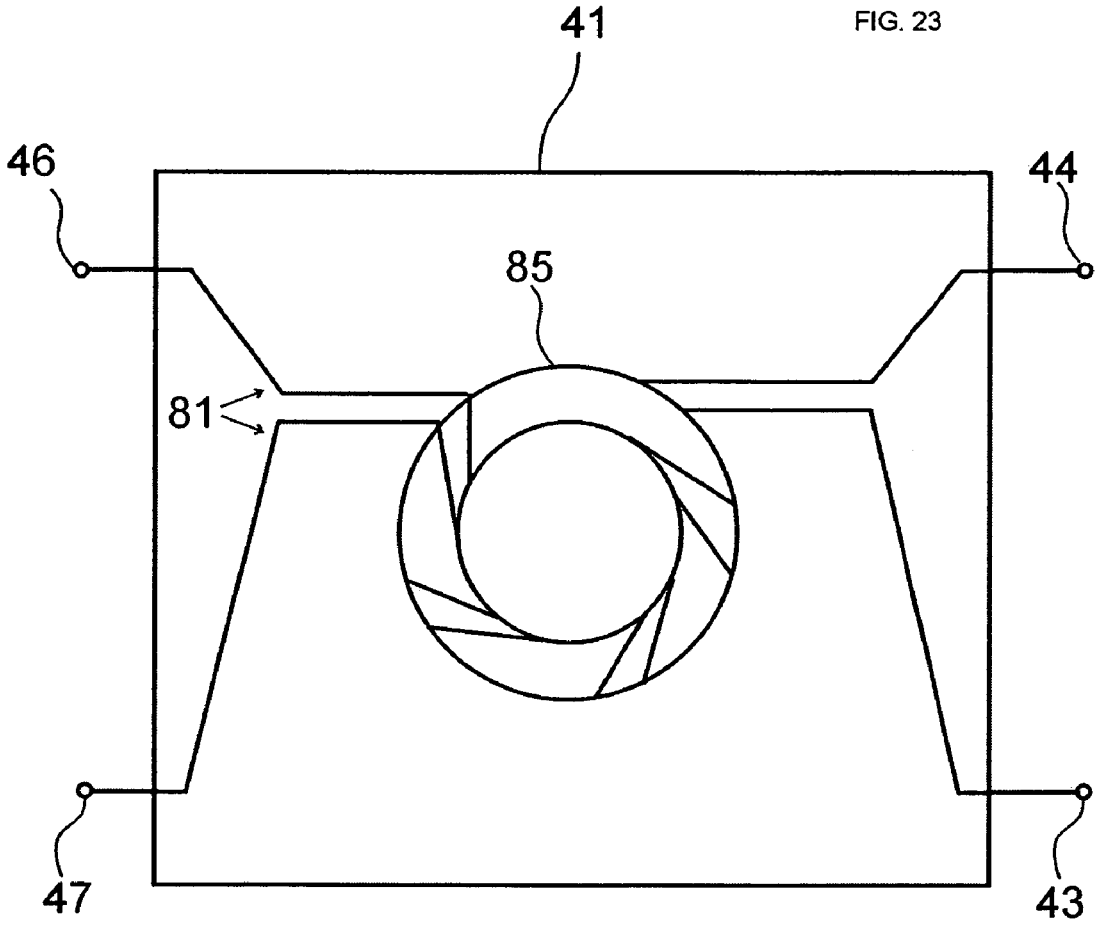

FIG. 23 shows the coaxial antenna system feedpoint unit for connection to radiating and receiving elements and transmitter or receiver, showing connection of a balanced to unbalanced isolation transformer or balun.

Figure 24:
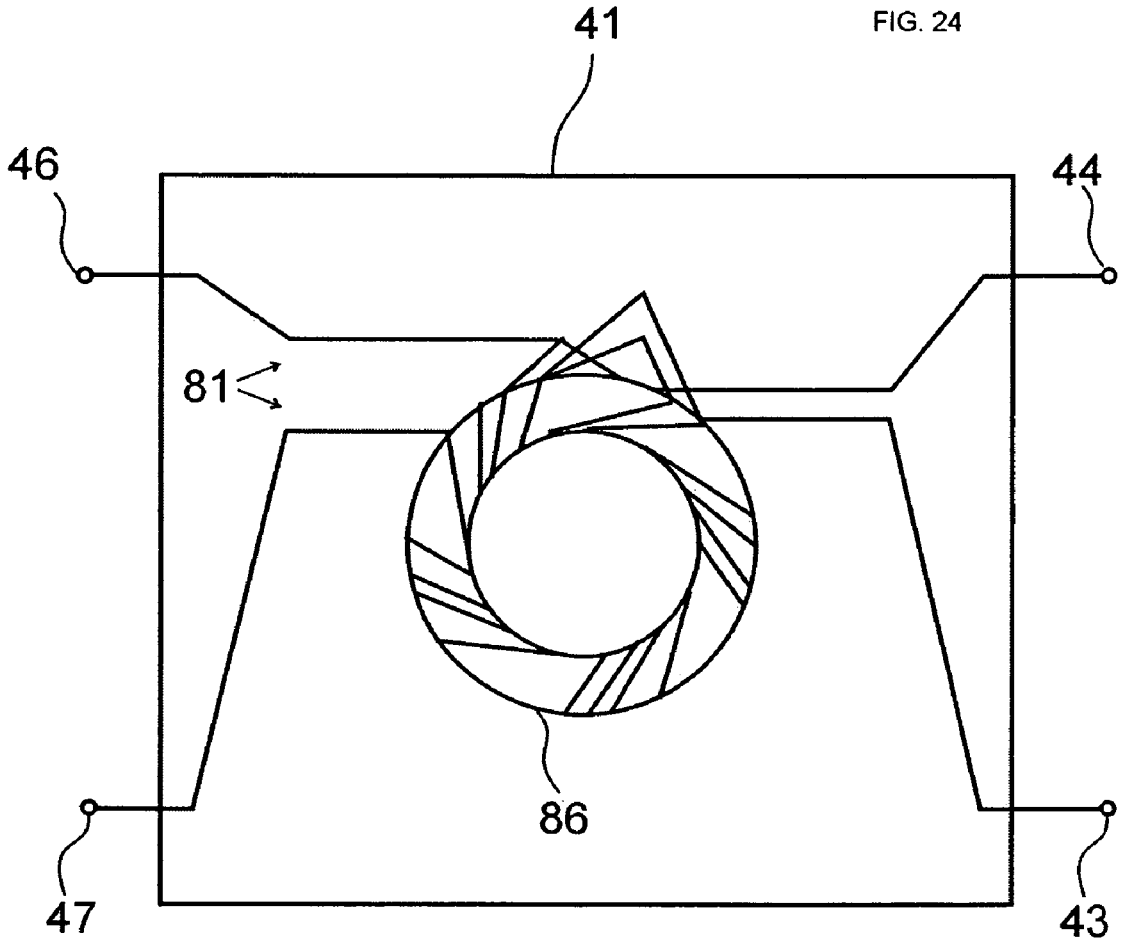

FIG. 24 shows the coaxial antenna system feedpoint unit for connection to radiating and receiving elements and transmitter or receiver, showing connection of an rf impedance transforming transformer or balun or unun.

Figure 25:
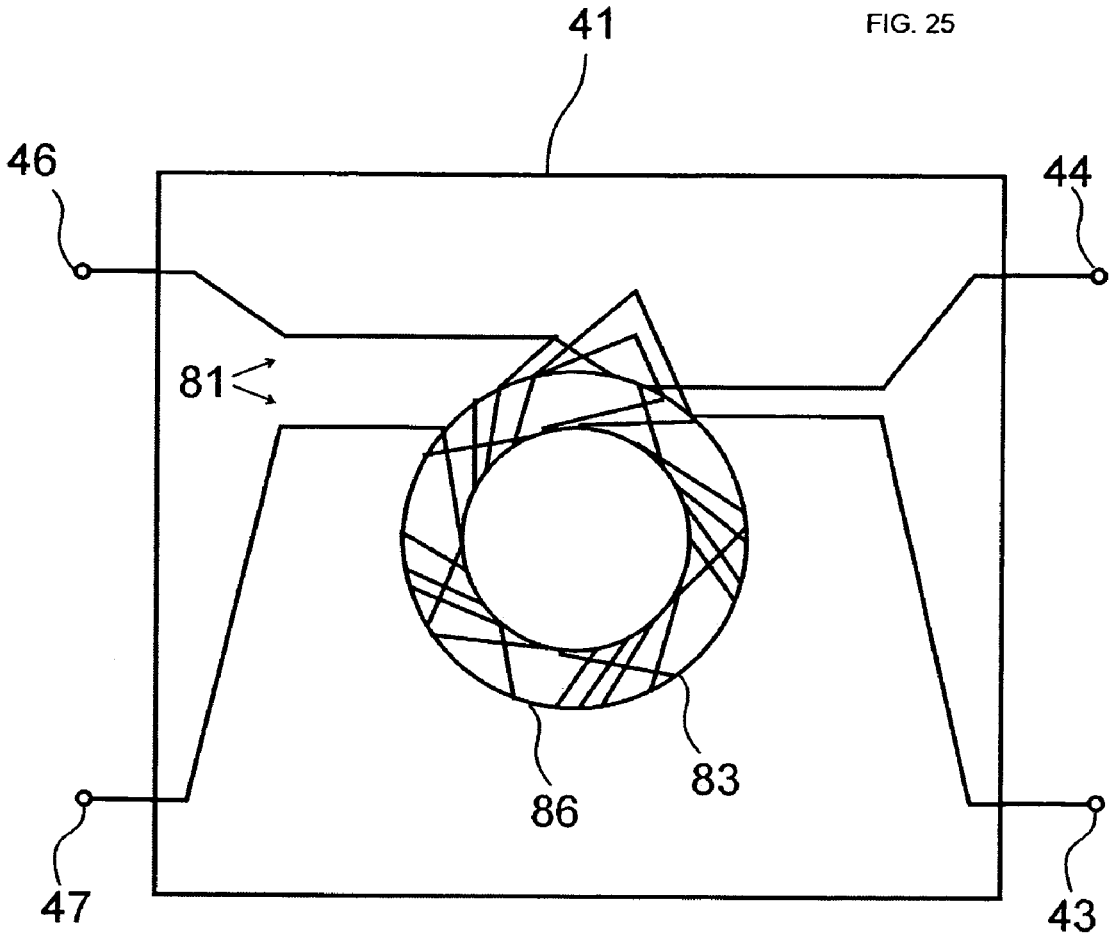

FIG. 25 shows the coaxial antenna system feedpoint unit for connection to radiating and receiving elements and transmitter or receiver, showing connection of an rf impedance transforming transformer combined with an isolation balun.

Figure 26:
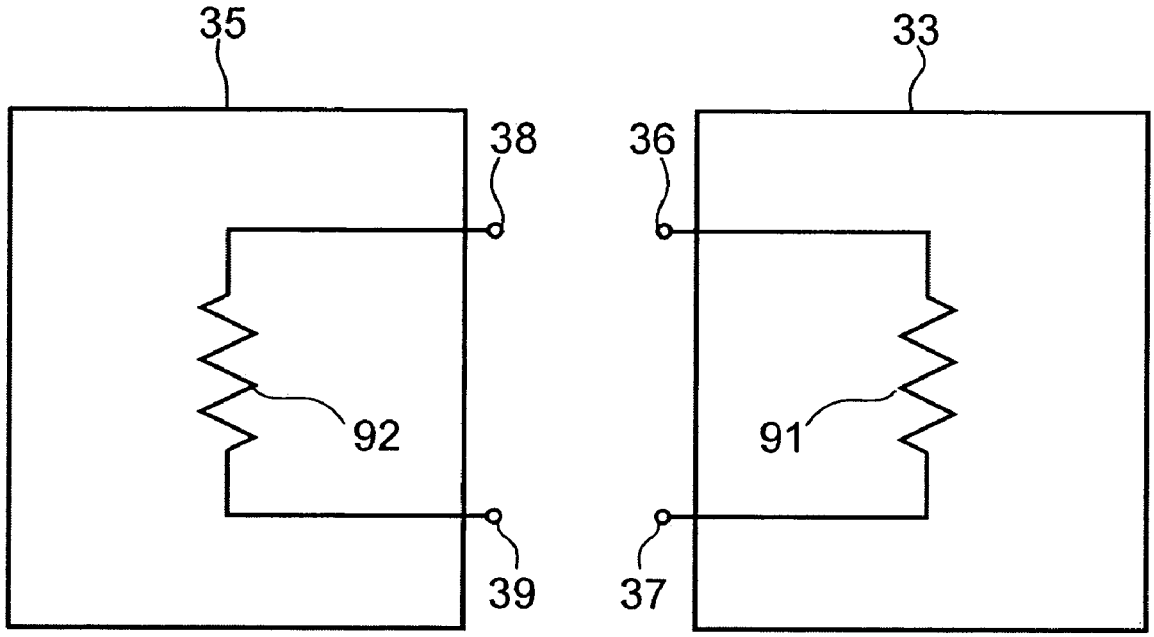

FIG. 26 shows the coaxial antenna system element termination units for connection to ends of radiating and receiving elements, showing connection of a resistance.

Figure 27:
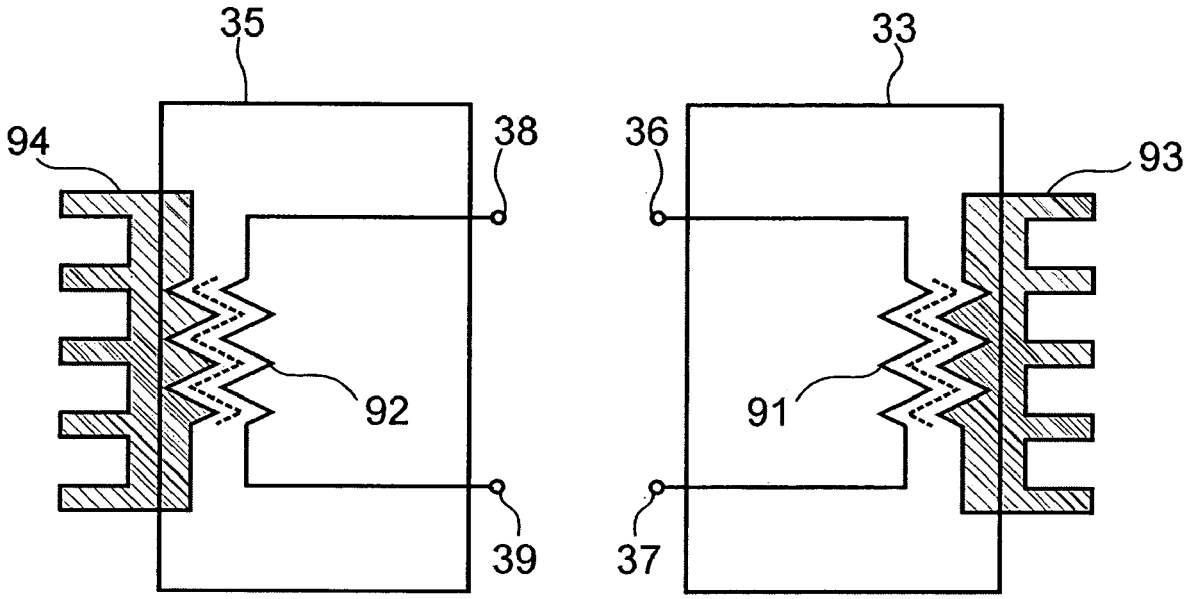

FIG. 27 shows the coaxial antenna system element termination units for connection to ends of radiating and receiving elements, showing connection of a resistance with a heat sink.

Figure 28:
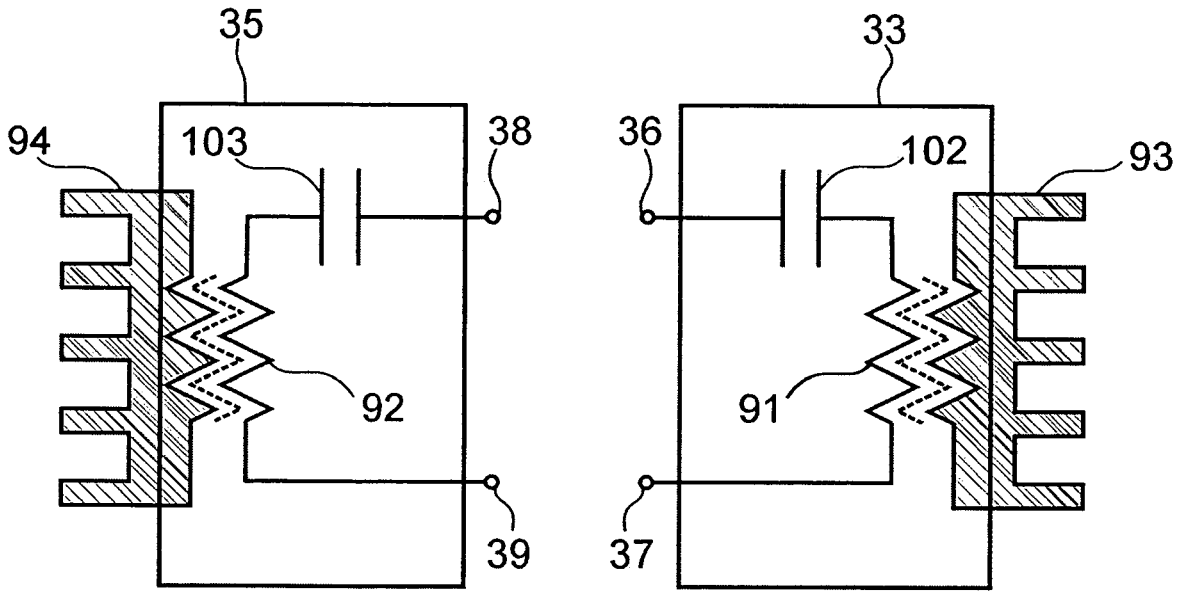

FIG. 28 shows the coaxial antenna system element termination units for connection to ends of radiating and receiving elements, showing connection of a capacitive reactance and a resistance with a heat sink.

Figure 29:
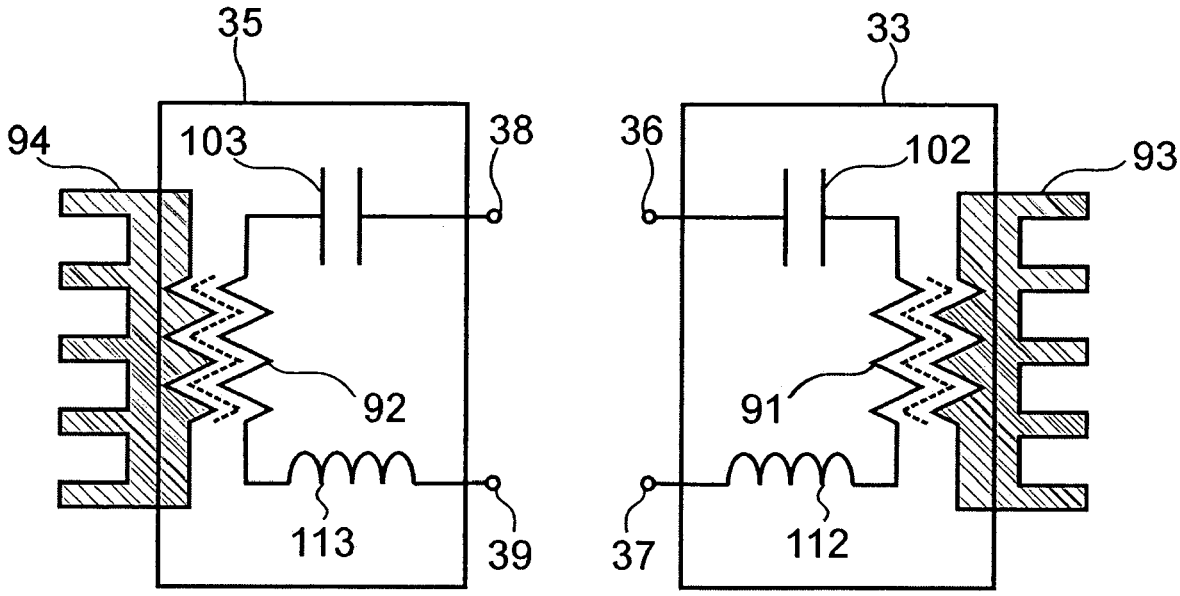

FIG. 29 shows the coaxial antenna system element termination units for connection to ends of radiating and receiving elements, showing connection of a series capacitive reactance, inductive reactance, and resistance with a heat sink.

Figure 30:
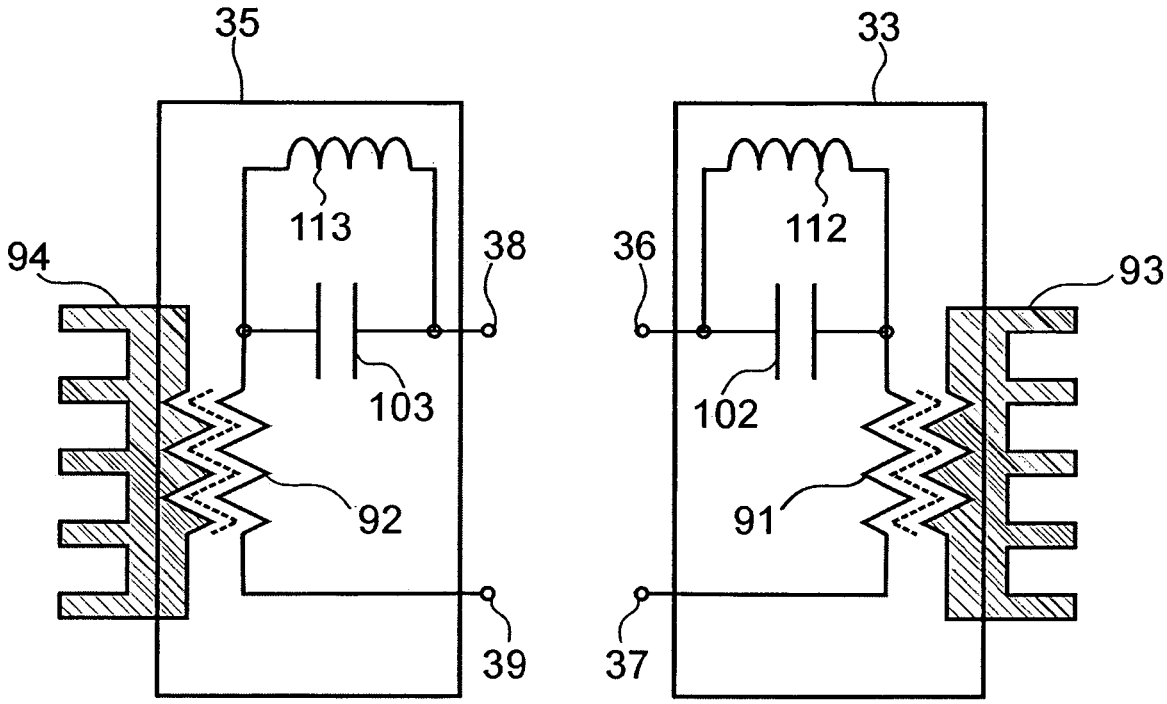

FIG. 30 shows the coaxial antenna system element termination units for connection to ends of radiating and receiving elements, showing connection of a parallel capacitive reactance and inductive reactance, in series with a resistance with a heat sink.

Figure 31:
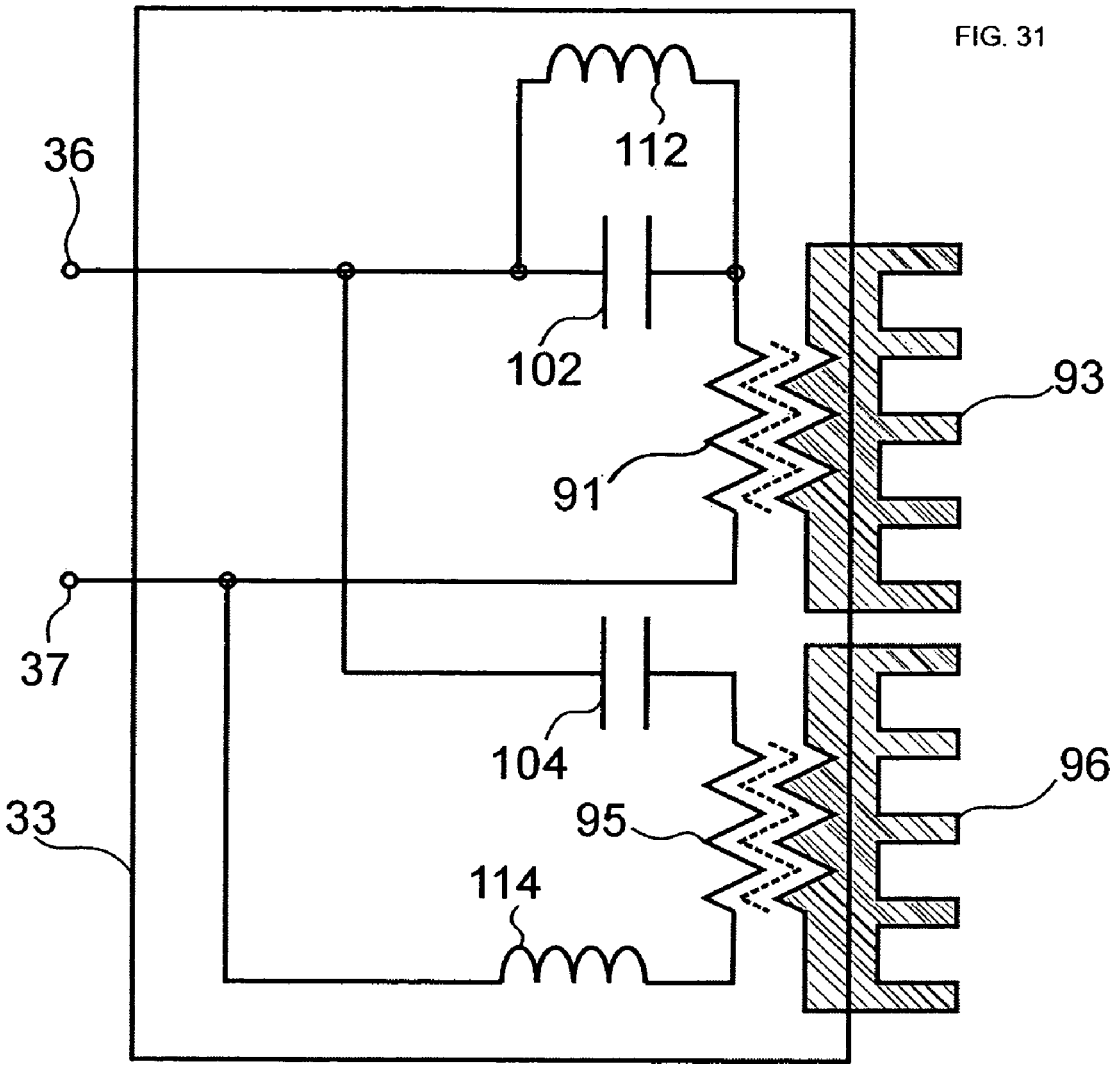

FIG. 31 shows the coaxial antenna system element termination unit for connection to ends of radiating and receiving elements, showing parallel connection of: a parallel capacitive reactance and inductive reactance, in series with a resistance with a heat sink; and a series capacitive reactance, inductive reactance, and resistance with a heat sink.

Figure 32:
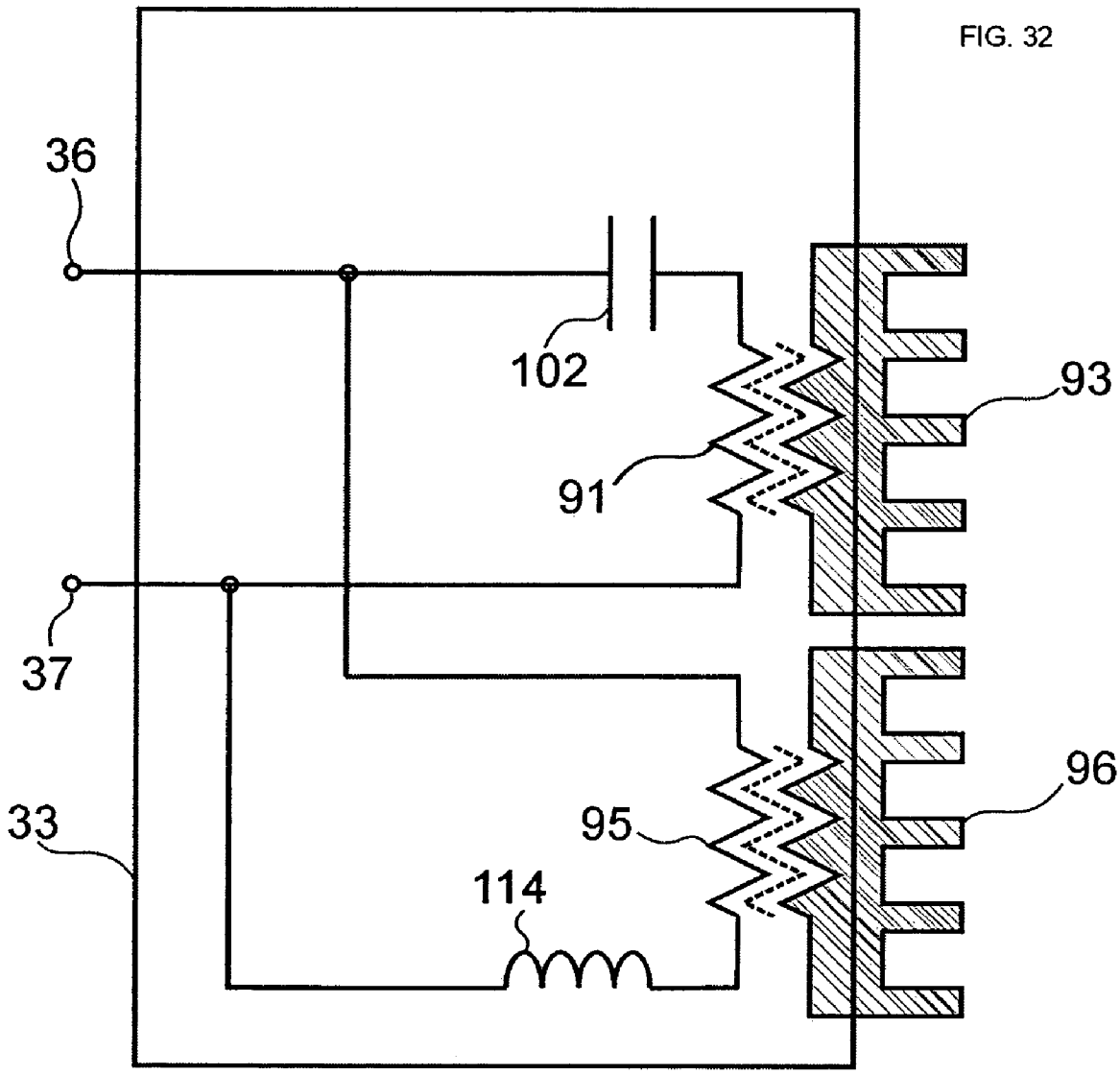

FIG. 32 shows the coaxial antenna system element termination unit for connection to ends of radiating and receiving elements, showing parallel connection of: a series inductive reactance and a resistance with a heat sink; and a series capacitive reactance and a resistance with a heat sink.

Figure 33:
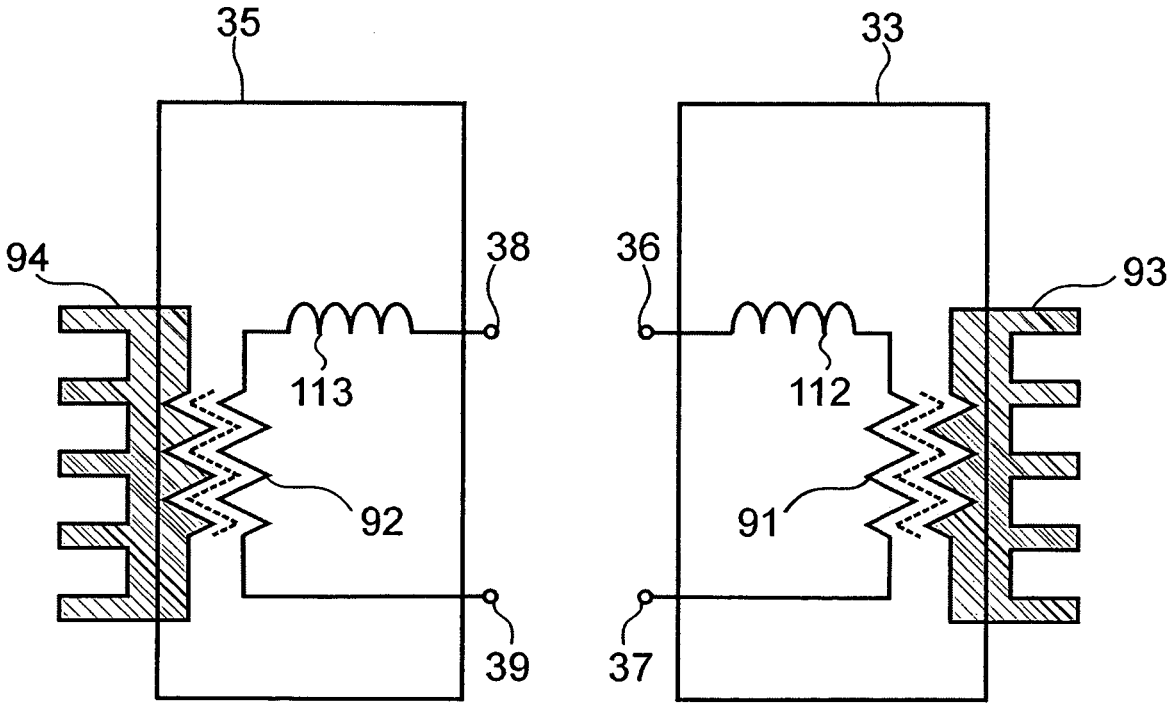

FIG. 33 shows the coaxial antenna system element termination units for connection to ends of radiating and receiving elements, showing a series connection of an inductive reactance and a resistance with a heat sink.

Figure 34:
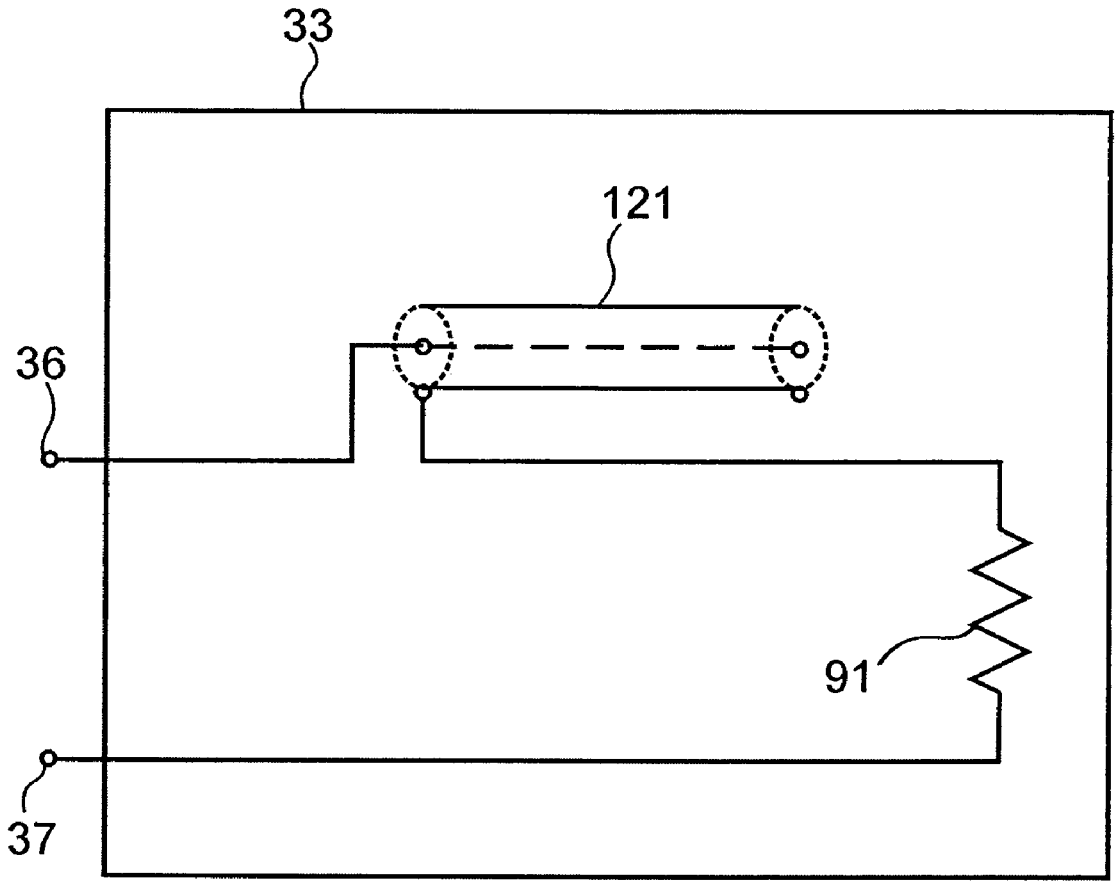

FIG. 34 shows the coaxial antenna system element termination units for connection to ends of radiating and receiving elements, showing a series connection of a coaxial open stub line and a resistance.

Figure 35:
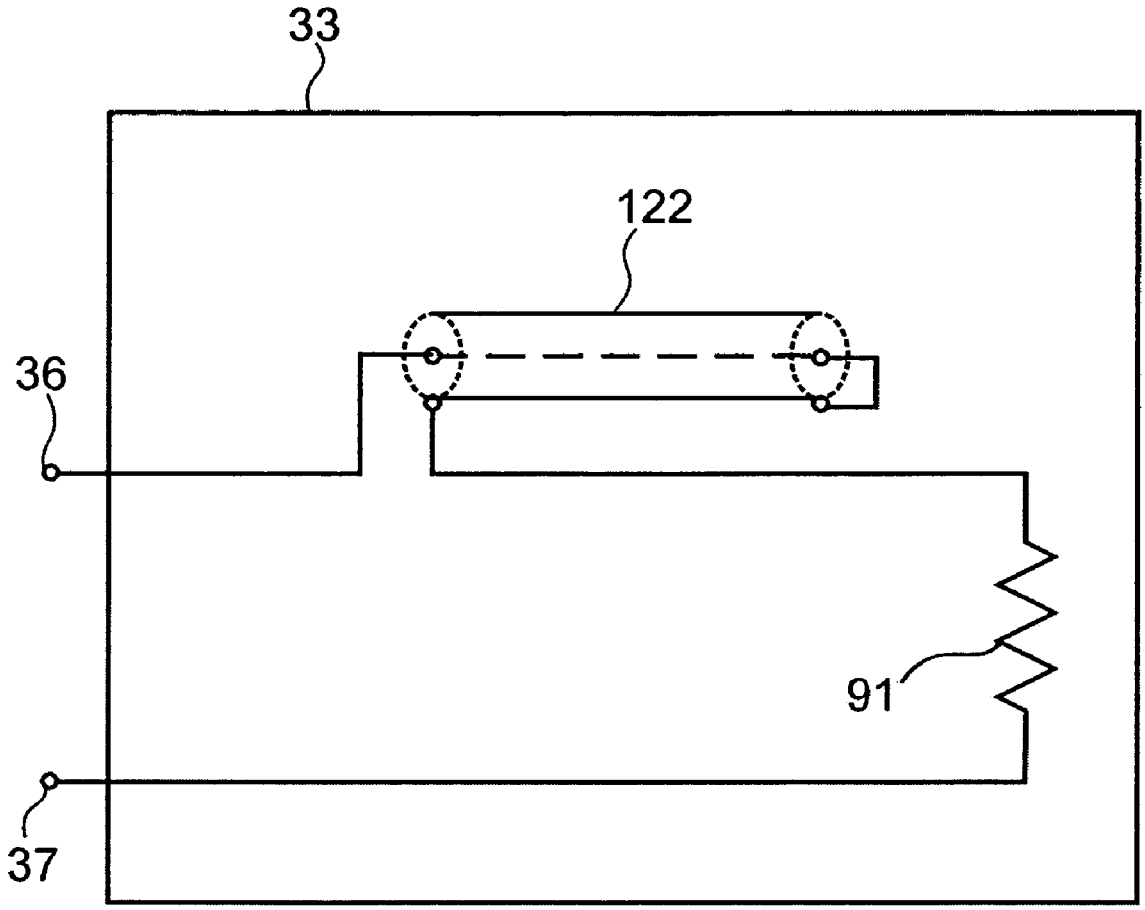

FIG. 35 shows the coaxial antenna system element termination units for connection to ends of radiating and receiving elements, showing a series connection of a coaxial shorted stub line and a resistance.

Figure 36:
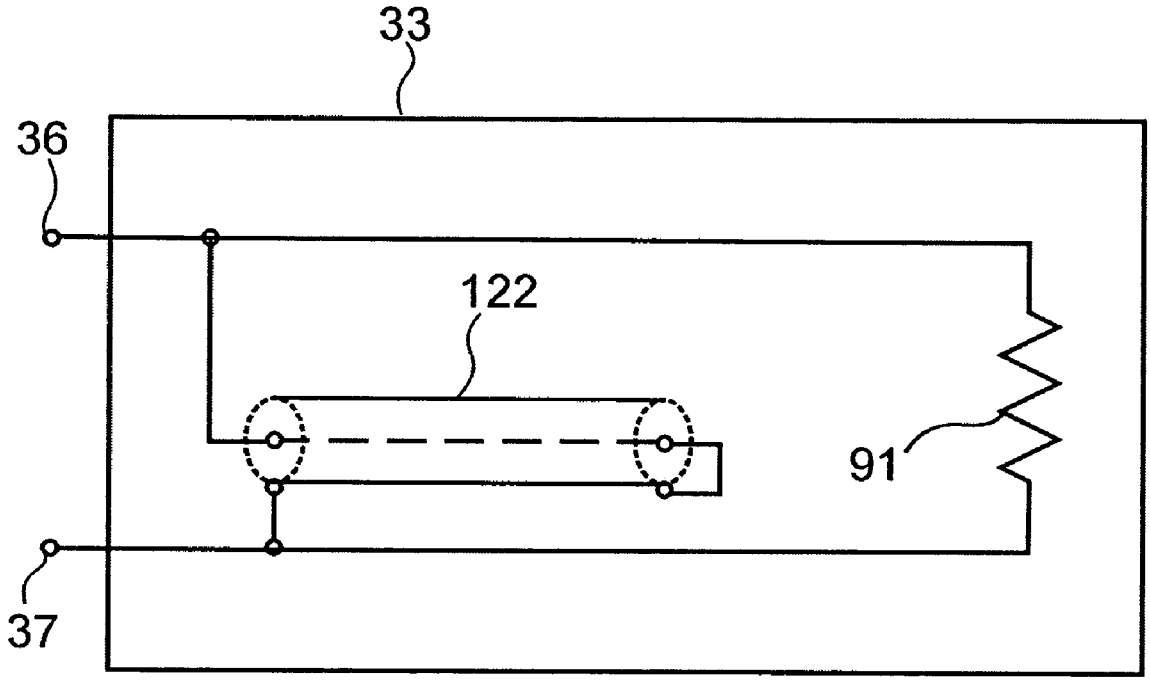

FIG. 36 shows the coaxial antenna system element termination units for connection to ends of radiating and receiving elements, showing a parallel connection of a coaxial shorted stub line and a resistance.

Figure 37:
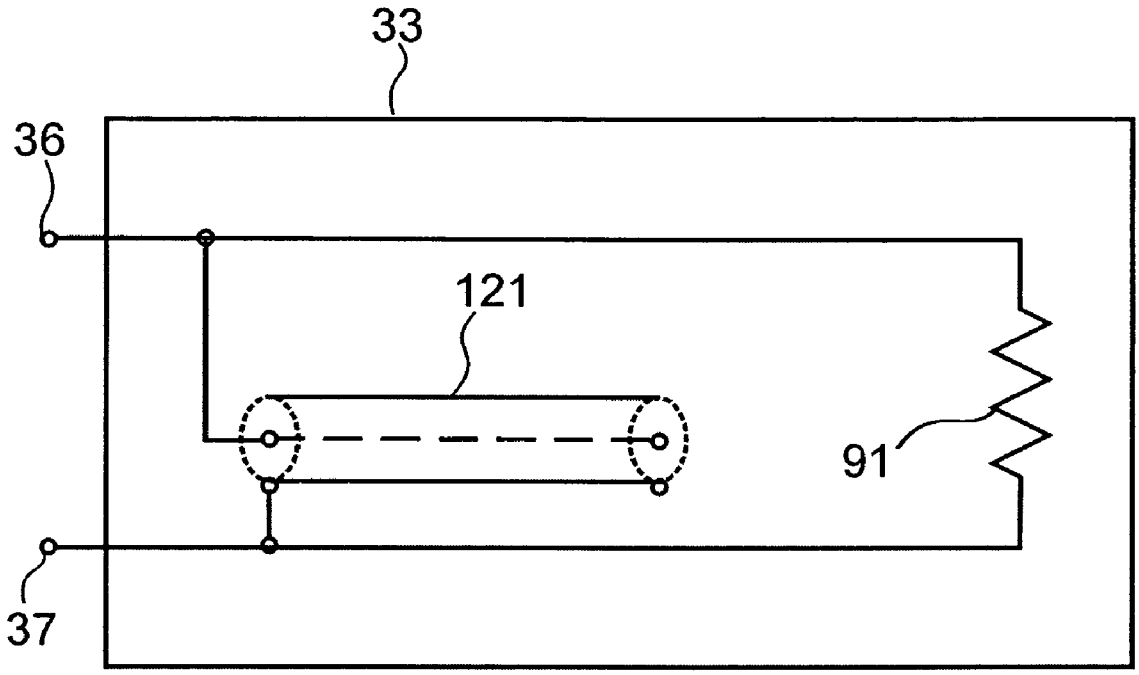

FIG. 37 shows the coaxial antenna system element termination units for connection to ends of radiating and receiving elements, showing a parallel connection of a coaxial open stub line and a resistance.

Figure 38:
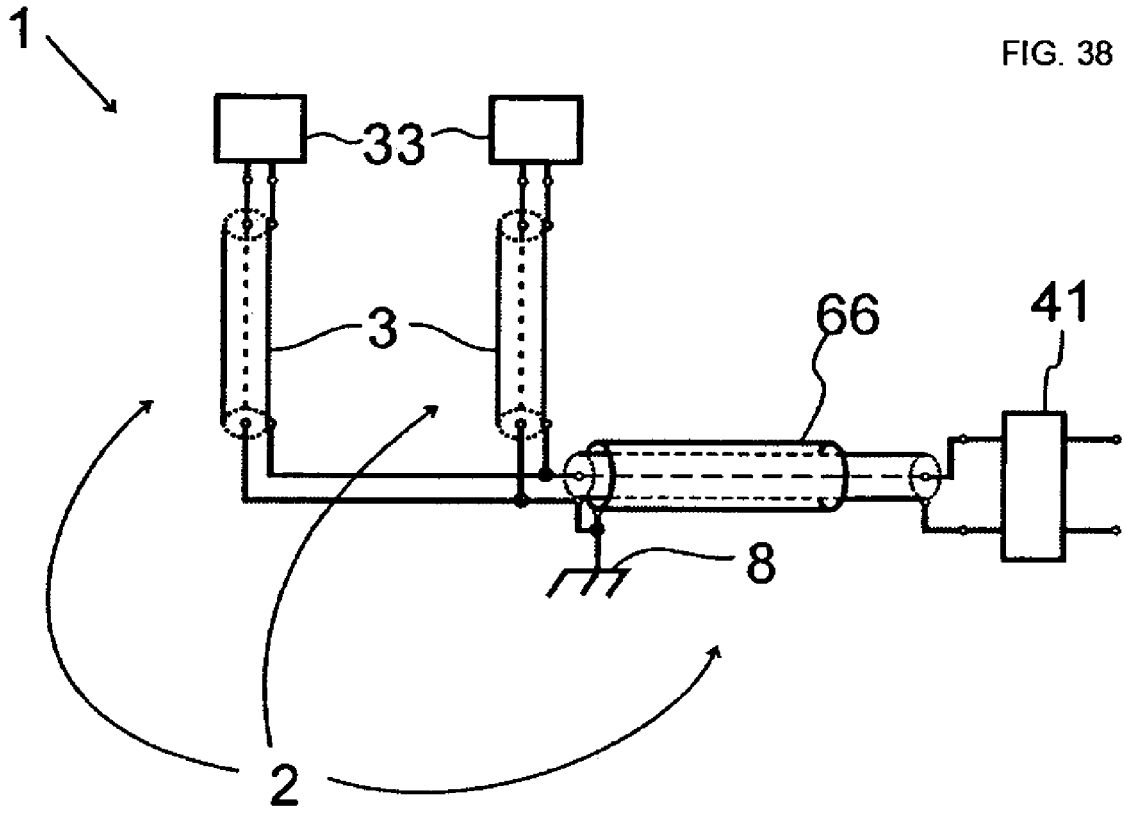

FIG. 38 shows the coaxial antenna system, with multiple coaxial radiating and receiving elements connected to a common feedpoint, end terminations of the radiating and receiving elements, a coaxial line connection and a coaxial sleeve surrounding the coaxial transmission line.

Figure 39:
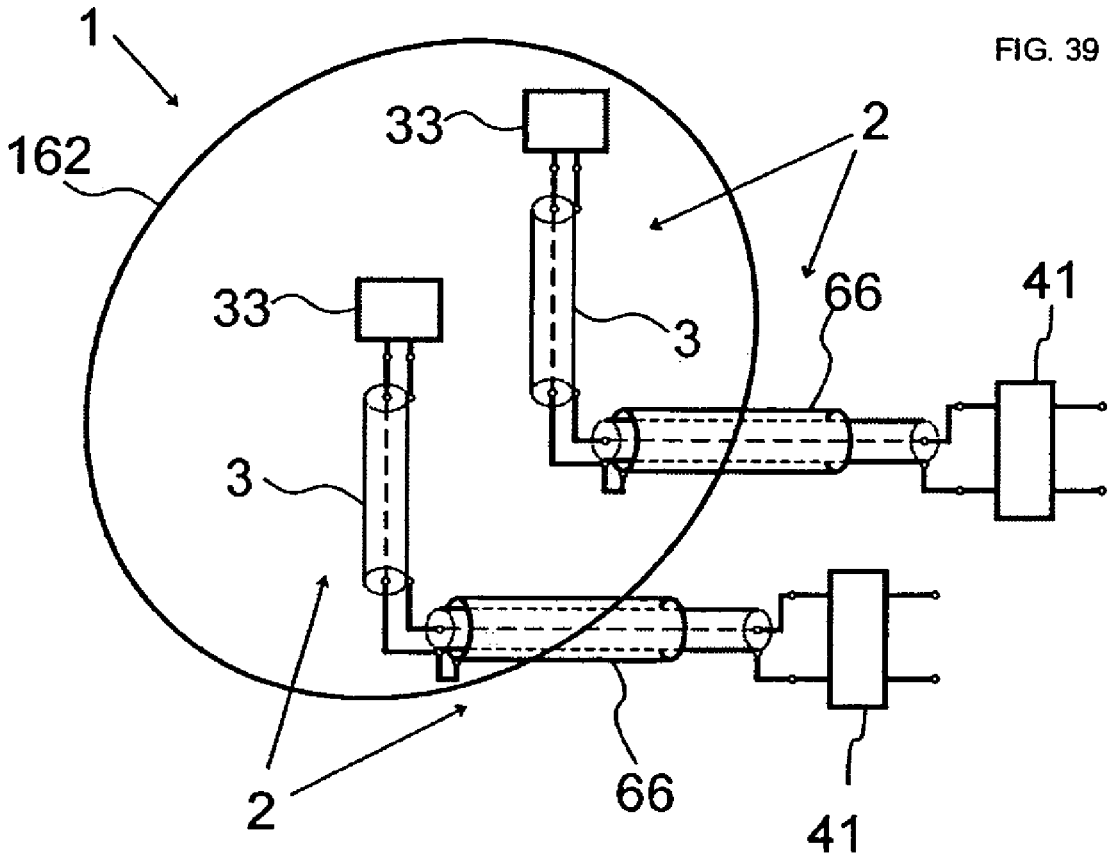

FIG. 39 shows the coaxial antenna system, with multiple coaxial radiating and receiving elements connected to different feedpoints, end terminations of the radiating and receiving elements, coaxial line connections and coaxial sleeves surrounding the coaxial transmission lines, contained within or partially contained within a common housing or structure.

Figure 40:
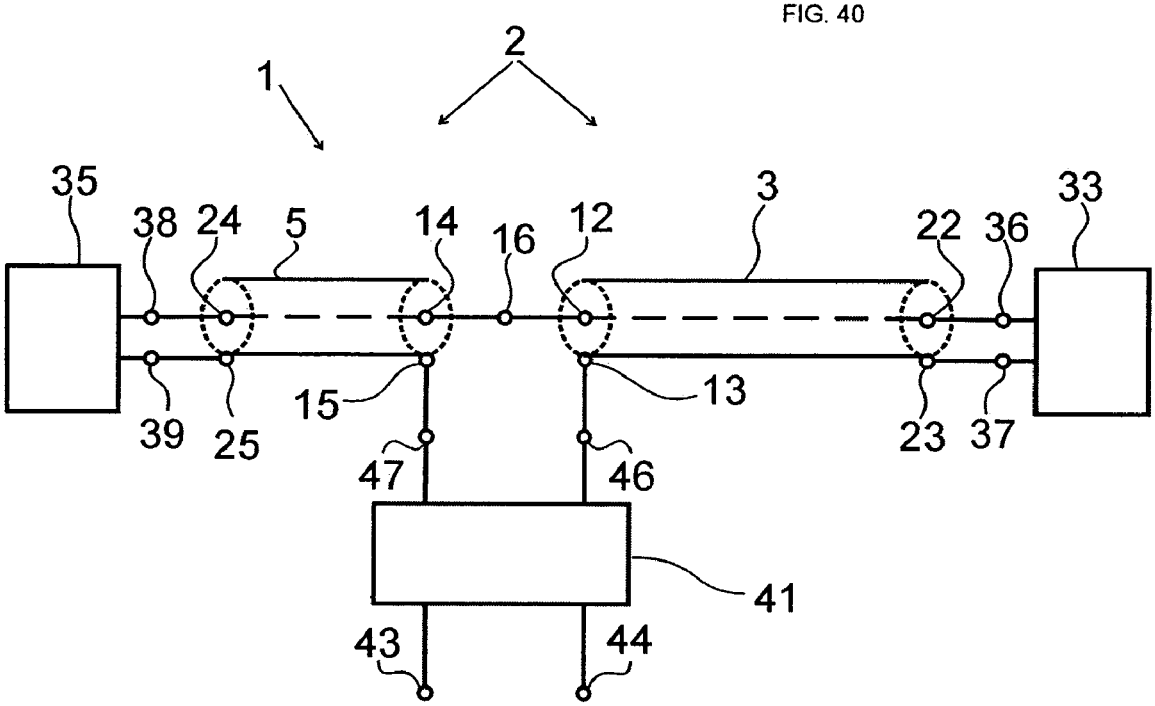

FIG. 40 shows the coaxial antenna system, shown in dipole configuration, with two end terminations, having at least two coaxial radiating and receiving elements of different lengths.

Figure 41:
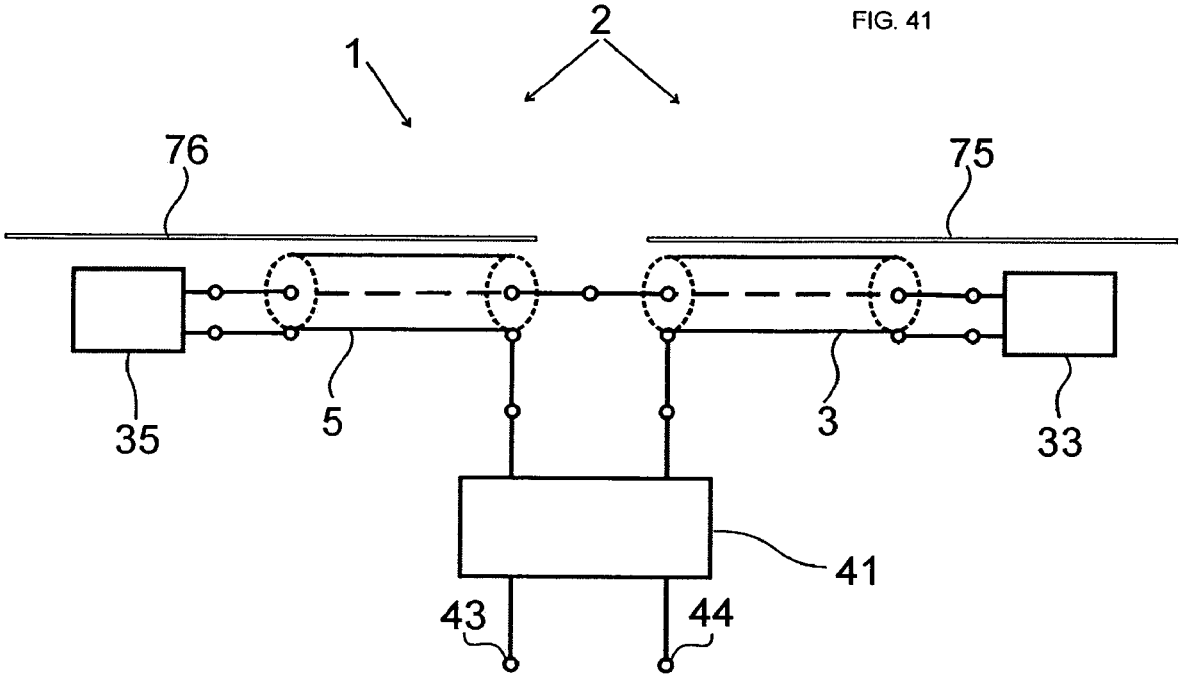

FIG. 41 shows the coaxial antenna system, shown in dipole configuration, with two end terminations, having at least two coaxial radiating and receiving elements coupled electromagnetically to conductive materials such as wire, cable, metallic plating, or surfaces, in proximity to the coaxial radiating and receiving elements.

Figure 42:
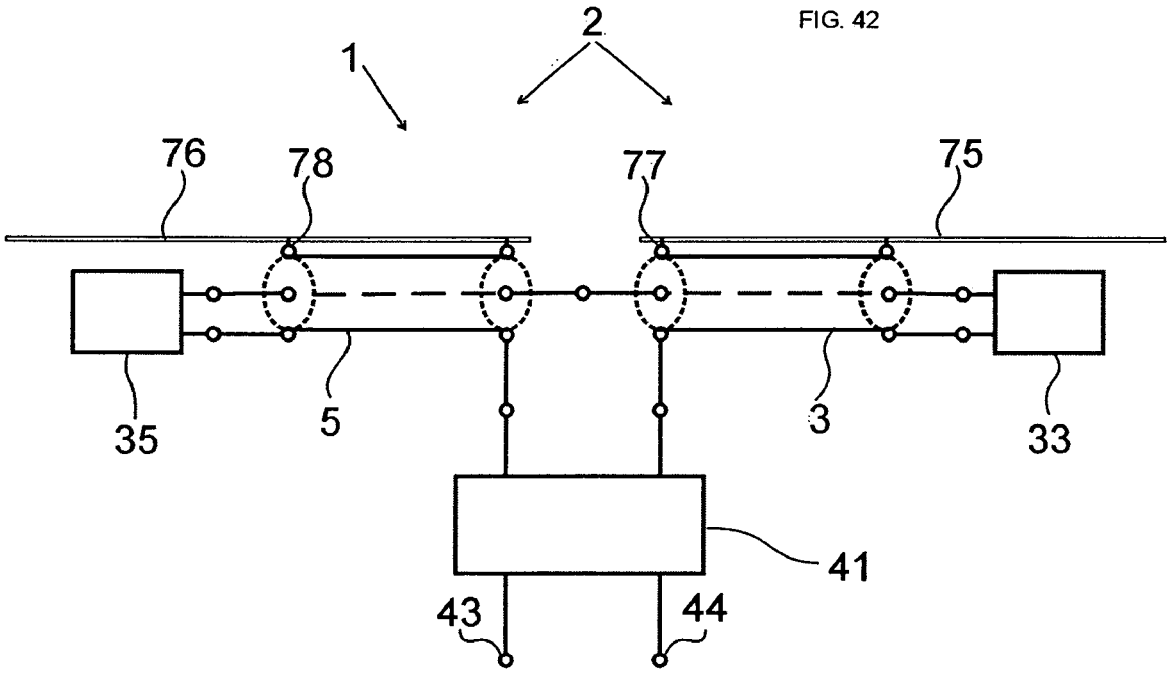

FIG. 42 shows the coaxial antenna system, shown in dipole configuration, with two end terminations, having at least two coaxial radiating and receiving elements coupled electromagnetically to conductive materials such as wire, cable, metallic plating, or surfaces, in proximity to the coaxial radiating and receiving elements, in which part or all of the conductive materials are connected to the coaxial radiating and receiving elements and may support the elements mechanically.

Figure 43:
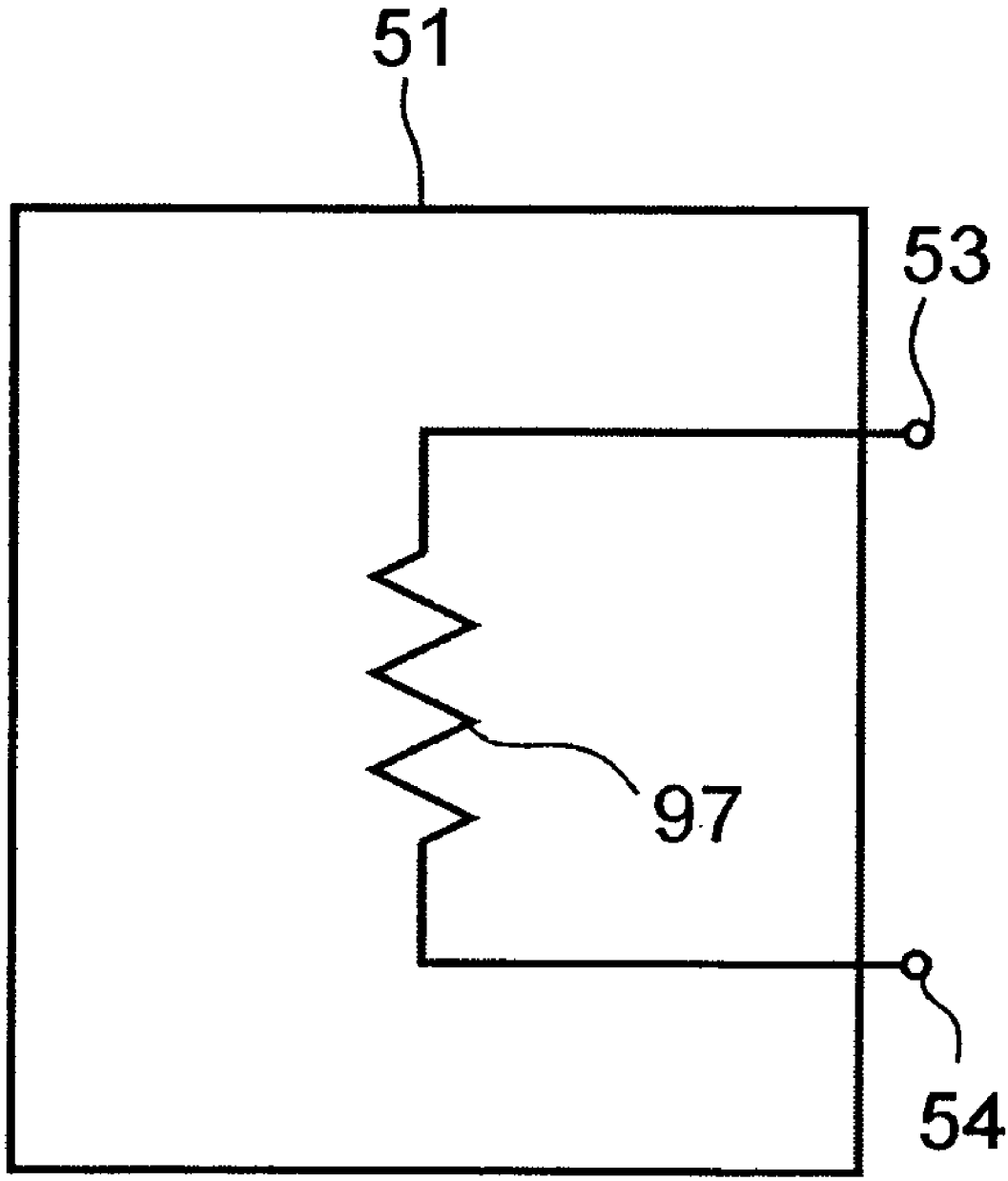

FIG. 43 shows the coaxial antenna system element termination unit for connection to a central point adjacent to the feedpoint of radiating and receiving elements, showing connection of a resistance.

Figure 44:
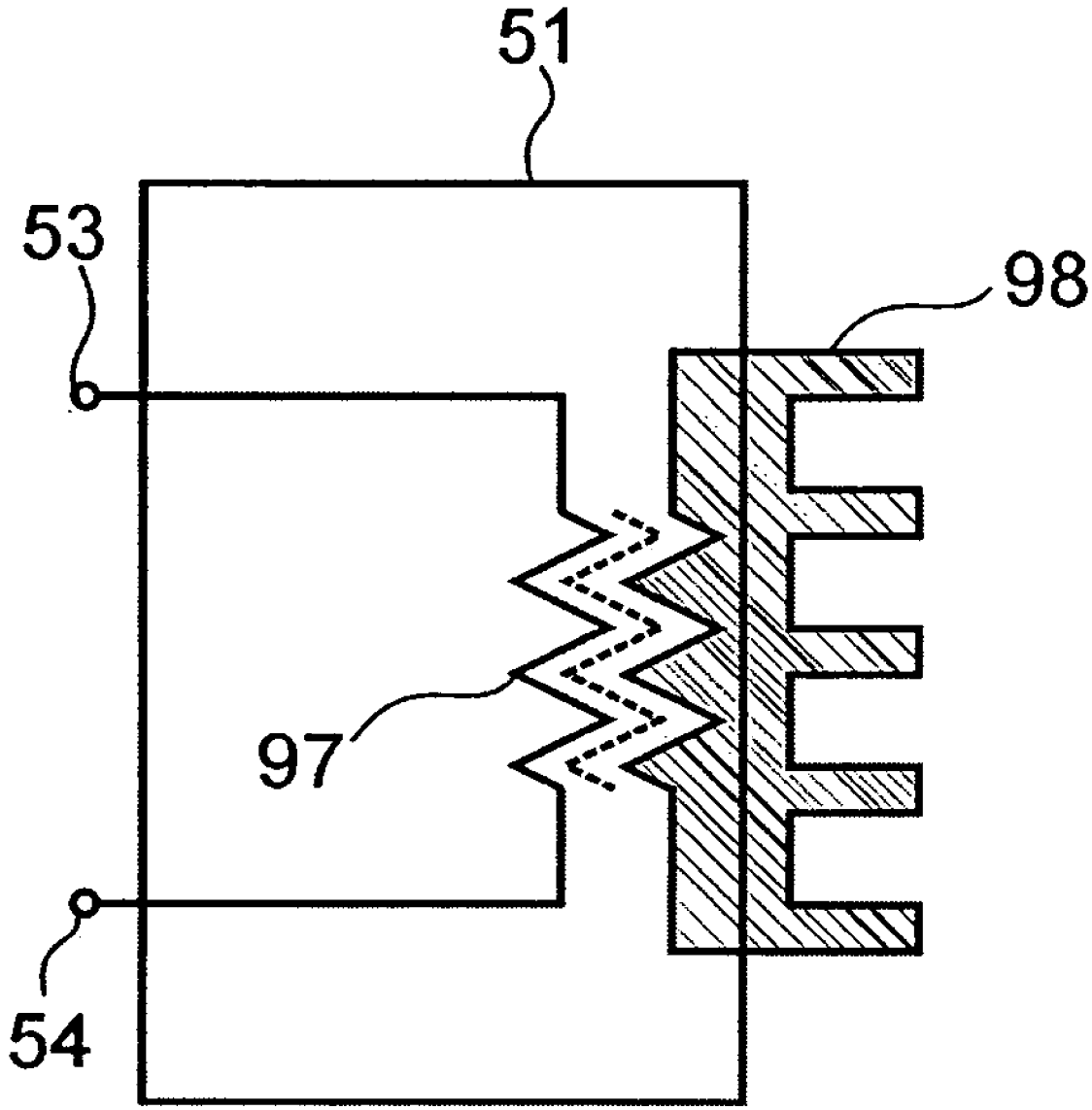

FIG. 44 shows the coaxial antenna system element termination unit for connection to a central point adjacent to the feedpoint of radiating and receiving elements, showing connection of a resistance with a heat sink.

Figure 45:
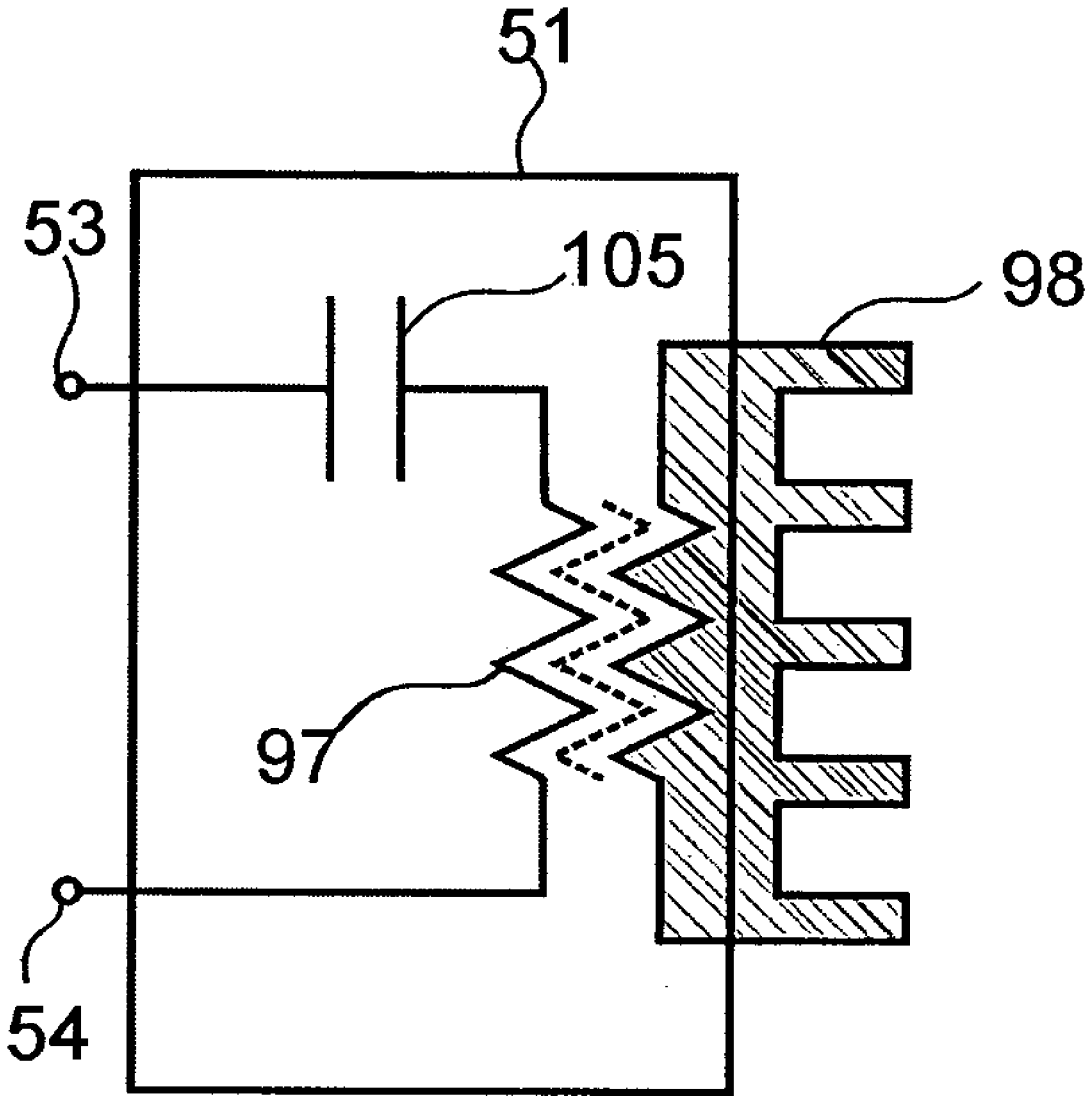

FIG. 45 shows the coaxial antenna system element termination unit for connection to a central point adjacent to the feedpoint of radiating and receiving elements, showing connection of a series capacitive reactance and a resistance with a heat sink.

Figure 46:
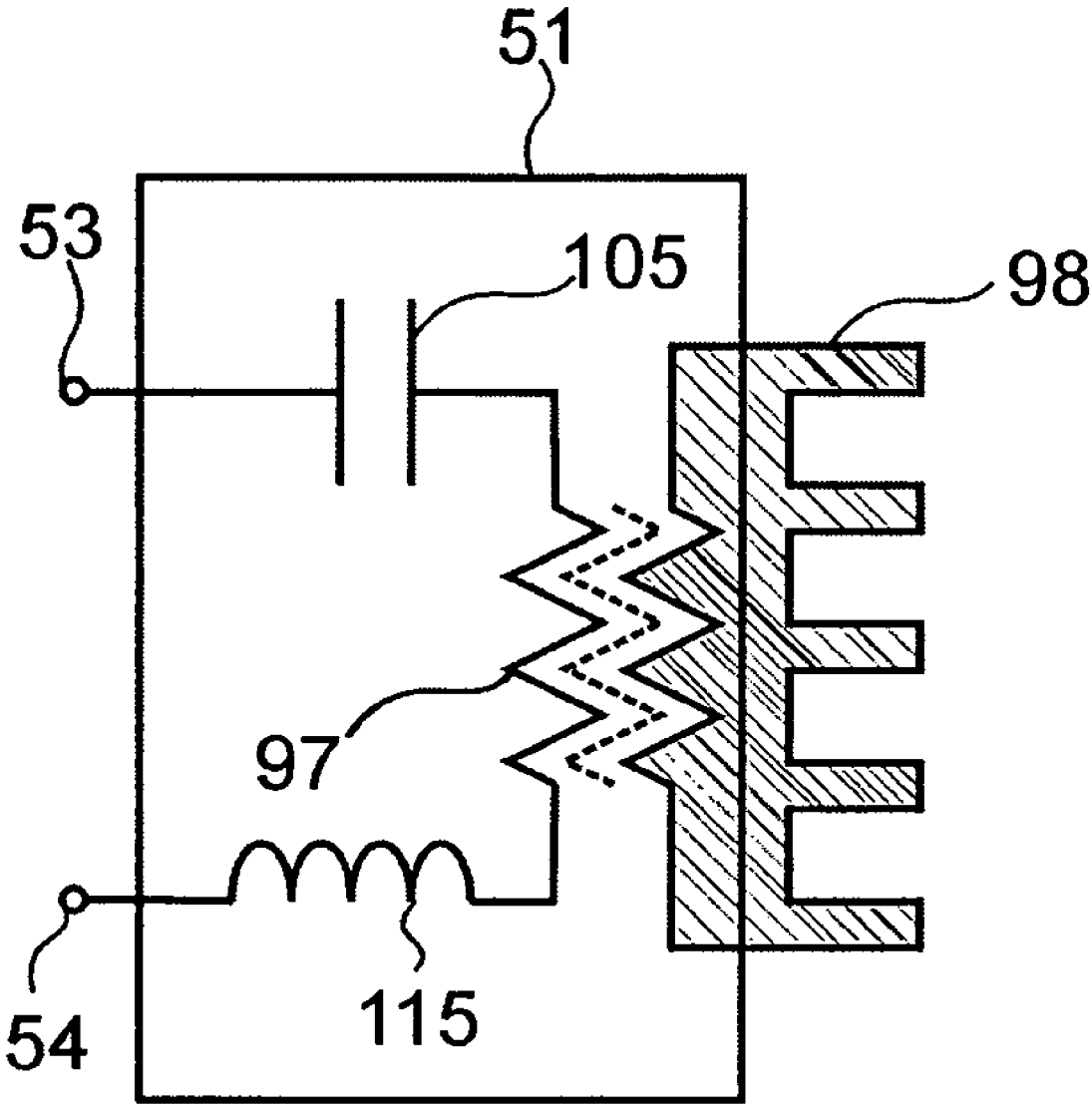

FIG. 46 shows the coaxial antenna system element termination unit for connection to a central point adjacent to the feedpoint of radiating and receiving elements, showing connection of a series capacitive reactance, an inductive reactance, and a resistance with a heat sink.

Figure 47:
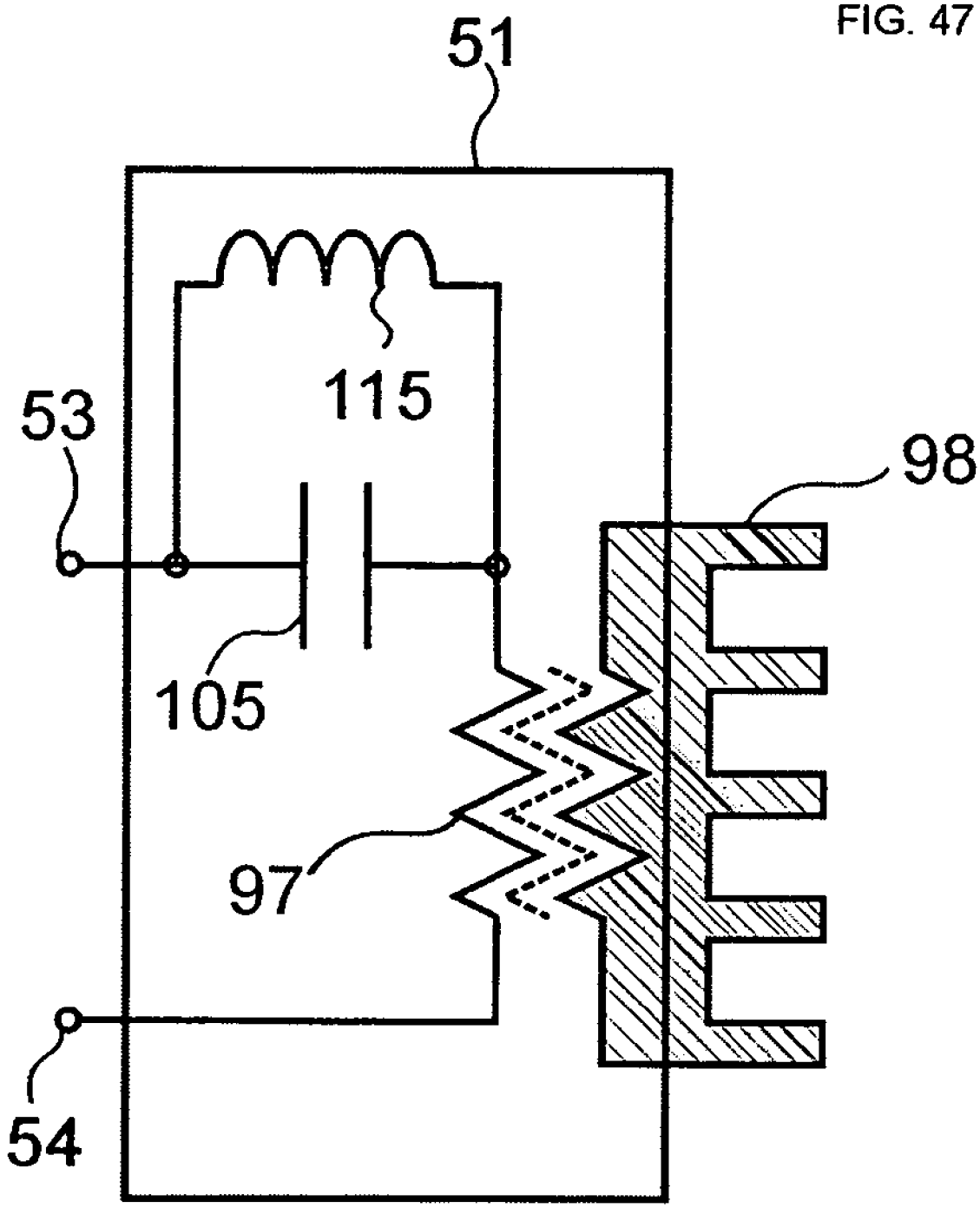

FIG. 47 shows the coaxial antenna system element termination unit for connection to a central point adjacent to the feedpoint of radiating and receiving elements, showing connection of a parallel capacitive reactance and an inductive reactance, and a series connection of a resistance with a heat sink.

Figure 48:
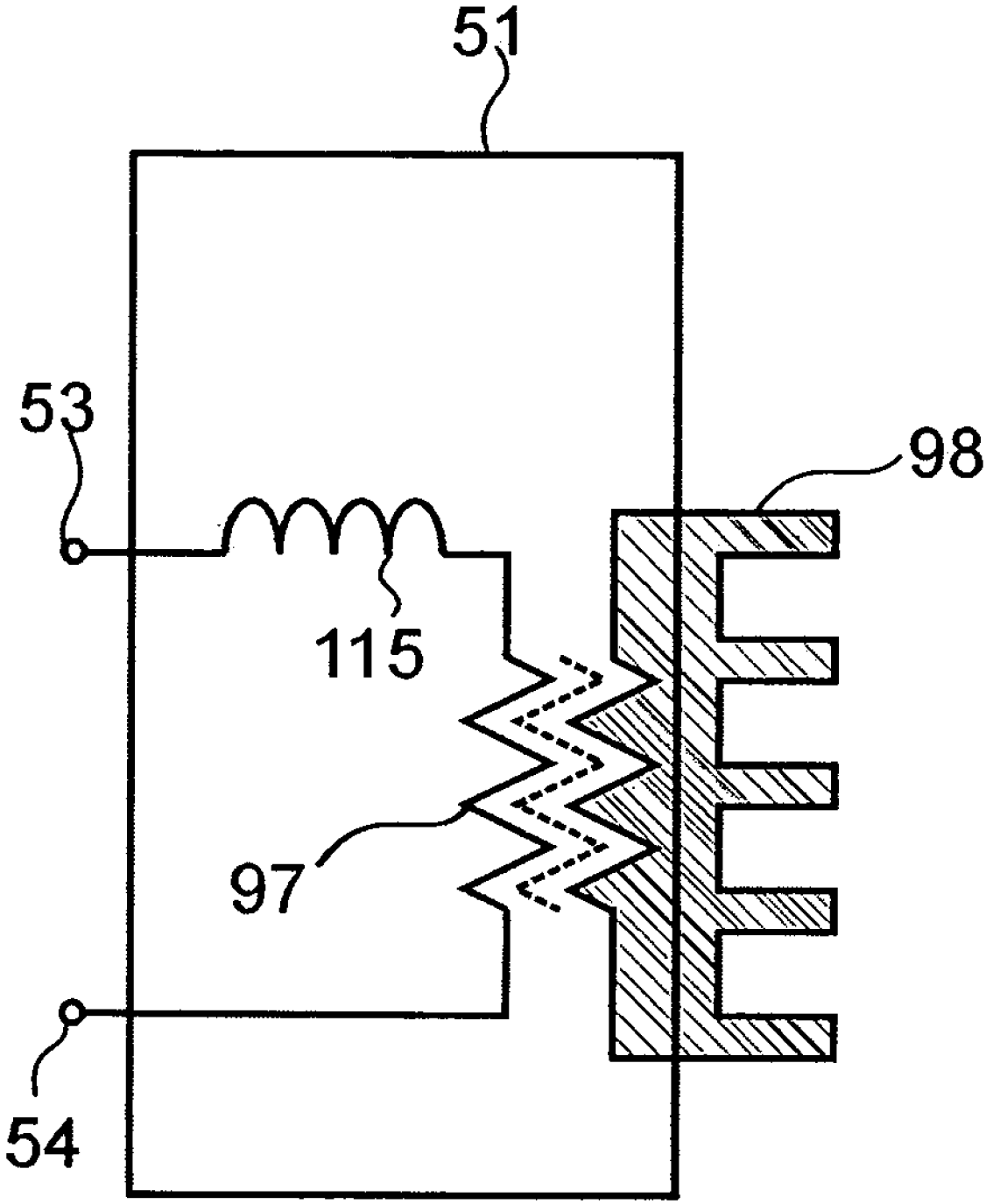

FIG. 48 shows the coaxial antenna system element termination unit for connection to a central point adjacent to the feedpoint of radiating and receiving elements, showing connection of a series inductive reactance and a resistance with a heat sink.

Figure 49:
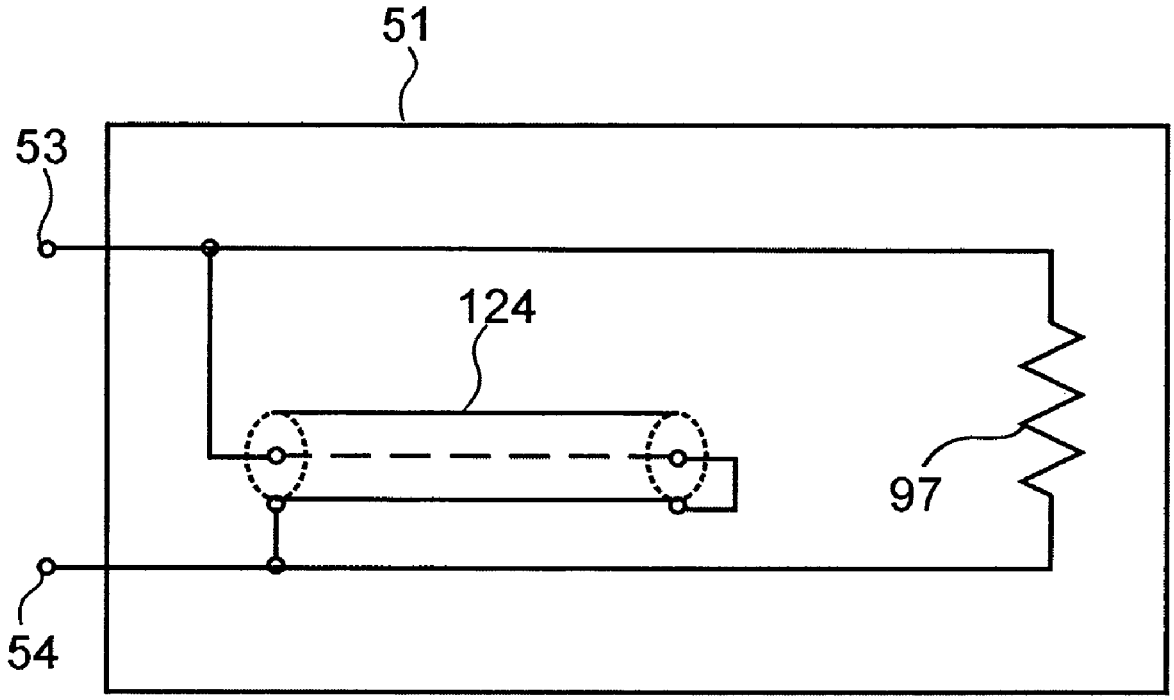

FIG. 49 shows the coaxial antenna system element termination unit for connection to a central point adjacent to the feedpoint of radiating and receiving elements, showing connection of a parallel coaxial shorted stub line and a resistance.

Figure 50:
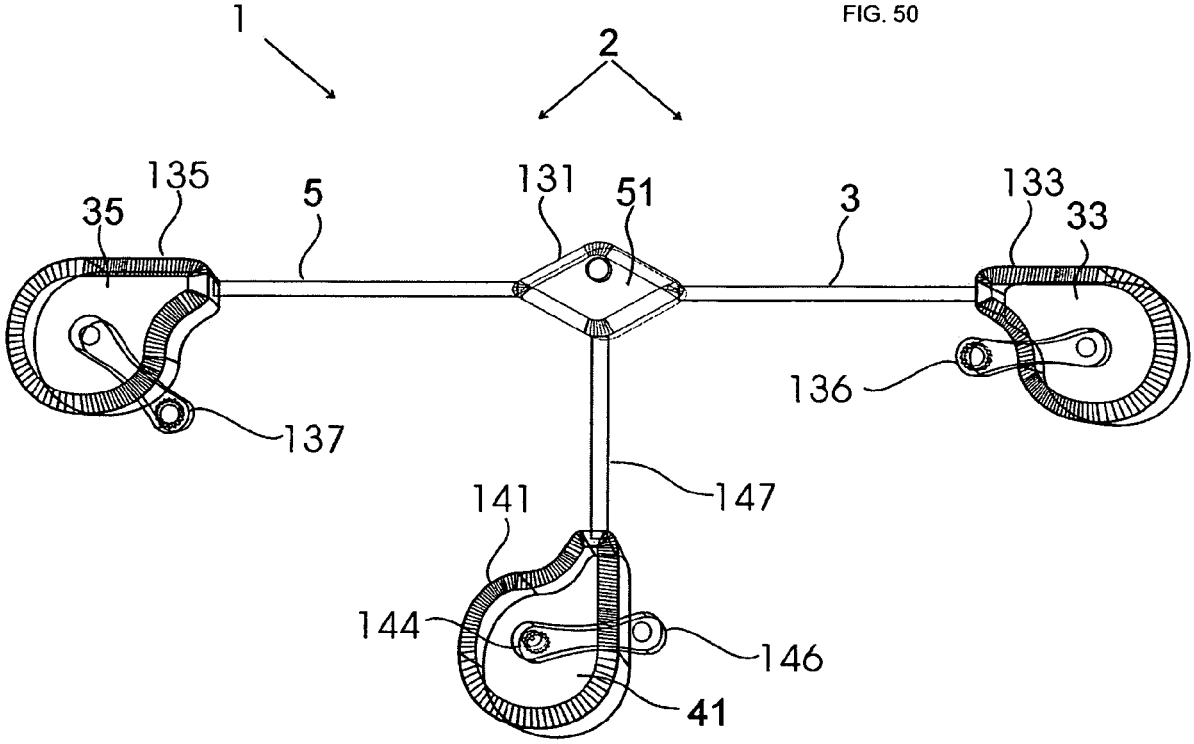

FIG. 50 shows the coaxial antenna system, shown in dipole configuration, partially stowed, central connection unit for coaxial antenna system elements and radio frequency transmission line and/or housing for central terminal unit, housing and/or reel for transmission line from a feedpoint unit to a central part and/or housing for feedpoint unit; end housings of combined terminating units and reels with cranks for winding, deploying, and stowing of elements of coaxial antenna system.

Figure 51:
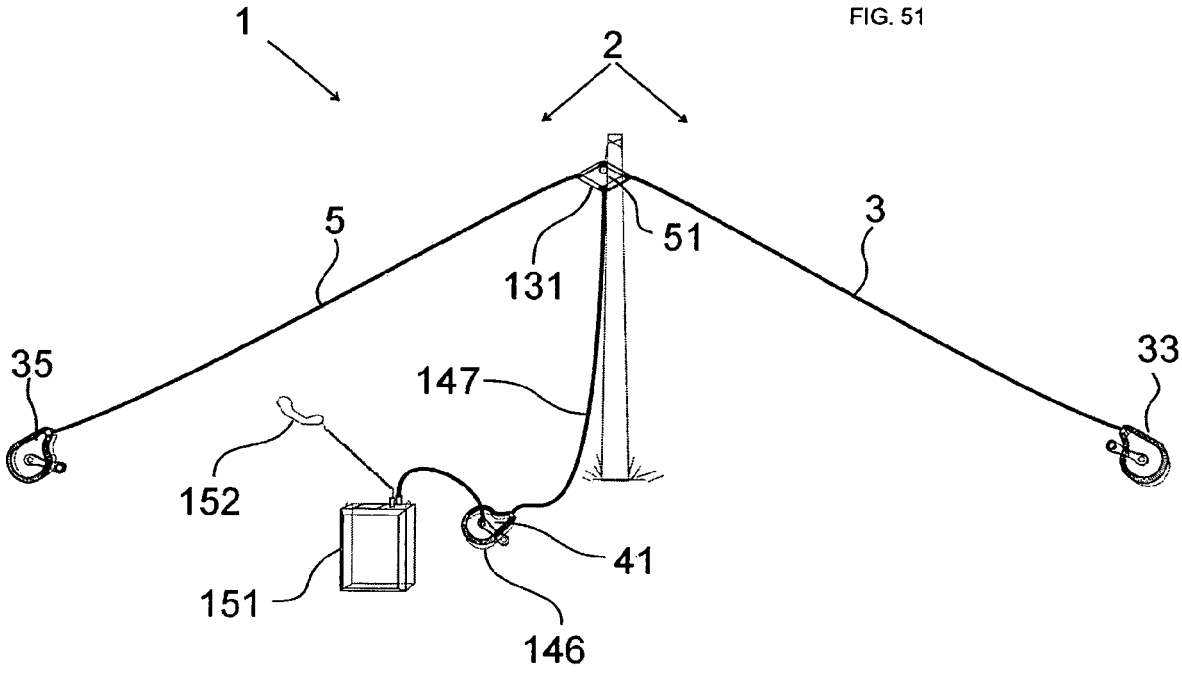

FIG. 51 shows the coaxial antenna system, shown in dipole configuration, central connection unit for coaxial antenna system elements and radio frequency transmission line and/or housing for central terminal unit, housing and/or reel for transmission line from a feedpoint unit to a central part and/or housing for feedpoint unit; end housings of terminating units and reels with cranks for winding, deploying, and stowing of elements of coaxial antenna system; shown deployed upon a support pole and connected to a transceiver with user interface.

Figure 52:
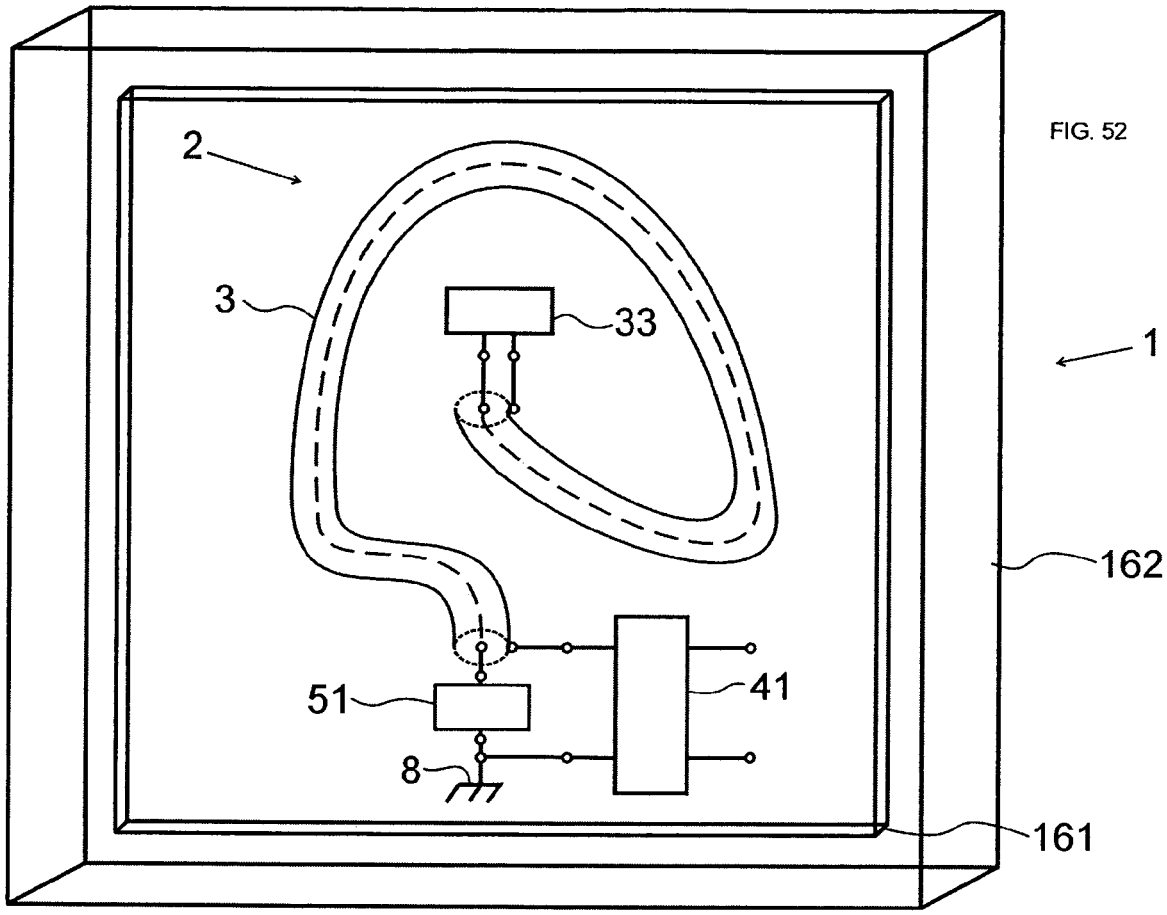

FIG. 52 shows the coaxial antenna system shown contained within a housing and mounted completely or partially upon a surface within the housing, such as a circuit board.

Figure 53:
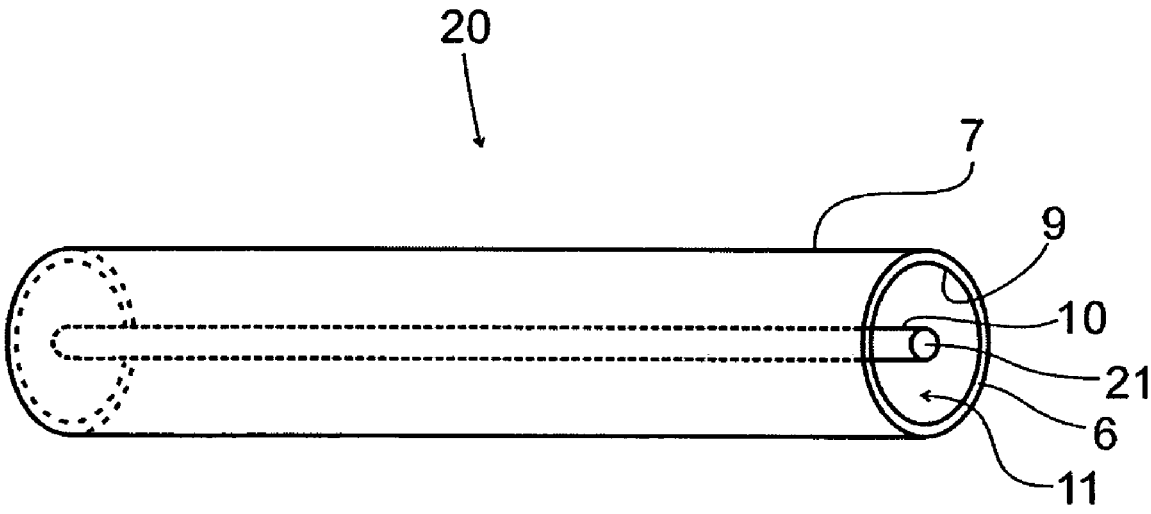

FIG. 53 shows the perspective view of a coaxial line, conductors of the coaxial line and the surfaces of the conductors of the coaxial line upon which are skin effect currents and electronic field potentials

DESCRIPTION OF THE INVENTION AND PREFERRED EMBODIMENT OF THE INVENTION

It is an object of the invention to provide an antenna system which exhibits a selectable and controllable impedance match and bandwidth control over the desired bands of frequencies. It is another object of the invention to provide a wide range of possible impedances desirable for electronic radio frequency devices, selectably controlled utilizing a system which contributes less loss due to heat than previously available means. It is another object of the invention to provide the broadest bandwidth impedance match over the broadest spectrum with the most efficient electromagnetic radiation efficiency. It is another object of the invention to provide a coaxial antenna element structure which is versatile and may be utilized for a variety of applications. It is another object of the invention to provide an antenna system which has inherent integral bandpass and band-rejection qualities. It is another object of the invention to provide an antenna system which has a coaxial radiating and receiving element structure and configuration. It is another object of the invention to provide an antenna system which is structurally and physically adaptable to a variety of shapes. It is another object of the invention to provide a broadband antenna system which may be reeled or rolled to a small package when stowed, and deployed easily and quickly. It is another object of the invention to provide an antenna system which is broadly applicable to the ELF, LF, HF, VHF, UHF, and microwave spectrum. It is another object of the invention to provide an antenna system which provides high efficiency electromagnetic radio frequency radiation while conforming to the required shapes internal to or immediately adjacent to containers, housings, or enclosures. It is another object of the invention to provide an antenna system having impedance matching stability while operating in a changing near field environment and coupling to nearby conductive materials for beneficial use as part of the radio frequency electromagnetic radiation element system.

In this description, the word radiation and the word reception and their derivative words, by the antenna system may be used interchangeably and serve to illustrate the bi-directional nature of the antenna system, i.e., the antenna may be used for both reception or transmission of radio waves. The invention antenna system is a reciprocal system, in which the principle that alternating currents may be injected into the antenna system feedpoint by a transmitter of radio frequency, or the alternating currents may be developed at the system feedpoint by electromagnetic waves which impinge upon the active radiating and receiving elements of the antenna system. Therefore, as the word "radiate", and its derivatives, is used in the explanation of the workings of the invention antenna system, the principle of radiation may also be applied as equivalent reciprocally to the reception of external electromagnetic radio frequency space fields. Therefore, the antenna system has the quality of being useful and beneficial, either simultaneously or alternatingly to receive electromagnetic fields or to transmit electromagnetic fields.

Coaxial lines are used as transmission lines for conveying electronic signals from one end of a coaxial line to the other end of a coaxial line while shielding the signal from outside electromagnetic signals. A coaxial line structure, when in conventional use as a coaxial transmission line, primarily utilizes currents flowing entirely within the inside of the coaxial structure, as the electronic circuit is completed by the flow of electrons between the end connections of the outside surface of the coaxial center conductor and the inside surface of the outer conductor shield due to skin effect. As illustrated in FIG. 53, a dielectric or insulator or vacuum or other material separates the two conductive surfaces, and an electromagnetic field is developed in that area longitudinally along that inner area of the coaxial line. The field enables signals to be propagated within the line from one end to the other efficiently when terminated on the ends at the characteristic impedance of the line.

The invention coaxial antenna system is shown illustrated in the figures and described herein, and as shown, has coaxial radiating and receiving elements that have an outside conductor surrounding an inner conductor and separated by a dielectric or insulator or vacuum or another material with specifically lossy radio frequency properties. The invention coaxial antenna radiating elements use a coaxial line structure, but in a different and specific way which is effective for radiation efficiency, and promotes the efficient reception of external electromagnetic signals of electronic fields impinging upon the antenna elements. The coaxial line structure antenna elements operate in an inverse manner in the invention, from conventional use of coaxial lines which shield radio waves, by beneficially radiating and receiving radio waves.

The invention coaxial antenna system is shown illustrated in the drawing figures and described herein and provides integrally selectable and controllable impedance match and bandwidth control over the desired bands, achieved through the use of a combination of terminations with the coaxial and non-coaxial elements as shown in the drawing figures. The outside surfaces of the coaxial radiating and receiving elements shown provide efficient radio frequency electromagnetic radiation surfaces, which as shown in some of the preferred embodiments, also selectively provide electromagnetic coupling and electronic contact with external conductive materials. These external conductive materials become a part of the radiating element of the antenna system. Materials such as circuit board conductive patterns, conductive surfaces of enclosures and housings, metallic surfaces of nearby objects, and other types of antennas are utilized as part of the antenna system, and the coaxial structure in combination with the termination impedances enable those external conductive objects to properly match and efficiently couple radio frequency currents to and from the antenna system feedpoint. Additionally the invention coaxial antenna system utilizes currents flowing on the inside of the coaxial line to equalize and current and voltage vectors and produce the proper phase and magnitude for correct matching and efficient transfer of energy.

When it is fed by alternating current applied at the feedpoint connections, electronic current travels upon the outer surface of the outside coaxial radiating element structure conductor 3 without effect to the currents flowing on the inside of the coaxial radiating element conductor center conductor or the inside conductor of the coaxial structure. The invention coaxial antenna system beneficially utilizes the electronic skin effect on both the coaxial outer conductor's inside surface currents and the coaxial outer conductor's outside surface currents. The invention coaxial antenna system is shown illustrated and described herein and as shown in the figures also has terminating impedance units attached and connected conductively to the end connections of the coaxial antenna system's radiating element structures which operate beneficially to match impedances and to develop and manipulate current vectors between the coaxial outer conductor's inside surface currents and the inside of the coaxial radiating and receiving elements' conductors, thereby utilizing the available electromagnetic energy efficiently. The terminating impedance units, shown in the drawing figures, provide cross-connections between the inside current and the outside current of the coaxial radiating antenna elements. By adjusting the terminating impedance units' resistance, inductive reactance, and capacitive reactance, the proper transfer of radio frequency currents between the coaxial inside and the coaxial outside is enabled.

In a preferred embodiment of the invention, a dipole configuration as is shown in FIG. 40 with resistive end termination units is utilized, one on each end, providing a broadband match with high efficiency over more than 10 octaves of radio frequency spectrum with high return loss to the feedpoint. In this embodiment, coaxial line or cable with a characteristic impedance of 50 ohms is utilized as the coaxial radiating and receiving elements, end terminations with resistive impedances approximately equal to 33 ohms are used for connecting the inside to the outside conductors of the coaxial radiating element at the opposite ends of the antenna structure, and the nominal impedance of the antenna at the feedpoint is approximately equal to 95 ohms. The antenna radiating and receiving elements in this embodiment are of unequal lengths, with the shorter element being approximately equal to between two-thirds and three-quarters the length of the longer element. In this embodiment, the feedpoint unit 41 utilizes a balanced to unbalanced balun matching transformer 86 as shown detailed in FIG. 25 to provide a balanced connection to the antenna radiating elements at connection points 15 and 13, and an unbalanced connection to a radio frequency transmitting or receiving device at connections 43 and 44 with a nominal impedance of 50 ohms.

In another embodiment of the invention, a dipole configuration as is shown in FIG. 40 with resistive end termination units is utilized, one on each end, providing a broadband match with high efficiency over more than 10 octaves of radio frequency spectrum with high return loss to the feedpoint. In this embodiment, coaxial line or cable with a characteristic impedance of between 8 and 300 ohms is utilized as the coaxial radiating and receiving elements, end terminations with resistive impedances between zero and an infinite ohms are used for connecting the inside to the outside conductors of the coaxial radiating element at the opposite ends of the antenna structure, and the nominal impedance of the antenna at the feedpoint is approximately between 4 and 1000 ohms.

The antenna radiating and receiving elements in this embodiment are of unequal lengths, with the shorter element being approximately equal to between approximately 7.5 percent and approximately 99 percent of the length of the longer element. A connection to a radio frequency transmitting or receiving device at connections 43 and 44 are made with a nominal impedance of between 4 and 1000 ohms, and the feedpoint unit has the properties described in FIG. 20, FIG. 21, FIG. 23, FIG. 24 or FIG. 25 and detailed in descriptions below. Alternatively, applicable in the same or other embodiments, the feedpoint unit 41 is not used, and instead, the feedpoint connections 13, 15, 17, 8, or 65 are utilized for connection of a radio frequency electronic device or its feedline. Alternatively, or in addition to resistive impedances in impedance termination units, inductive and capacitive reactances with phase shifts of from zero to 180 degrees are utilized. Alternatively, or in addition to resistive and reactive impedances in the impedance termination units, coaxial lines or balanced transmission lines, or microstrips, or strip lines are utilized for required impedance vectors. These reactances and transmission lines are used to provide several different desired properties for the antenna system including impedance matching, narrowbanding, broadbanding, bandpassing, band rejecting, band stopping, or multiple frequency bandpass band reject, band stop, narrowband, or broadband qualities.

In the various embodiments of the invention described herein, a terminating impedance unit 33, 35, or 51 are of a pure resistance or a complex impedance as is illustrated in the drawing FIGS. 26, 27, 28, 29, 30, 31, 32, 33, 34, 35, 36, 37, 43, 44, 45, 46, 47, 48, and 49 and described in detail below. The terminating impedance units operatively provide impedance current and voltage vectors which match the current and voltage flowing on the outside of the radiating elements so as to maximize feedpoint return loss and minimize the standing wave ratio at the feedpoint connections 47 and 46. At frequencies where undesired impedances due to differences in finite electrical radiating element length and operating frequency wavelength are encountered, the terminating impedance units operate to maintain traveling waves on the outer surface of the radiating elements. By connection and placement at the ends of the coaxial elements, the termination units only have effect on the remaining radio frequency energy which has not been already radiated by the radiating element as the radio wave travels from the feedpoint toward the end of the radiating element. The part of the said radio wave which has not already been radiated, upon reaching the end of the radiating element, is shunted into the terminating unit which vectors the voltage and current to inner surface of the outside conductor of the coaxial line and the outside surface of the inner conductor of the coaxial line, setting up a transmission line field within the coaxial line. As the said current and voltage on the inside of the coaxial is forced into the transmission line mode, it is conveyed by transmission line properties to the opposite end of the coaxial line, where it is either connected to the other half of the dipole in the dipole configuration, or the radio frequency ground in the monopole configuration, or the connection terminal of the sleeve in the sleeve configuration, thereby providing a beneficially circulating and radiating path or if desired, a dissipating path for remaining unwanted currents and voltage. In the case of the central or remote impedance terminating unit 51, it operates similarly to the terminating units 33 and 35, however, it is operatively connected so that it is on the near end of the coaxial elements. The effect and operation is similar to end impedance termination units, as it forces current and voltage vectors from the inside to the outside of the coaxial line structure, or from one coaxial line structure to another.

In the various embodiments of the invention described herein, the antenna system radiating elements are of coaxial lines, combinations of coaxial lines and non-coaxial conductors, or combinations of coaxial lines and coaxial surfaces, or combinations of coaxial lines and coaxial sleeves, or coaxial lines and radio frequency ground, as illustrated in the drawing FIGS. 1, 2, 3, 4, 5, 6, 7, 8, 9, 10, 11, 12, 13, 14, 15, 16, 17, 18, 19, 38, 39, 40, 41, 42, 50, 51, and 52, and described in detail below.

In a preferred embodiment of the invention, as shown in the drawing figures, and described herein and below, the bandwidth of the antenna is confined to specifically desired bands of frequencies by selection of specific parallel or series reactances or transmission lines within the terminating impedance units, and or by selection of specific lengths of radiating elements, and or selection of specific coupled conductive structures adjacent and or directly connected to the radiating elements.

In preferred embodiments of the invention, referring to FIG. 29, a bandpass resistive impedance termination is shown. In FIG. 30, a band reject resistive impedance termination is shown. In FIG. 31, a bandpass and band reject resistive impedance termination is shown with a plurality of resistances. In FIG. 32, a lowpass and highpass resistive impedance termination with a plurality of resistances is shown. In FIG. 33, a lowpass resistive impedance termination is shown. In FIGS. 34, 35, 36, and 37, a harmonically selective or alternatively lowpass or highpass resistive impedance termination is shown utilizing a transmission line as the reactive element. In FIG. 26, FIG. 27 and FIG. 43 a resistive impedance termination is shown. In an alternative embodiment, the value of resistances 91, 92, or 97 are a value between zero ohms inclusive and 2000 ohms inclusive. In another alternative embodiment, the value of the value of resistances 91, 92, or 97 are infinite or equal to the stray values or electrically equivalent representative at radio frequencies to the Q of the reactance elements in the termination impedance unit which are operatively connected and beneficially utilized.

Figure 1:
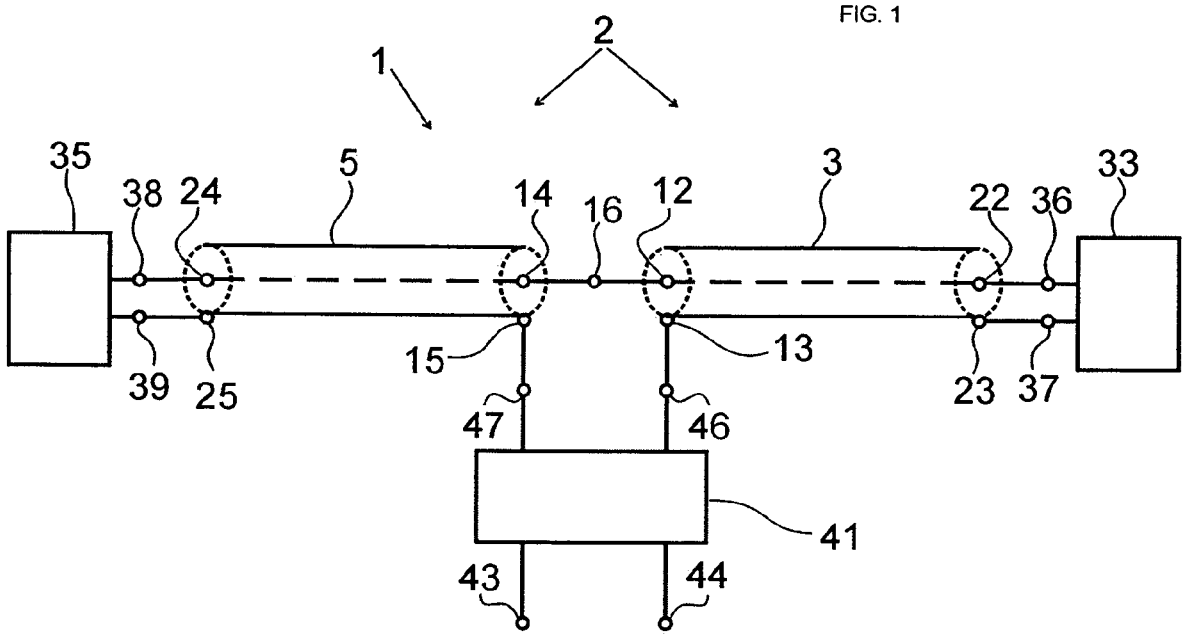

In a preferred embodiment, referring to FIG. 53, and applicable to all the Figures which contain coaxial lines, such as FIG. 1 and others, the coaxial line 20 is utilized in the coaxial antenna system 1 and alternatively has a dielectric 11 which is lossy and or dissapative for radio frequency. It is formed of a material that has electrical resistance such as carbon or other lossy conductive materials, including but not limited to composites, nickel chromium compounds, teflon, plastic, nylon, ceramic or glass fiber empregnated with carbon, or other types of resistive materials. Such a lossy dielectric material at radio frequencies is also found in common small diameter coaxial cables, and this quality is beneficially used as part of the antenna sytem. The purpose of such a lossy dielectric 11 is to provide an alternative implementation of the termination impedance unit as part of the coaxial element itself, including the distributed quality of the resistance and the heat dissapation and heat sinking of the entire coaxial line. Alternatively, applied to said embodiment with lossy dielectric 11, the radiating element may be shorted or open on either end as required for the impedance when utilizing this part of the invention.

In a preferred embodiment of the invention, referring to FIG. 53, the outer surface 7 of the coaxial line 20 used as a radiating element 3 or 5 of the antenna system, is coated or covered with a lossy material for radio frequency which contributes resistance or resistivity to the surface, thereby providing an alternative distributed implementation of the termination impedance or partially replacing the end termination.

In a preferred embodiment of the invention, as shown in the drawing figures, and described with the various parts of the invention detailed below, referring to FIG. 1, a view of the dipole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 14 of the inside conductor 21 of the coaxial radiating element 5. A coaxial radiating and receiving element 5 consisting of a coaxial line 20 as detailed in FIG. 53 with inside conductor 21 and outside conductor 6, is operatively connected by connections 38 connected to 24 and 25 connected to 39 to a terminating impedance unit 35. At the opposite end of the element 3, a connection 14 is shown to the inside conductor 21, connecting it to the connection 12 of the inside conductor 21 of the coaxial radiating element 3 via intermediate junction 16 connection. The active radiating field area 2 of the antenna system is shown. A feedpoint unit 41 is shown connected to the coaxial radiating elements 3 and 5 at connections 13 and 15 respectively, for connection to the radio frequency device at the connections 43 and 44. A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

Figure 2:
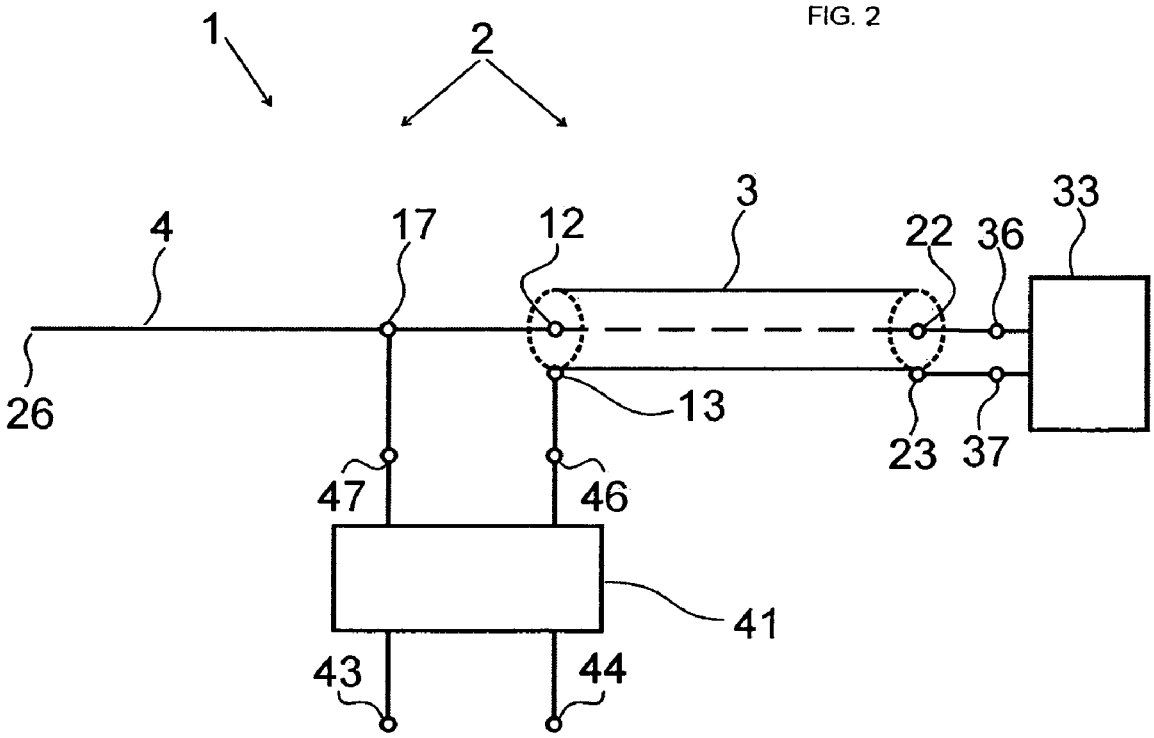

In a preferred embodiment of the invention, as shown in the drawing figures, and described with the various parts of the invention detailed below, referring to FIG. 2, a view of the dipole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 17 of the inside conductor 21 of the coaxial radiating element 3. Radiating and receiving element 4 consisting of a conductor having a free end 26. The active radiating field area 2 of the antenna system is shown. A feedpoint unit 41 is shown connected to the coaxial radiating elements 3 and 4 at connections 13 and 17 respectively, for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 3:
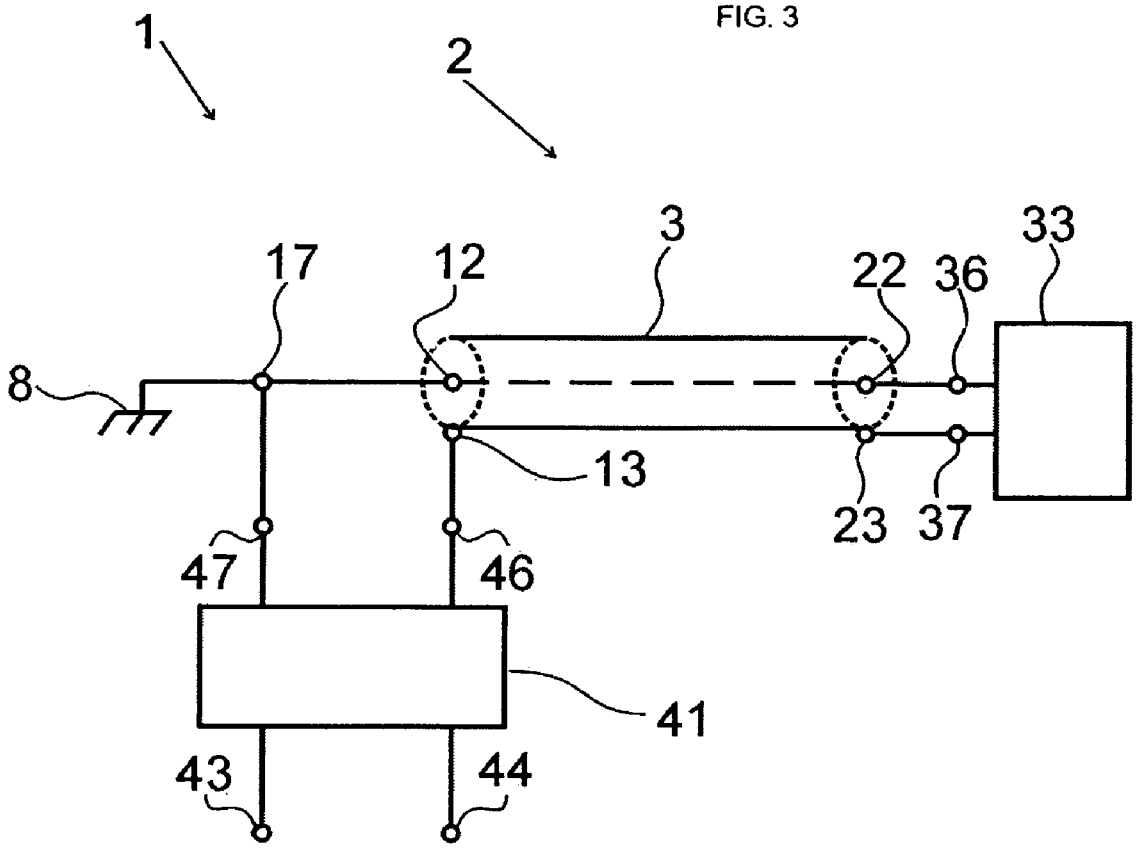

In a preferred embodiment of the invention, as shown in the drawing figures, and described with the various parts of the invention detailed below, referring to FIG. 3, a view of a monopole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 17 forming a junction of the inside conductor 21 of the coaxial radiating element 3 and radio frequency earth ground reference. The monopole configuration is shown horizontally arranged, and may be arranged vertically, spirally, or in a circular or loop-like configuration. The polarization may thus be adjusted and made as required, being determined by the physical shape and direction of the monopole element and location of the feedpoint with respect to the ground reference and the monopole element. The active radiating field area 2 of the antenna system is shown. A feedpoint unit 41 is shown connected to the coaxial radiating elements 3 and 4 at connections 13 and 17 respectively, for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 4:
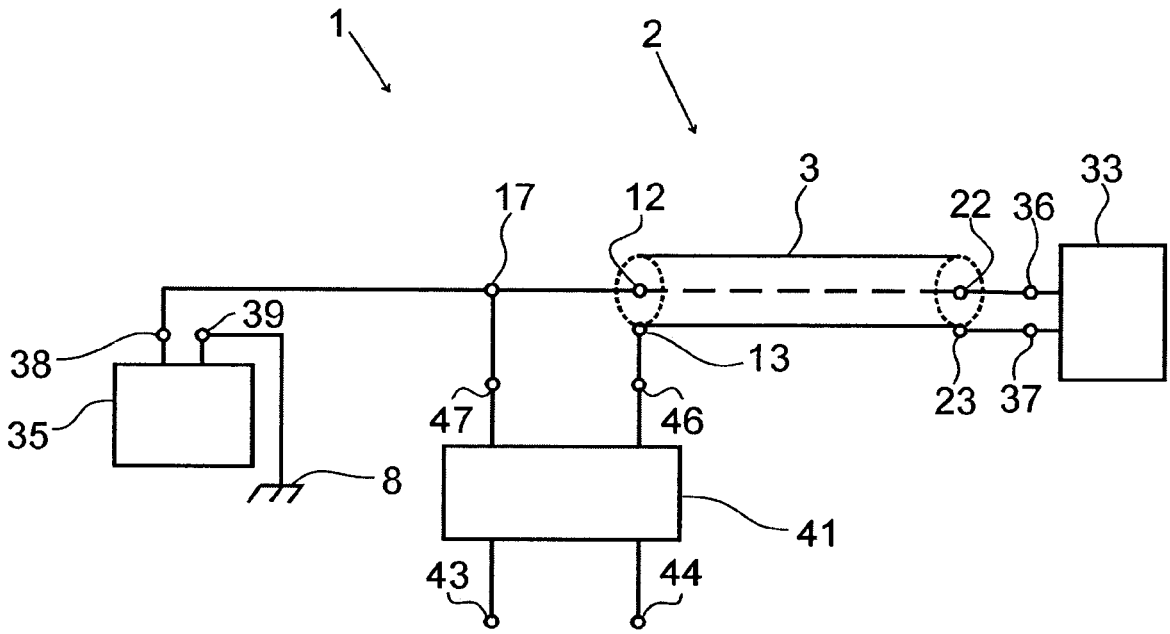

In a preferred embodiment of the invention, as shown in the drawing figures, and described with the various parts of the invention detailed below, referring to FIG. 4, a view of a hybrid dipole-like and monopole-like configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 17 forming a junction of the inside conductor 21 of the coaxial radiating element 3 and a conductor to connection 38 of terminating unit 35. Terminating unit 35 is shown connected at connection 39 to radio frequency earth ground reference 8. The hybrid configuration is shown horizontally arranged, and may be arranged vertically, spirally, or in a circular or loop-like configuration. The polarization may thus be adjusted and made as required, being determined by the physical shape and direction of the monopole element and location of the feedpoint with respect to the ground reference and the monopole element. The active radiating field area 2 of the antenna system is shown and includes the conductor between connections 17 and 38. A feedpoint unit 41 is shown connected to the coaxial radiating element 3 and to the conductor leading to connection 38 of the terminating unit 35 at connections 13 and 17 respectively, for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 5:
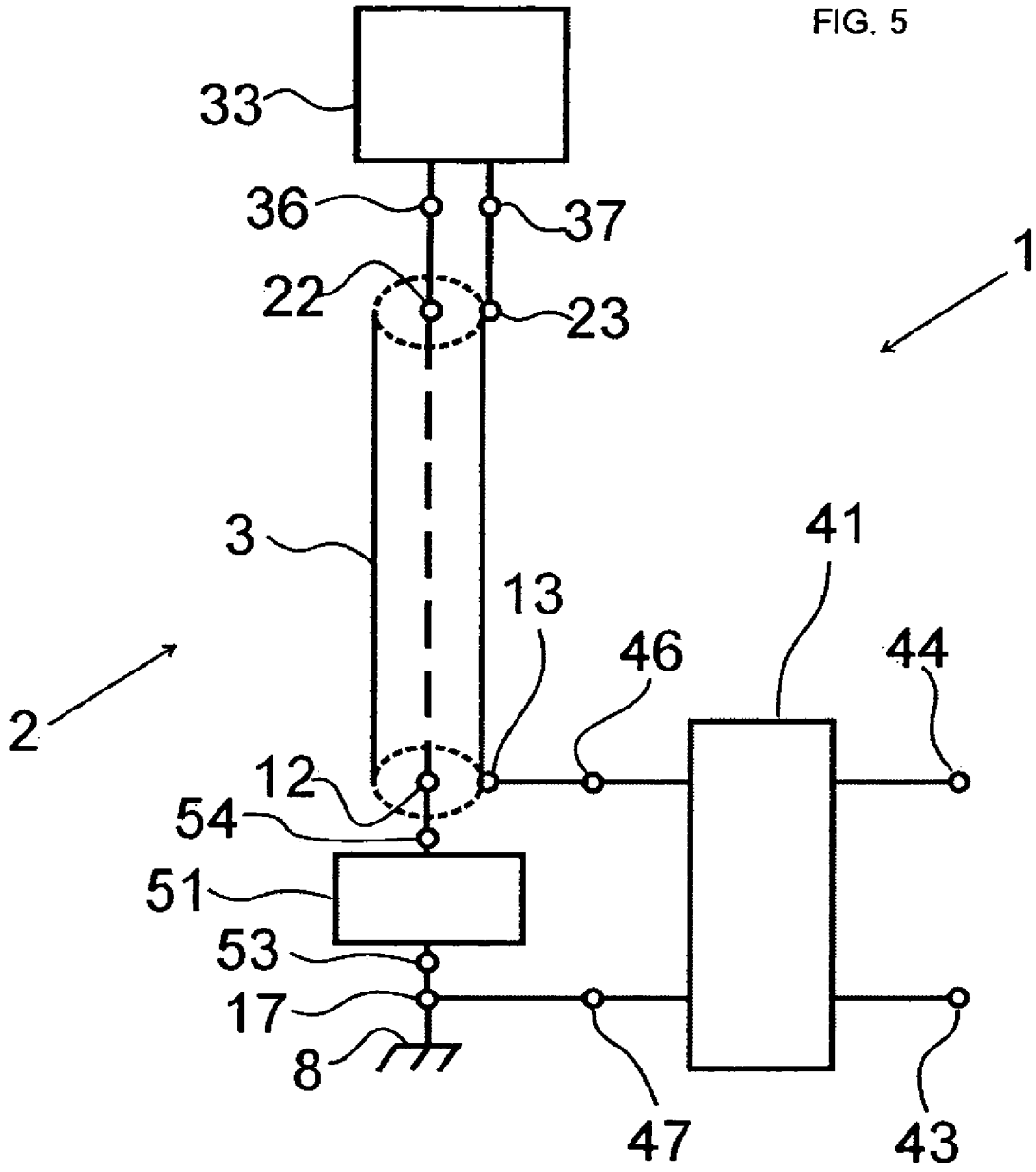

In a preferred embodiment of the invention, as shown in the drawing figures, and described with the various parts of the invention detailed below, referring to FIG. 5, a view of a monopole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 54 of terminating unit 51. Connection 53 of terminating unit 51 is connected to the junction connection 17 and frequency earth ground reference 8. The monopole configuration is shown vertically arranged, and may be arranged horizontally, sloped, bented, spirally, or in a circular or loop-like configuration, or conformed to other shapes and objects. The polarization may thus be adjusted and made as required, being determined by the physical shape and direction of the monopole element and location of the feedpoint with respect to the ground reference and the monopole element. The active radiating field area 2 of the antenna system is shown. A feedpoint unit 41 is shown connected to the coaxial radiating elements 3 and radio frequency ground reference 8 at connections 13 and 17 respectively, for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 6:
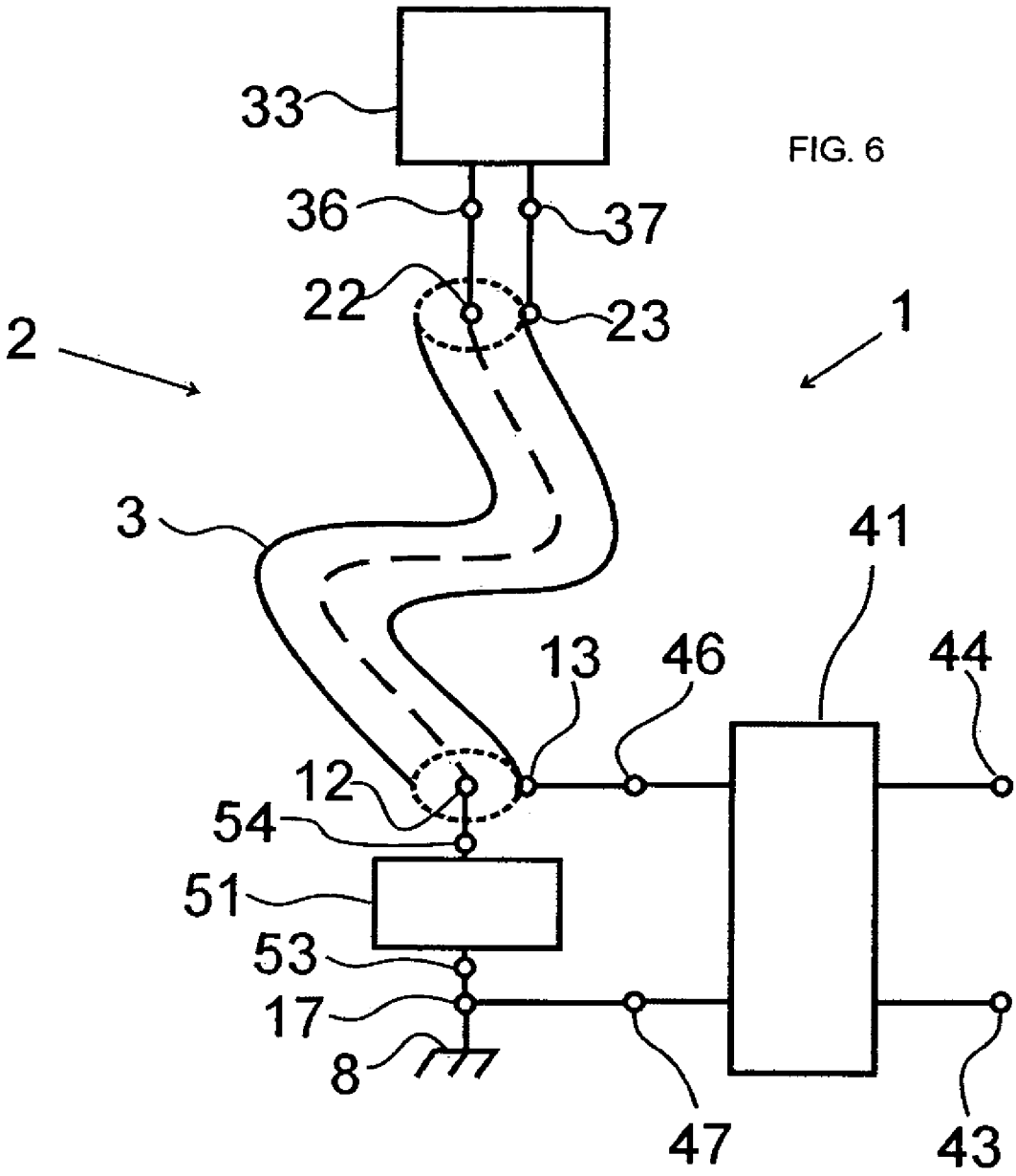
Figure 8:
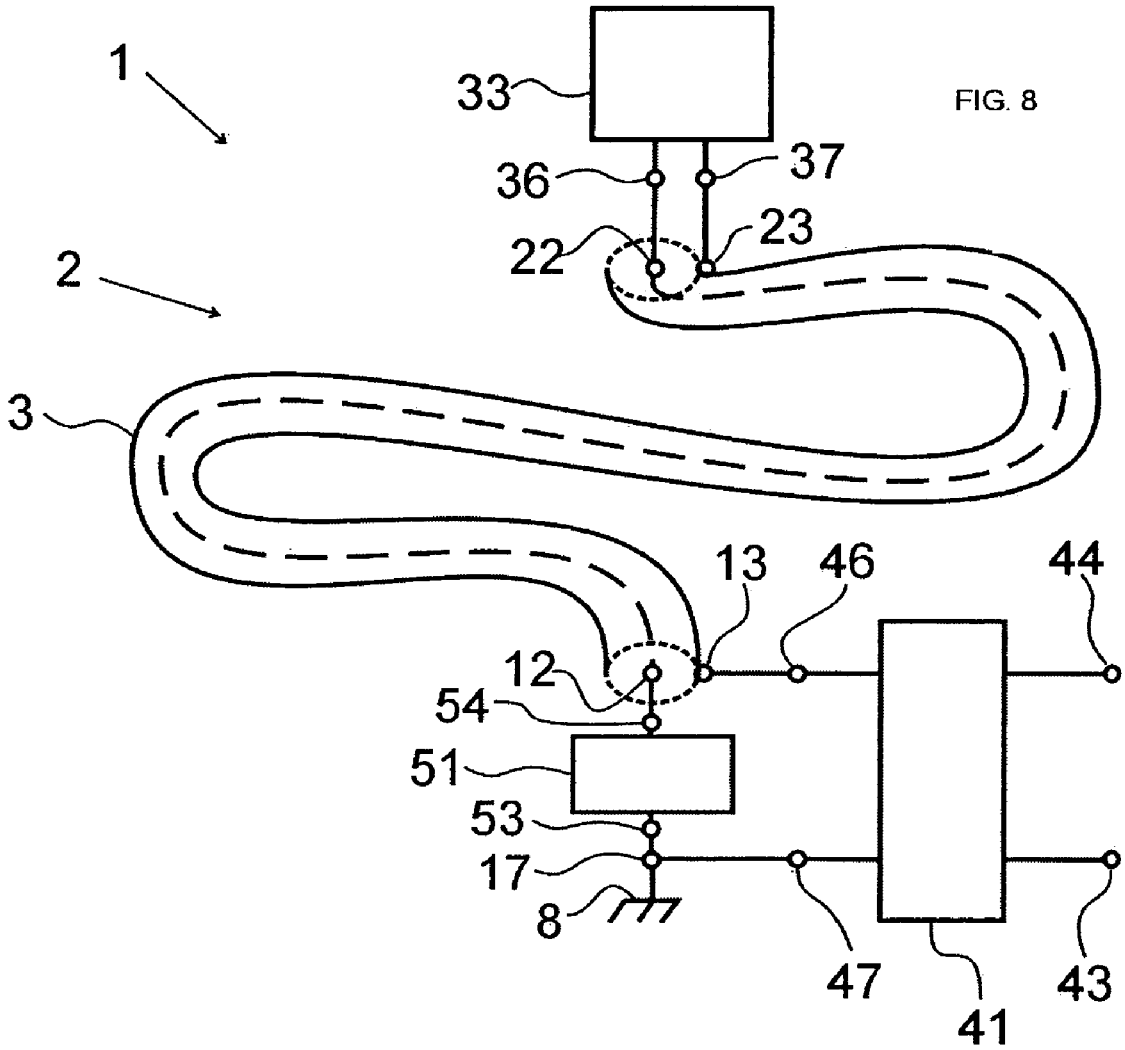

In a preferred embodiment of the invention, as shown in the drawing figures, and described with the various parts of the invention detailed below, referring to FIG. 6 and to FIG. 8, views of the monopole configurations of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. In this embodiment, the coaxial radiating element is bent, meandered, serpentined, spiralled, conformed, or helixed to provide desirable shapes for the antenna system requirements. The beneficial effect of the shaping of the element includes providing eliptical or circular polarization, multiple polarization of the electromagnetic field and radio waves. Other beneficial effects of this embodiment include conforming to the shape needed to fit within a given physical area, while maintaining a certain length of radiating element for efficient radiation properties at certain frequencies. At the opposite end of the element 3, a connection 12 is shown to the inside conductor 21, connecting it to the connection 54 of terminating unit 51. Connection 53 of terminating unit 51 is connected to the junction connection 17 and frequency earth ground reference 8. The monopole configuration is shown vertically arranged, and may be arranged horizontally, sloped, bented, spirally, or in a circular or loop-like configuration, or conformed to other shapes and objects. The polarization may thus be adjusted and made as required, being determined by the physical shape and direction of the monopole element and location of the feedpoint with respect to the ground reference and the monopole element. The active radiating field area 2 of the antenna system is shown. A feedpoint unit 41 is shown connected to the coaxial radiating elements 3 and radio frequency ground reference 8 at connections 13 and 17 respectively, for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 7:
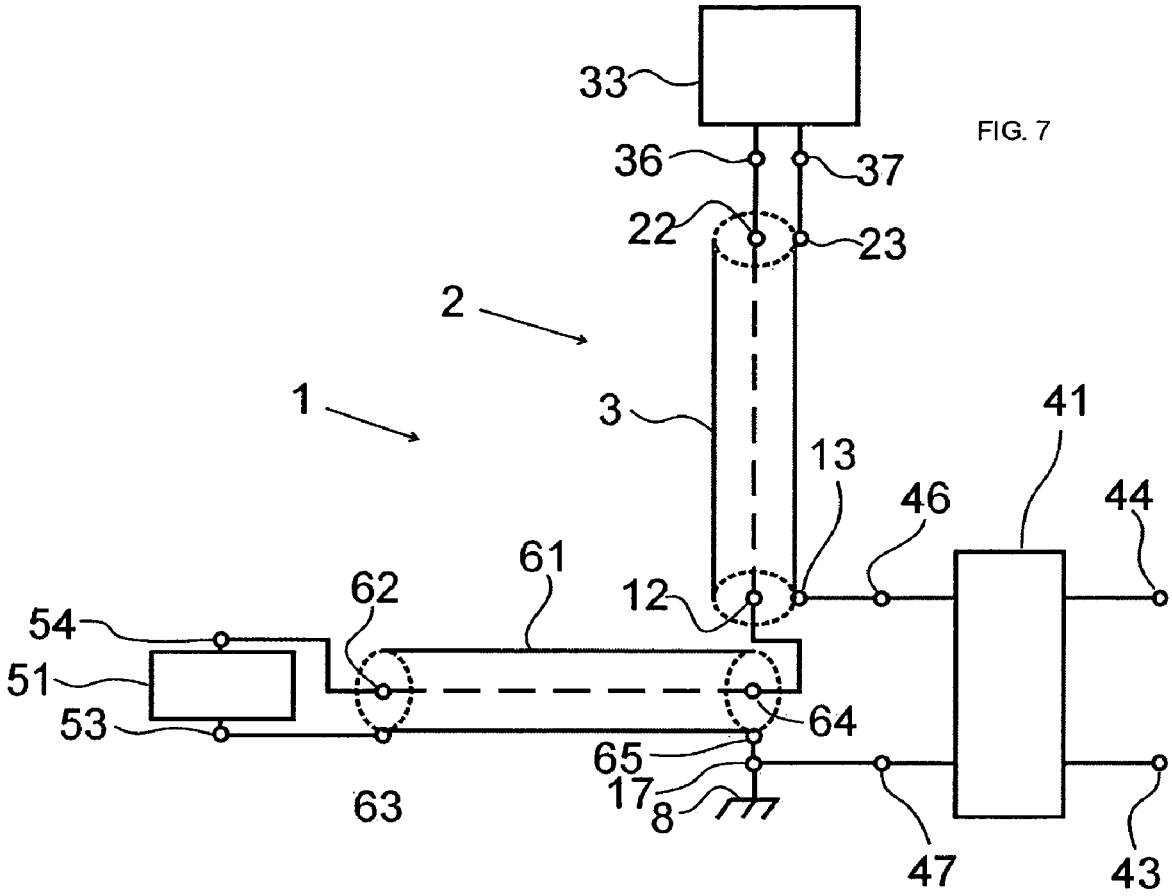

In a preferred embodiment of the invention, as shown in the drawing figures, and described with the various parts of the invention detailed below, referring to FIG. 7, a view of a monopole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. In this embodiment, the coaxial radiating element is bent, meandered, serpentined, spiralled, conformed, or helixed to provide desirable shapes for the antenna system requirements. The beneficial effect of the shaping of the element includes providing eliptical or circular polarization, multiple polarization of the electromagnetic field and radio waves. Other beneficial effects of this embodiment include conforming to the shape needed to fit within a given physical area, while maintaining a certain length of radiating element for efficient radiation properties at certain frequencies. At the opposite end of the element 3, a connection 12 is shown to the inside conductor 21, connecting it to the connection 64 of coaxial line 61. Connection 65 of coaxial line 65 is connected to the connection 17 which forms the junction of radio frequency ground reference 8 and connection 47 of feedpoint unit 41. The opposite end of coaxial line 61 is shown connected via connection 62 to connection 54 of the terminating impedance unit 51, and connection 63 is shown connected to the termination impedance unit 51 at connection 53. One of the advantages of this embodiment is the placing impedance unit 51 at any distance required from the feedpoint. Thus, impedance 51 is considered a remote termination unit in this embodiment, and may be separately remotely adjusted at a more convenient control point away from the feedpoint of the antenna radiating elements. The monopole configuration is shown vertically arranged, and may be arranged horizontally, sloped, bented, spirally, or in a circular or loop-like configuration, or conformed to other shapes and objects. The polarization may thus be adjusted and made as required, being determined by the physical shape and direction of the monopole element and location of the feedpoint with respect to the ground reference and the monopole element. The active radiating field area 2 of the antenna system is shown. A feedpoint unit 41 is shown connected to the coaxial radiating elements 3 and radio frequency ground reference 8 at connections 13 and 17 respectively, for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 9:
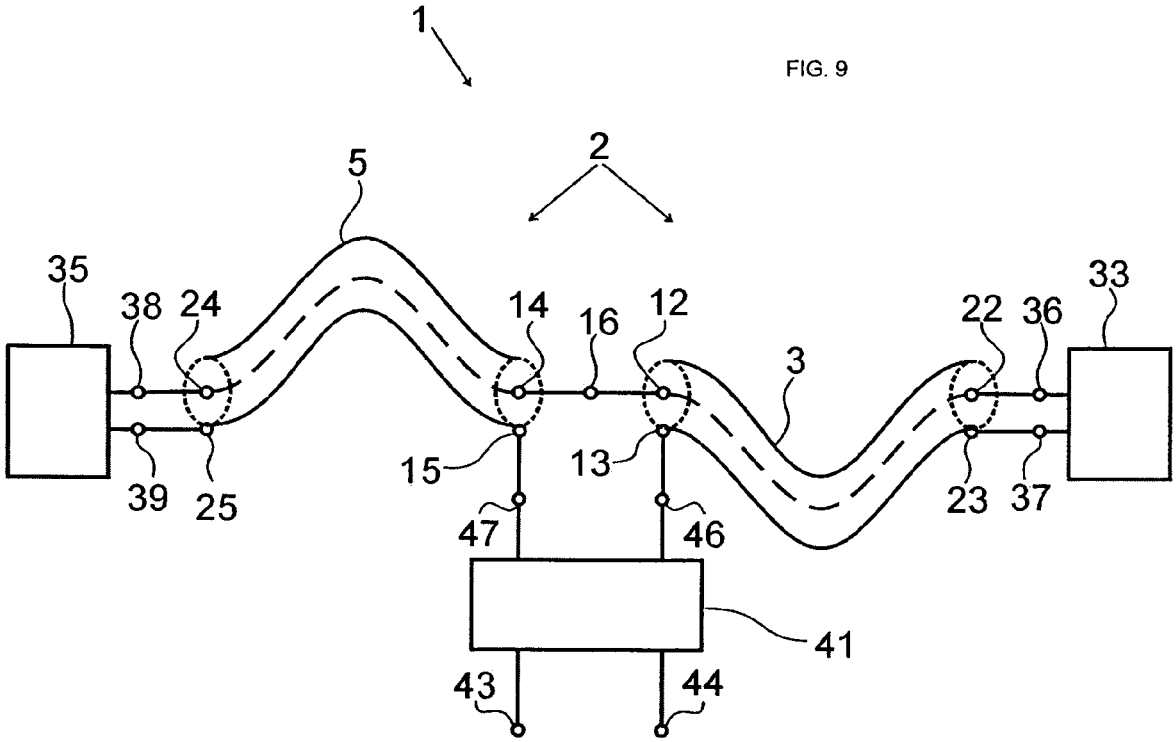
Figure 11:
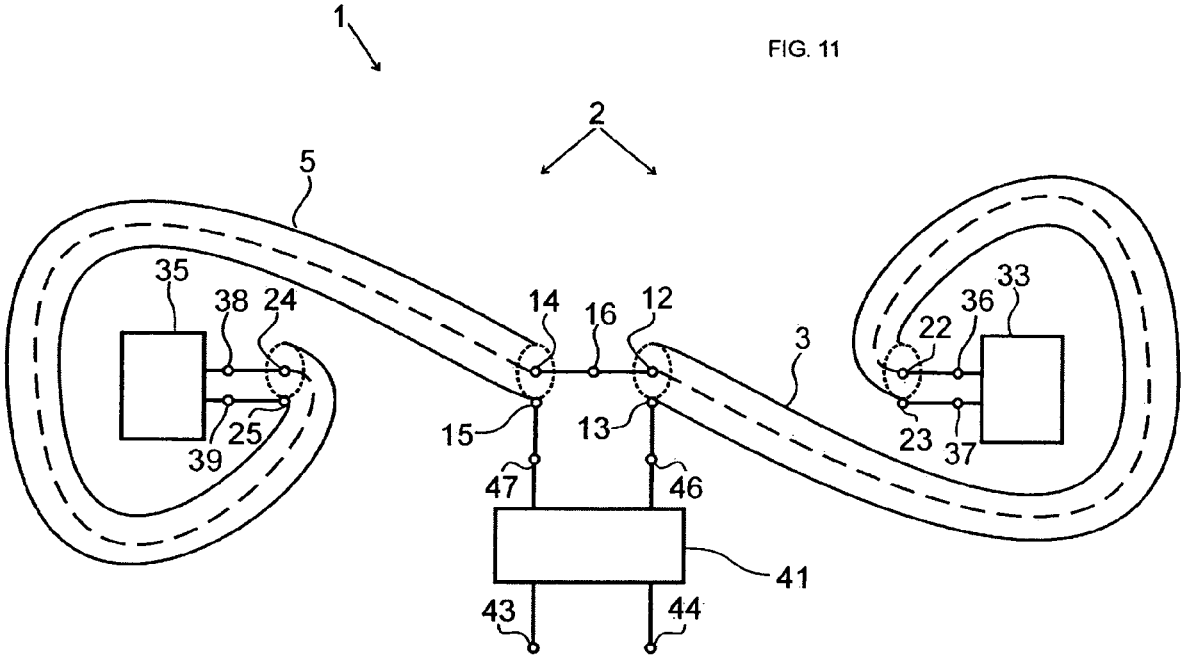

In a preferred embodiment of the invention, as shown in the drawing figures, and described with the various parts of the invention detailed below, referring to FIG. 9 and FIG. 11, views of the dipole configurations of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 14 of the inside conductor 21 of the coaxial radiating element 5. A coaxial radiating and receiving element 5 consisting of a coaxial line 20 as detailed in FIG. 53 with inside conductor 21 and outside conductor 6, is operatively connected by connections 38 connected to 24 and 25 connected to 39 to a terminating impedance unit 35. At the opposite end of the element 3, a connection 14 is shown to the inside conductor 21, connecting it to the connection 12 of the inside conductor 21 of the coaxial radiating element 3 via intermediate junction 16 connection. The active radiating field area 2 of the antenna system is shown. In this embodiment, the coaxial radiating element is bent, meandered, serpentined, spiralled, conformed, or helixed to provide desirable shapes for the antenna system requirements. Additionally as in FIG. 11, the coaxial radiating elements are spiralled and or wound upon forms or reels. Alternatively, the coiling or spooling also provides inductive reactance on the outside conductor of the coaxial radiating element, thus lowering the lowest frequency of higher efficiency for a given physical overall size. The beneficial effect of the shaping of the element includes providing eliptical or circular polarization, multiple polarization of the electromagnetic field and radio waves. Other beneficial effects of this embodiment include conforming to the shape needed to fit within a given physical area, while maintaining a certain length of radiating element for efficient radiation properties at certain frequencies. A feedpoint unit 41 is shown connected to the coaxial radiating elements 3 and 5 at connections 13 and 15 respectively, for connection to the radio frequency device at the connections 43 and 44.

A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

Figure 10:
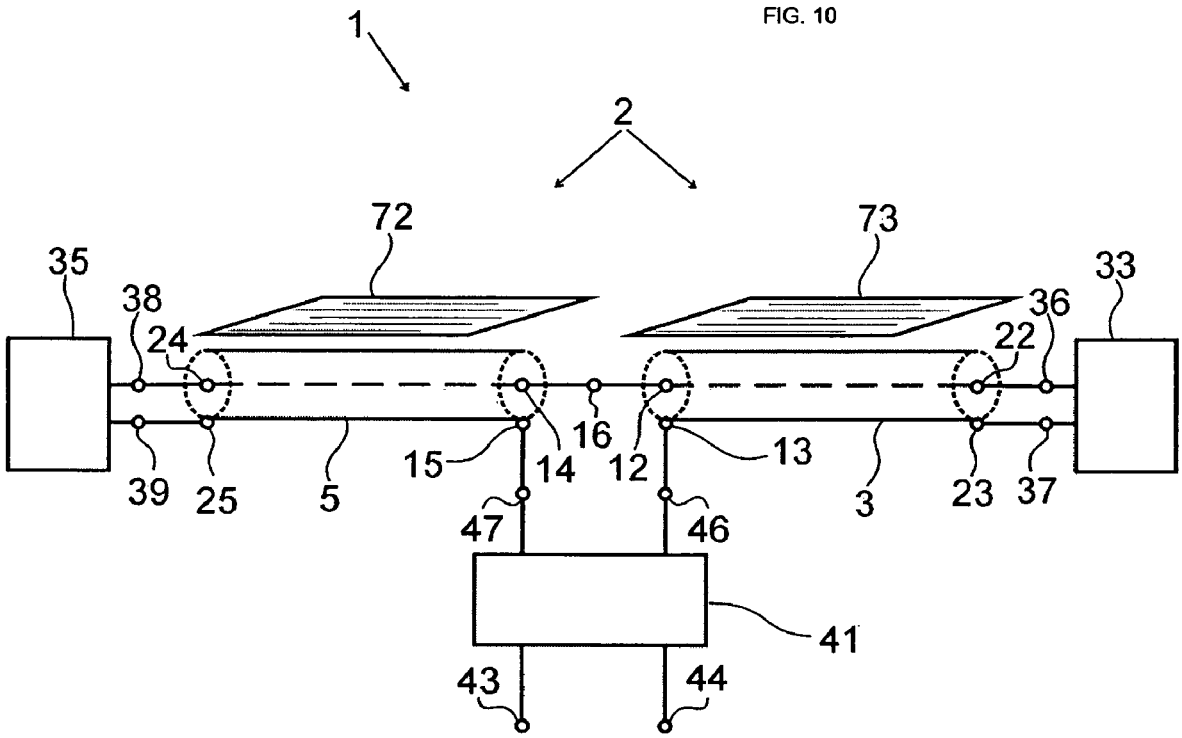

In a preferred embodiment of the invention, as shown in the drawing figures, and described with the various parts of the invention detailed below, referring to FIG. 10, a view of the dipole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 14 of the inside conductor 21 of the coaxial radiating element 5. A coaxial radiating and receiving element 5 consisting of a coaxial line 20 as detailed in FIG. 53 with inside conductor 21 and outside conductor 6, is operatively connected by connections 38 connected to 24 and 25 connected to 39 to a terminating impedance unit 35. At the opposite end of the element 3, a connection 14 is shown to the inside conductor 21, connecting it to the connection 12 of the inside conductor 21 of the coaxial radiating element 3 via intermediate junction 16 connection. The active radiating field area 2 of the antenna system is shown. In this embodiment, the coaxial radiating elements 3 and 5 are coupled to adjacent conductive material surfaces 73 and 72 respectively. One of the advantages of this embodiment is the use of adjacent conductive material surfaces to provide efficient electromagnetic radiation, and also to utilize structures that are ancillary to the antenna coaxial radiating elements. The coaxial element provides a stable impedance match for the antenna system, while coupling radio frequency energy with the conductive surface 72 and 73 structures. A feedpoint unit 41 is shown connected to the coaxial radiating elements 3 and 5 at connections 13 and 15 respectively, for connection to the radio frequency device at the connections 43 and 44. A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

Figure 12:
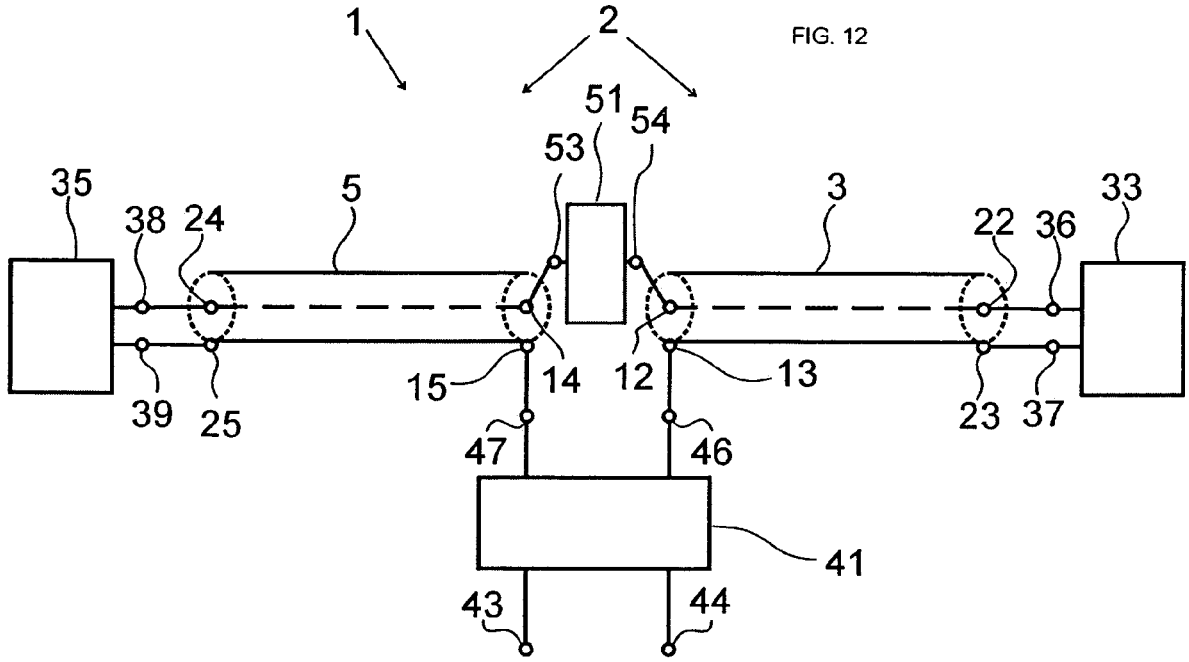

In a preferred embodiment of the invention, as shown in the drawing figures, and described with the various parts of the invention detailed below, referring to FIG. 12, a view of the dipole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connected to the connection 54 of the impedance termination unit 51, and connection 53 of the impedance termination unit 51 connected to connection 14 of the inside conductor 21 of the coaxial radiating element 5. A coaxial radiating and receiving element 5 consisting of a coaxial line 20 as detailed in FIG. 53 with inside conductor 21 and outside conductor 6, is operatively connected by connections 38 connected to 24 and 25 connected to 39 to a terminating impedance unit 35. An advantage of this embodiment is the placement of more distributed impedance terminations as required for best efficiency and to achieve broadband, bandpass, bandstop or band rejection qualities. The active radiating field area 2 of the antenna system is shown. A feedpoint unit 41 is shown connected to the coaxial radiating elements 3 and 5 at connections 13 and 15 respectively, for connection to the radio frequency device at the connections 43 and 44. A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

Figure 13:
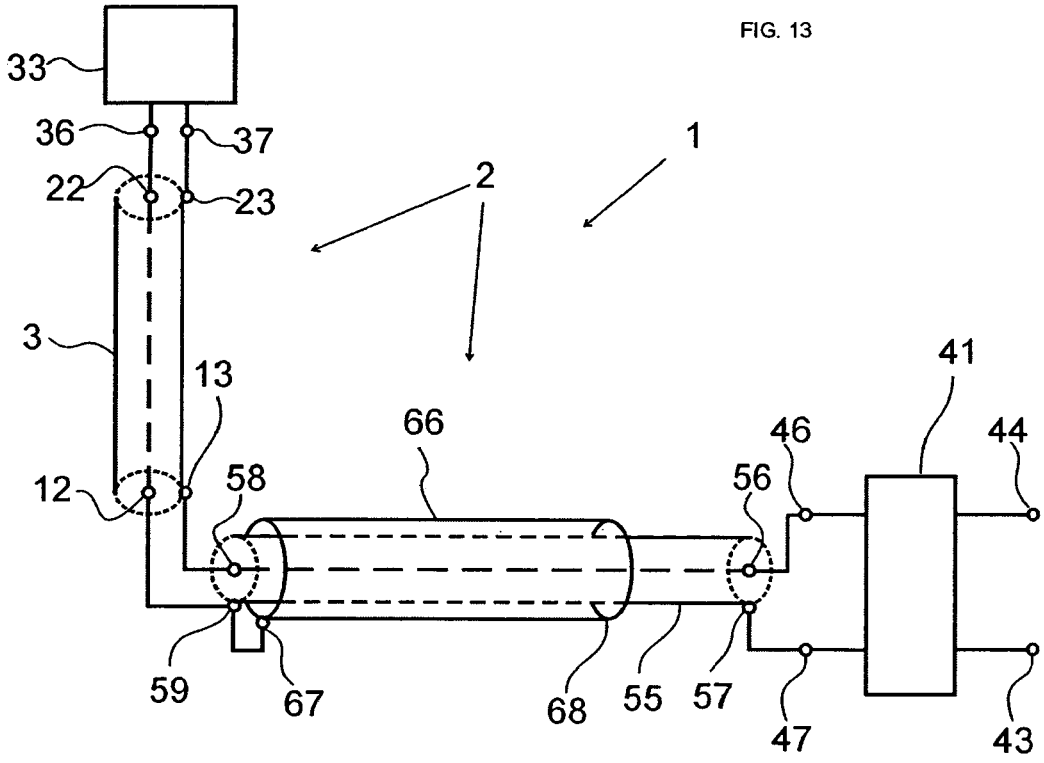

In a preferred embodiment of the invention, as shown in the drawing figures, and described with the various parts of the invention detailed below, referring to FIG. 13, a view of a hybrid dipole-like and monopole-like configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 59 of the coaxial transmission line 55 and also connecting with the connection 67 of the coaxial sleeve 66 surrounding a portion of the coaxial tranmission line 55. Also shown is the connection 13 of the outer conductor of the coaxial radiating element connected to the connection 58 of the coaxial transmission line 55. The coaxial transmission line 55 is connected at connections 56 and 57 to the connections 46 and 47 respectively of the feedpoint unit 41. Alternatively, the coaxial transmission line is a balanced transmission line, a microstrip, or a stripline. A free end 68 of the coaxial sleeve 66 is shown. The hybrid configuration is shown partially vertical and partially horizontally arranged, and is alternatively arranged vertically, horizontally, linearly, spirally, or in a circular or loop-like configuration. Alternatively, it is arranged as a whip antenna configuration. The polarization may thus be adjusted and made as required, being determined by the physical shape and direction of the monopole element and location of the feedpoint with respect to the ground reference and the monopole element. The active radiating field area 2 of the antenna system is shown and includes the coaxial sleeve 66. Advantages of the embodiment include the qualities of sleeve decoupling and radiation from the sleeve as a support structure. Other advantages of the embodiment include flexibility of the sleeve portion and a larger active area of the antenna surface. A feedpoint unit 41 is also shown for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 14:
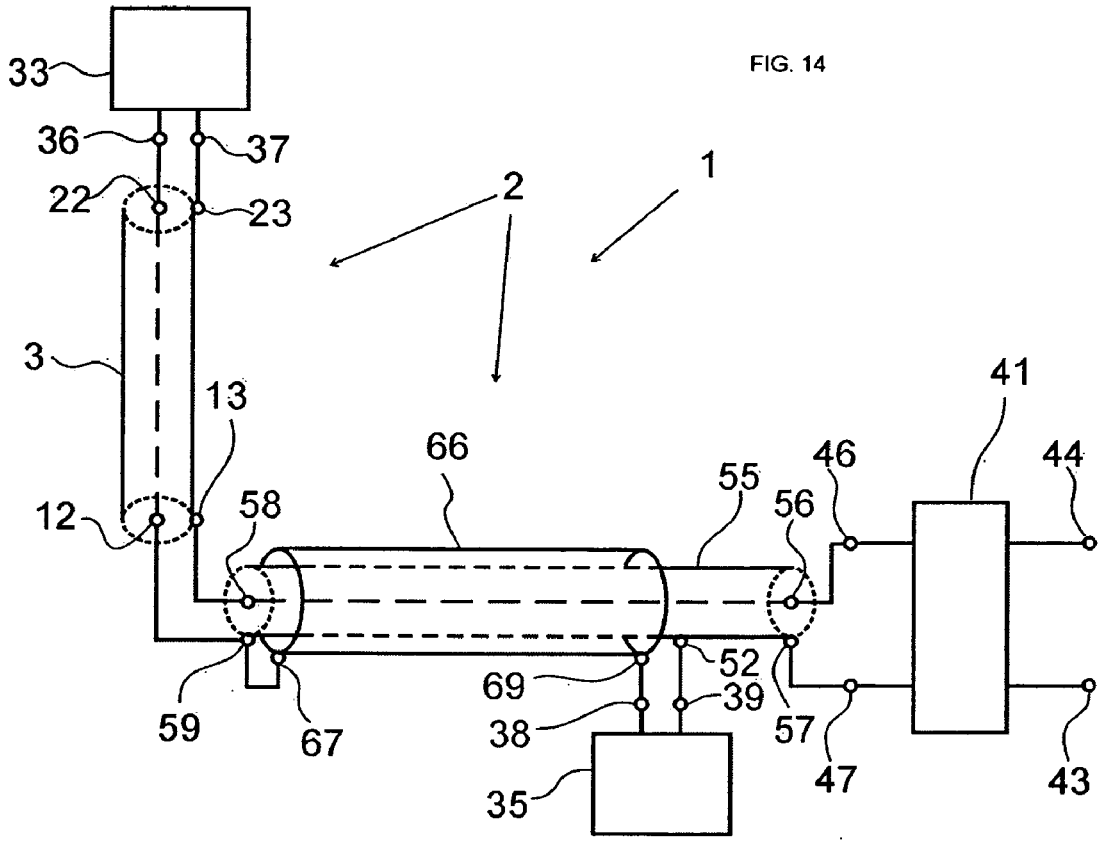
FIG. 14 shows the coaxial antenna system, with an end termination of the radiating and receiving element, a coaxial line connection, a coaxial sleeve surrounding the coaxial transmission line, and a terminating impedance connected between the end of the sleeve and the coaxial transmission line.

In a preferred embodiment of the invention, as shown in the drawing figures, and described with the various parts of the invention detailed below, referring to FIG. 14, a view of a hybrid dipole-like and monopole-like configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 59 of the coaxial transmission line 55 and also connecting with the connection 67 of the coaxial sleeve 66 surrounding a portion of the coaxial tranmission line 55. Also shown is the connection 13 of the outer conductor of the coaxial radiating element connected to the connection 58 of the coaxial transmission line 55. The coaxial transmission line 55 is connected at connections 56 and 57 to the connections 46 and 47 respectively of the feedpoint unit 41. Alternatively, the coaxial transmission line is a balanced transmission line, a microstrip, or a stripline. Connection 69 at the end of sleeve 66 is shown connected to connection 38 of the terminating unit 35 which is further connected at 39 to the outer conductor of the transmission line 55 at connection 52. The hybrid configuration is shown partially vertical and partially horizontally arranged, and is alternatively arranged vertically, horizontally, linearly, spirally, or in a circular or loop-like configuration. Alternatively, it is arranged as a whip antenna configuration. The polarization may thus be adjusted and made as required, being determined by the physical shape and direction of the monopole element and location of the feedpoint with respect to the ground reference and the monopole element. The active radiating field area 2 of the antenna system is shown and includes the coaxial sleeve 66. Advantages of the embodiment include the qualities of sleeve decoupling and radiation from the sleeve as a support structure. Other advantages of the embodiment include flexibility of the sleeve portion and a larger active area of the antenna surface. Additional advantages include the addition of the terminating unit 35 to better control the impedance of the sleeve 66 section of the antenna system. A feedpoint unit 41 is also shown for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

Figure 15:
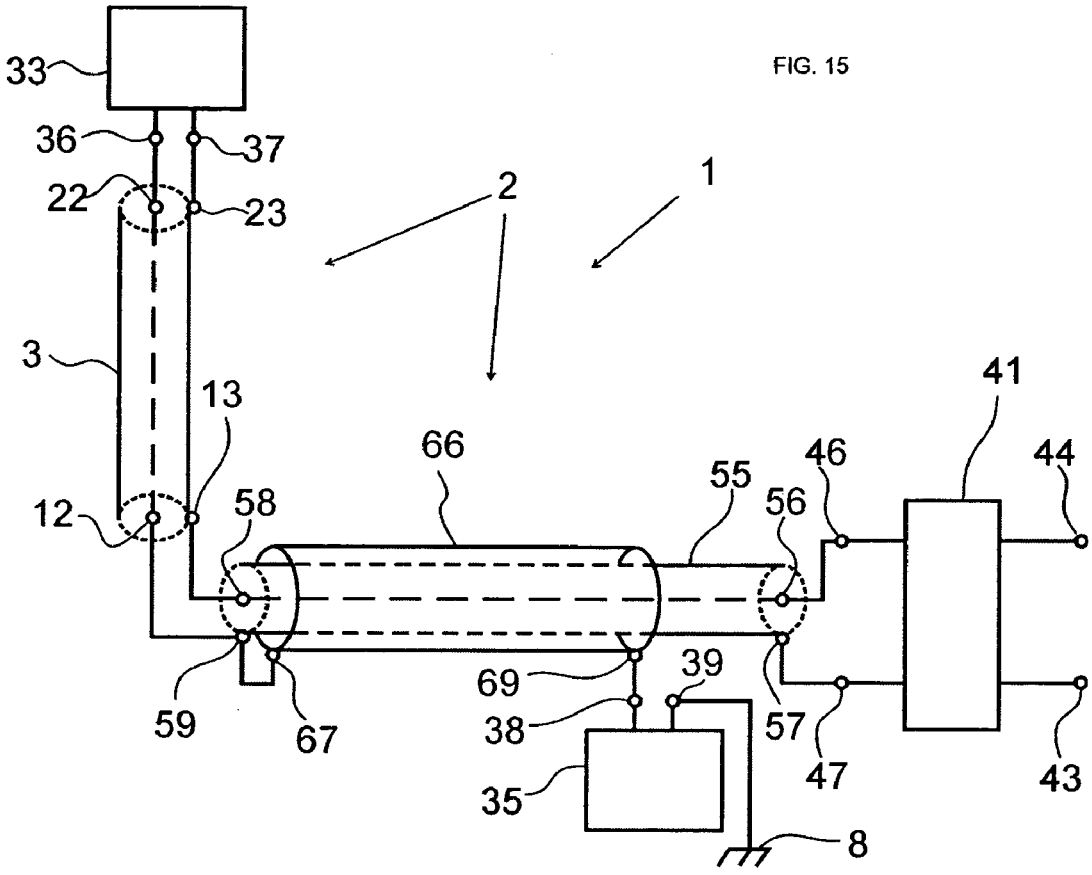
FIG. 15 shows the coaxial antenna system, with an end termination of the radiating and receiving element, a coaxial line connection, a coaxial sleeve surrounding the coaxial transmission line, and a terminating impedance connected between the end of the sleeve and radio frequency ground reference.

In a preferred embodiment of the invention, as shown in the drawing figures, and described with the various parts of the invention detailed below, referring to FIG. 15, a view of a hybrid dipole-like and monopole-like configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 59 of the coaxial transmission line 55 and also connecting with the connection 67 of the coaxial sleeve 66 surrounding a portion of the coaxial tranmission line 55. Also shown is the connection 13 of the outer conductor of the coaxial radiating element connected to the connection 58 of the coaxial transmission line 55. The coaxial transmission line 55 is connected at connections 56 and 57 to the connections 46 and 47 respectively of the feedpoint unit 41. Alternatively, the coaxial transmission line is a balanced transmission line, a microstrip, or a stripline. Connection 69 at the end of sleeve 66 is shown connected to connection 38 of the terminating unit 35 which is further connected at 39 to the radio frequency ground reference 8. The hybrid configuration is shown partially vertical and partially horizontally arranged, and is alternatively arranged vertically, horizontally, linearly, spirally, or in a circular or loop-like configuration. Alternatively, it is arranged as a whip antenna configuration. The polarization may thus be adjusted and made as required, being determined by the physical shape and direction of the monopole element and location of the feedpoint with respect to the ground reference and the monopole element. The active radiating field area 2 of the antenna system is shown and includes the coaxial sleeve 66. Advantages of the embodiment include the qualities of sleeve decoupling and radiation from the sleeve as a support structure. Other advantages of the embodiment include flexibility of the sleeve portion and a larger active area of the antenna surface. Additional advantages include the addition of the terminating unit 35 to better control the impedance of the sleeve 66 section of the antenna system. Further advantages include the use of a radio frequency ground reference for the antenna system. A feedpoint unit 41 is also shown for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

In a preferred embodiment of the invention, as shown in the drawing figures, and described with the various parts of the invention detailed below, referring to FIG. 16, a view of a hybrid dipole-like and monopole-like configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 59 of the coaxial transmission line 55 and also connecting with the connection 67 of the coaxial sleeve 66 surrounding a portion of the coaxial tranmission line 55. Also shown is the connection 13 of the outer conductor of the coaxial radiating element connected to the connection 58 of the coaxial transmission line 55. The coaxial transmission line 55 is connected at connections 56 and 57 to the connections 46 and 47 respectively of the feedpoint unit 41. Alternatively, the coaxial transmission line is a balanced transmission line, a microstrip, or a stripline. A free end 68 of the coaxial sleeve 66 is shown. In this embodiment, the coaxial radiating elements 3 is coupled to adjacent conductive material surfaces 73. One of the advantages of this embodiment is the use of adjacent conductive material surfaces to provide efficient electromagnetic radiation, and also to utilize structures that are ancillary to the antenna coaxial radiating elements. The coaxial element provides a stable impedance match for the antenna system, while coupling radio frequency energy with the conductive surface 73 structures. The hybrid configuration is shown partially vertical and partially horizontally arranged, and is alternatively arranged vertically, horizontally, linearly, spirally, or in a circular or loop-like configuration. Alternatively, it is arranged as a whip antenna configuration. The polarization may thus be adjusted and made as required, being determined by the physical shape and direction of the monopole element and location of the feedpoint with respect to the ground reference and the monopole element. The active radiating field area 2 of the antenna system is shown and includes the coaxial sleeve 66. Advantages of the embodiment include the qualities of sleeve decoupling and radiation from the sleeve as a support structure. Other advantages of the embodiment include flexibility of the sleeve portion and a larger active area of the antenna surface. A feedpoint unit 41 is also shown for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

In a preferred embodiment of the invention, as shown in the drawing figures, and described with the various parts of the invention detailed below, referring to FIG. 17, a view of a hybrid dipole-like and monopole-like configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 59 of the coaxial transmission line 55 and also connecting with the connection 67 of the coaxial sleeve 66 surrounding a portion of the coaxial tranmission line 55. Also shown is the connection 13 of the outer conductor of the coaxial radiating element connected to the connection 58 of the coaxial transmission line 55. The coaxial transmission line 55 is connected at connections 56 and 57 to the connections 46 and 47 respectively of the feedpoint unit 41. Alternatively, the coaxial transmission line is a balanced transmission line, a microstrip, or a stripline. A free end 68 of the coaxial sleeve 66 is shown. In this embodiment, the coaxial radiating elements 3 is coupled and connected as shown with connection 23 of the outside conductor of the radiating element 3 connected to connection 74 of the conductive material surface 73, and it becomes part of the radiating element. One of the advantages of this embodiment is the use of adjacent conductive material surfaces to provide efficient electromagnetic radiation, and also to utilize structures that are ancillary to the antenna coaxial radiating elements. The coaxial element provides a stable impedance match for the antenna system, while coupling radio frequency energy with the conductive surface 73 structures. The hybrid configuration is shown partially vertical and partially horizontally arranged, and is alternatively arranged vertically, horizontally, linearly, spirally, or in a circular or loop-like configuration. Alternatively, it is arranged as a whip antenna configuration. The polarization may thus be adjusted and made as required, being determined by the physical shape and direction of the monopole element and location of the feedpoint with respect to the ground reference and the monopole element. The active radiating field area 2 of the antenna system is shown and includes the coaxial sleeve 66. Advantages of the embodiment include the qualities of sleeve decoupling and radiation from the sleeve as a support structure. Other advantages of the embodiment include flexibility of the sleeve portion and a larger active area of the antenna surface. A feedpoint unit 41 is also shown for connection to the radio frequency device at the connections 43 and 44. A detailed description of the feedpoint unit 41 is provided as detailed below and above in descriptions of the preferred embodiments. The invention antenna system described herein provides specific qualities and advantages for use as an efficient transducer for electromagnetic fields as detailed the various descriptions provided herein.

In a preferred embodiment of the invention, as shown in the drawing figures, and described with the various parts of the invention detailed below, referring to FIG. 18, a view of a dipole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is shorted on the end at connections 23 to 22. At the opposite end of the element 3, a connection 12 is shown to the inside conductor 21, connected to the connection 54 of the impedance termination unit 51, and connection 53 of the impedance termination unit 51 connected to connection 14 of the inside conductor 21 of the coaxial radiating element 5. A coaxial radiating and receiving element 5 consisting of a coaxial line 20 as detailed in FIG. 53 with inside conductor 21 and outside conductor 6, is shorted on the end at connections 24 to 25. An advantage of this embodiment is the placement of the impedance termination in the central part of the antenna structure near the feedpoint. The center impedance termination configuration is advangeous for best efficiency and to achieve broadband, bandpass, bandstop or band rejection qualities. It also is advantageous for mechanical structure of the antenna system, and convenient for manufacturing by making it possible to place the impedance termination in the central support structure which alternatively includes the feedpoint unit 41. The active radiating field area 2 of the antenna system is shown. A feedpoint unit 41 is shown connected to the coaxial radiating elements 3 and 5 at connections 13 and 15 respectively, for connection to the radio frequency device at the connections 43 and 44. A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

In a preferred embodiment of the invention, a dipole configuration as is shown in FIG. 18 with shorted ends of the coaxial line radiating elements is utilized, one on each end, providing a broadband match with high efficiency over more than 10 octaves of radio frequency spectrum with high return loss to the feedpoint. In this embodiment, a terminating impedance unit 51 is connected at the midpoint between inner conductor connections 12 and 14 of the coaxial radiating elements 3 and 5. Alternatively, as shown in FIG. 19, the radiating elements of the dipole are unequal in length. The antenna radiating and receiving elements in this embodiment are of unequal lengths, with the shorter element being approximately equal to between approximately 7.5 percent and approximately 99 percent of the length of the longer element. An advantage of the unequal length is to beneficially provide intermediate impedance vectors and offset electrical resonances of the finite radiating element lengths, thus reducing the need for resistive impedance in the terminating impedance.

In embodiments of the invention, a dipole configuration or a multiple radiating element configuration is utilized, with an unequal length of the opposite or plurality of elements, and an advantage of the unequal length is to beneficially provide intermediate impedance vectors and offset electrical resonances of the finite radiating element lengths, thus reducing the need for resistive impedance in the terminating impedance.

In a preferred embodiment of the invention, it is alternatively desired to avoid resonances of zero or 180 degrees phase which yield the most extreme impedances at the feedpoint, and the offsetting of the feedpoint longitudinally along the radiating elements as is illustrated in FIGS. 2, 40, 13, 18, 19, reduces the magnitude of the impedance matching reactance or resistance needed in the terminating units and at the antenna feedpoint for meeting broadbanding, bandwidth, bandstop, and band reject requirements. Alternatively, unequal lengths of the antenna elements are shown.

In a preferred embodiment of the invention, as illustrated in FIG. 39, the antenna system is partially or wholly contained with a housing 162, containing a singular or a plurality of coaxial antenna radiating elements. In a preferred embodiment of the invention, as illustrated in FIG. 52, the antenna system is partially or wholly contained with a housing 162, containing a singular or a plurality of coaxial antenna radiating elements which are mounted on or coupled to a surface 161 material such as a circuit board. In a preferred embodiment of the invention, as illustrated in FIG. 52, the antenna system is partially or wholly contained with a housing 162, containing a singular or a plurality of coaxial antenna radiating elements which are mounted on or coupled to a surface 161 material such as a circuit board, the antenna radiating elements are bent or conformed to the surfaces and or internal space within the housing, as required to fit within the constraints of the housing. In a preferred embodiment of the invention, as illustrated in FIG. 52, the antenna system is partially or wholly contained with a housing 162, containing a singular or a plurality of coaxial antenna radiating elements which are mounted on or coupled to a surface 161 material such as a circuit board and the housing itself is partly or wholly of a conductive material which is utilized as part of the radiating conductor of the antenna as illustrated in the drawing FIGS. 16, 17, 41, or 42. In an alternative embodiment, the plurality of feedpoints is connected with one feedpoint to a transmitter and the other feedpoint to a reciever. In another alternative embodiment, the different antenna elements have different passbands and rejection bands so as to provide a duplexing arrangement as an integral part of the antenna system. Advantages of this embodiment include the elimination of the need for a combiner within a transceiver between the receiver and transmitter ports.

In a preferred embodiment of the invention, as shown in the drawing figures, and described with the various parts of the invention detailed below, referring to FIG. 41, a view of a dipole configuration of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 14 of the inside conductor 21 of the coaxial radiating element 5. A coaxial radiating and receiving element 5 consisting of a coaxial line 20 as detailed in FIG. 53 with inside conductor 21 and outside conductor 6, is operatively connected by connections 38 connected to 24 and 25 connected to 39 to a terminating impedance unit 35. At the opposite end of the element 3, a connection 14 is shown to the inside conductor 21, connecting it to the connection 12 of the inside conductor 21 of the coaxial radiating element 3 via intermediate junction 16 connection. The active radiating field area 2 of the antenna system is shown. Conductive material 75 and 76 coupled electromagnetically to and in longitudinal proximity to radiating and receiving element 3 and 5 respectively is shown. The conductive materials 75 and 76 alternatively are metallic surfaces, wire, tubes, and or cables. Alternatively said cables and wires are utilized as part of the mechanical support structure of the antenna system, and contribute to the radiation efficiency by becoming part of the radiating element through electronic coupling, whether that be capacitive, inductive, distributed, or lumped coupling. Alternatively the conductive materials 75 and 76 form electronically resonant structures and are used beneficially as part of the antenna system to achieve higher efficiency, or as a transmission line formed between the outer surface of element 5 and the outer surface of conductive material 76, and or the outer surface of element 3 and the outer surface of conductive material 75. In FIG. 42, as an alternative preferred embodiment, the conductive materials 76 and 75 are connected by means of connections typified by connections 78 and 77. A feedpoint unit 41 is shown connected to the coaxial radiating elements 3 and 5 at connections 13 and 15 respectively, for connection to the radio frequency device at the connections 43 and 44. A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

In a preferred embodiment of the invention, as illustrated in FIG. 52, the antenna system is partially or wholly contained with a housing 162, containing a singular or a plurality of coaxial antenna radiating elements which are mounted on or coupled to a surface 161 material such as a circuit board.

In a preferred embodiment of the invention, as shown in the drawing figures, and described with the various parts of the invention detailed below, referring to FIG. 50, FIG. 51, and FIG. 1, views of the dipole configurations of the invention coaxial antenna system is shown. The coaxial antenna system 1 and electromagnetic field radiating area 2 of the antenna system is shown. A coaxial radiating and receiving element 3 consisting of a coaxial line 20 as detailed in FIG. 53 with inside conductor 21 and outside conductor 6, is operatively connected by connections 36 connected to 22 and 23 connected to 37 to a terminating impedance unit 33. At the opposite end of the element 3, a connection 12 is shown to the inside conductor 21, connecting it to the connection 14 of the inside conductor 21 of the coaxial radiating element 5. A coaxial radiating and receiving element 5 consisting of a coaxial line 20 as detailed in FIG. 53 with inside conductor 21 and outside conductor 6, is operatively connected by connections 38 connected to 24 and 25 connected to 39 to a terminating impedance unit 35. At the opposite end of the element 3, a connection 14 is shown to the inside conductor 21, connecting it to the connection 12 of the inside conductor 21 of the coaxial radiating element 3 via intermediate junction 16 connection. The active radiating field area 2 of the antenna system is shown. In this embodiment, the coaxial radiating element is bent, meandered, serpentined, spiralled, conformed, or helixed to provide desirable shapes for the antenna system requirements. Additionally as in FIG. 11, the coaxial radiating elements are spiralled and or wound upon forms or reels 133 and 135 with wind up cranks 136 and 137. Alternatively, the coiling or spooling also provides inductive reactance on the outside conductor of the coaxial radiating element, thus lowering the lowest frequency of higher efficiency for a given physical overall size. The beneficial effect of the shaping of the element includes providing eliptical or circular polarization, multiple polarization of the electromagnetic field and radio waves. Other beneficial effects of this embodiment include conforming to the shape needed to fit within a given physical area, while maintaining a certain length of radiating element for efficient radiation properties at certain frequencies. An embodiment of the invention is shown in FIG. 51 deployed as an inverted-V dipole configuration with a radio receiver transmitter 151 and user interface 152. A feedpoint unit 41 contained within a housing 141 or alternatively within housing 131 is shown connected to the coaxial radiating elements 3 and 5 at connections 13 and 15 respectively, for connection to the radio frequency device at the connections 43 and 44 which are provided by connector 141 at the axis of the reel housing 141 and the crank 146. A detailed description of the feedpoint unit 41 is provided below and above in descriptions of other preferred embodiments. The invention antenna system described herein provides specific qualities and advantages for use as an efficient transducer for electromagnetic fields as detailed the various descriptions provided herein.

The Following Detailed Description Describes the Invention and the Preferred Embodiments of the Invention and the Parts of the Invention Illustrated in the Drawing Figures

1 is the coaxial antenna system.
2 is the active area for radiating and receiving electromagnetic radio frequencies.
3 is the coaxial radiating and receiving element of coaxial antenna system.
4 is the conductive radiating and receiving element part of coaxial antenna system.
5 is the coaxial radiating and receiving element of coaxial antenna system.
6 is the outer conductor of coaxial line.
7 is the outside surface of the outer conductor of coaxial line.
8 is the ground or earth reference plane reference plane for electromagnetic radio frequencies.
9 is the inside surface of the outer conductor of coaxial line.
10 is the outside surface of the inner conductor of coaxial line.
11 is the dielectric, insulator, vacuum, or intentionally lossy material between the outside surface of the inner conductor of the coaxial line and the inside surface of the outer conductor of the coaxial line.
12 is the connection to the inner conductor of coaxial radiating and receiving element 3.
13 is the feedpoint connection to the outer conductor of coaxial radiating and receiving element 3.
14 is the connection to the inner conductor of coaxial radiating and receiving element 5.
15 is the feedpoint connection to the outer conductor of coaxial radiating and receiving element 5.
16 is the connection between inner conductors of coaxial radiating and receiving elements 3 and 5.
17 is the junction connection of conductors of coaxial antenna system and feedpoint connection 47.
20 is the coaxial line.
21 is the inside conductor of coaxial line.
22 is the connection to the inner conductor of terminated end of the coaxial radiating and receiving element 3.
23 is the connection to outer conductor of terminated end of coaxial radiating and receiving element 3.
24 is the connection to the inner conductor of terminated end of the coaxial radiating and receiving element 5.
25 is the connection to outer conductor of terminated end of coaxial radiating and receiving element 5.
26 is the free end of radiating and receiving element 4.
33 is the terminating impedance unit connected to end of coaxial radiating and receiving element 3
35 is the terminating impedance unit connected to coaxial antenna system.
36 is the connection terminal of terminating impedance unit 33.
37 is the connection terminal of terminating impedance unit 33.
38 is the connection terminal of terminating impedance unit 35.
39 is the connection terminal of terminating impedance unit 35.
41 is the feedpoint unit for connection to radiating and receiving elements and transmitter or receiver.
43 is the connection terminal of feedpoint unit 41 to transmitter or receiver.
44 is the connection terminal of feedpoint unit 41 to transmitter or receiver.
46 is the connection terminal of feedpoint unit 41 to radiating and receiving antenna elements.
47 is the connection terminal of feedpoint unit 41 to radiating and receiving antenna elements.
51 is the terminating impedance unit connected to coaxial antenna system and feedpoint.
53 is the connection terminal of terminating impedance unit 51.
54 is the connection terminal of terminating impedance unit 51.
55 is the coaxial line connecting feedpoint unit 41 to radiating and receiving element 3 and sleeve 66.
56 is the connection of coaxial line 55 inner conductor to terminal 46 of feedpoint unit of 41.
57 is the connection of coaxial line 55 outer conductor to terminal 47 of feedpoint unit of 41.
58 is the connection of coaxial line 55 inner conductor to outer conductor of radiating and receiving element 3.
59 is the connection of coaxial line 55 outer conductor to inner conductor of radiating and receiving element 3.
61 is the coaxial element connected to coaxial antenna feedpoint junction and impedance unit 51.
62 is the connection of coaxial element 61 inner conductor to impedance unit 51.
63 is the connection of coaxial element 61 outer conductor to impedance unit 51.
64 is the connection of coaxial element 61 inner conductor to coaxial element 3 inner conductor.
65 is the connection of coaxial element 61 outer conductor to junction of radio frequency ground and feedpoint unit 41.
66 is the coaxial conductive radiating and receiving sleeve element surrounding part of coaxial line 55.
67 is the connection of coaxial sleeve element 66 to coaxial line 55 outer conductor connection 59.
68 is the free end of sleeve radiating and receiving element 66.
69 is the end of sleeve radiating and receiving element 66 connection to terminating impedance unit 35.
72 is the conductive material coupled electromagnetically to and in proximity to radiating and receiving element 5.
73 is the conductive material coupled electromagnetically to and in proximity to radiating and receiving element 3.
75 is the conductive material coupled electromagnetically to and in longitudinal proximity to radiating and receiving element 3.
76 is the conductive material coupled electromagnetically to and in longitudinal proximity to radiating and receiving element 5.
77 is the connection between outer conductor of element 3 and conductive material 75.
78 is the connection between outer conductor of element 5 and conductive material 76.

81 is the radio frequency transmission line in feedpoint unit 41.

82 is the conductor part of radio frequency transmission line in feedpoint unit 41.

83 is the conductor part of radio frequency transmission line in feedpoint unit 41.

84 is the radio frequency coaxial transmission line in feedpoint unit 41.

85 is the radio frequency balanced to unbalanced balun transformer device.

86 is the radio frequency impedance transformer device.

87 is the radio frequency balanced to unbalanced balun and impedance transformer device.

91 is the resistive impedance as part of terminating unit 33.

92 is the resistive impedance as part of terminating unit 35.

93 is the heat sink for resistive impedance 91 as part of terminating unit 33.

94 is the heat sink for resistive impedance 92 as part of terminating unit 35.

97 is the resistive impedance as part of terminating unit 51.

98 is the heat sink for resistive impedance 97 as part of terminating unit 51.

102 is the capacitive reactance as part of terminating unit 33.

103 is the capacitive reactance as part of terminating unit 35.

104 is the capacitive reactance as part of terminating unit 33.

105 is the capacitive reactance as part of terminating unit 51.

112 is the inductive reactance as part of terminating unit 33.

113 is the inductive reactance as part of terminating unit 35.

114 is the inductive reactance as part of terminating unit 33.

115 is the inductive reactance as part of terminating unit 51.

121 is the coaxial radio frequency transmission line open stub as part of terminating unit 33.

122 is the coaxial radio frequency transmission line shorted stub as part of terminating unit 33.

124 is the coaxial radio frequency transmission line shorted stub as part of terminating unit 51.

131 is the central connection unit for coaxial antenna system elements and radio frequency transmission line and/or housing for terminal unit 51.

133 is the end housing of terminating unit 33 and/or reel for winding element 3 of coaxial antenna system.

135 is the end housing of terminating unit 35 and/or reel for winding element 5 of coaxial antenna system.

136 is the crank for reel 133 for winding element 3.

137 is the crank for reel 135 for winding element 5.

141 is the housing and/or reel for transmission line from feedpoint unit 41 to central part 131 and/or housing for feedpoint unit 41.

144 is the connector on housing 141 connecting feedpoint unit 41 terminals 43 and 44.

146 is the crank for reel 141 for winding transmission line 147.

147 is the radio frequency transmission line from feedpoint unit 41 to central part 131 and/or unit 51 of coaxial antenna system.

151 is the transmitter and/or receiver of radio frequencies connected to coaxial antenna system 1.

152 is the user interface unit for transmitter and/or receiver 151.

161 is the material upon which coaxial antenna system 1 is mounted or coupled to such as circuit board.

162 is the housing or radome containing or partially containing coaxial antenna system 1.

What I claim as my invention is:

1. An antenna system for electromagnetic energy comprising:

a feedpoint having a first connection electrically connected to a first end of an outside conductor of a first coaxial antenna element with said feedpoint having a second connection electrically connected to a first end of an outside conductor of a second coaxial antenna element;

an inside conductor of said first end of said first coaxial antenna element electrically connected to an inside conductor of said first end of said second coaxial antenna element;

at least one second end of at least one said coaxial antenna element having electrical connections to a terminating impedance at said second end of said coaxial antenna element with said terminating impedance electrically connected between said inside conductor and said outside conductor of said coaxial antenna element.

2. The antenna system of claim 1 wherein at least one terminating impedance has reactance.

3. The antenna system of claim 1 wherein at least one terminating impedance has capacitance.

4. The antenna system of claim 1 wherein an outer conductor of at least one coaxial antenna element operatively coupled to a separate conductive surface along at least a portion of the length of the outer conductor of said coaxial antenna element.

5. The antenna system of claim 1 wherein at least one terminating impedance has inductance.

6. The antenna system of claim 1 wherein at least one terminating impedance has resistance.

7. The antenna system of claim 1 wherein at least one terminating impedance has a transmission line stub.

8. The antenna system of claim 1 wherein at least a portion of electrically conductive material has a dissipative resistive characteristic for electromagnetic energy.

9. An antenna system for electromagnetic energy comprising:

a feedpoint having a first connection electrically connected to a first end of an outside conductor of a coaxial antenna element with said feedpoint having a second connection electrically connected to an electrically conductive reference planet;

an inside conductor of said first end of said coaxial antenna element electrically connected to said electrically conductive reference plane via electrical connection through a first terminating impedance;

a second end of said coaxial antenna element having electrical connections to a second terminating impedance at said second end of said coaxial antenna element with said second terminating impedance connected between said inside conductor and said outside conductor of said coaxial antenna element.

10. The antenna system of claim 9 wherein at least one terminating impedance has reactance.

11. The antenna system of claim 9 wherein at least one terminating impedance has capacitance.

12. The antenna system of claim 9 wherein at least one terminating impedance has inductance.

13. The antenna system of claim 9 wherein at least one terminating impedance has resistance.

14. The antenna system of claim 9 wherein at least one terminating impedance has a transmission line stub.

15. The antenna system of claim 9 wherein at least a portion of electrically conductive material has a dissipative resistive characteristic for electromagnetic energy.

16. The antenna system of claim 9 wherein at least one antenna element is operatively coupled to a separate conductive surface along at least a portion of the length of said antenna element.

17. The antenna system of claim 9 wherein at least one reference plane is a separate conductive antenna element.

18. The antenna system of claim 9 wherein at least one reference plane is an electrical ground plane.

19. An antenna system for electromagnetic energy having a feedpoint first electrical connection to an outside conductor of a first coaxial antenna element while having at least one reactance electrically connected to at least one end of said first coaxial antenna element with said reactance connected between an inside conductor and said outside conductor of said first coaxial antenna element with said feedpoint having a second electrical connection to an outside conductor of a first end of a second coaxial antenna element with said inside conductor of said first end of said first coaxial element and an inside conductor of said second coaxial element electrically connected.

20. The antenna system of claim 19 wherein at least one reactance has capacitance.

21. The antenna system of claim 19 wherein an outer conductor of at least one coaxial antenna element is operatively coupled to a separate conductive surface along at least a portion of the length of the outer conductor of said coaxial antenna element.

22. The antenna system of claim 19 wherein at least one reactance has inductance.

23. The antenna system of claim 19 wherein at least one reactance has resistance.

24. The antenna system of claim 19 wherein at least one reactance has a transmission line stub.

25. The antenna system of claim 19 wherein at least a portion of electrically conductive material has a dissipative resistive characteristic for electromagnetic energy.

26. An antenna system for electromagnetic energy having a feedpoint first electrical connection to an outside conductor of a coaxial antenna element while having at least one reactance electrically connected to at least one end of said coaxial antenna element with said reactance connected operatively to an inside conductor of said coaxial antenna element with said feedpoint having a second electrical connection to an electrically conductive reference plane.

27. The antenna system of claim 26 wherein at least one reactance has capacitance.

28. The antenna system of claim 26 wherein at least one reactance has inductance.

29. The antenna system of claim 26 wherein at least one reactance has resistance.

30. The antenna system of claim 26 wherein at least one reactance has a transmission line stub.

31. The antenna system of claim 26 wherein at least a portion of electrically conductive material has a dissipative resistive characteristic for electromagnetic energy.

32. The antenna system of claim 26 wherein at least one antenna element is operatively coupled to a separate conductive surface along at least a portion of the length of said antenna element.

33. The antenna system of claim 26 wherein at least one reference plane is a separate conductive antenna element.

34. The antenna system of claim 26 wherein at least one reference plane is an electrical ground plane.

* * * * *